United States Patent [19]

Shirai et al.

[11] Patent Number: 4,464,451

[45] **Date of Patent: * Aug. 7, 1984**

[54] ELECTROPHOTOGRAPHIC IMAGE-FORMING MEMBER HAVING ALUMINUM OXIDE LAYER ON A SUBSTRATE

[75] Inventors: Shigeru Shirai, Yamato; Junichiro Kanbe; Tadaji Fukuda, both of Yokohama, all of Japan

[73] Assignee: Canon Kabushiki Kaisha, Tokyo, Japan

[ * ] Notice: The portion of the term of this patent subsequent to Nov. 22, 2000 has been disclaimed.

[21] Appl. No.: 344,056

[22] Filed: Jan. 29, 1982

[30] Foreign Application Priority Data

| | | | |
|---|---|---|---|
| Feb. 6, 1981 | [JP] | Japan | 56/16410 |
| Feb. 6, 1981 | [JP] | Japan | 56/16412 |
| Feb. 16, 1981 | [JP] | Japan | 56/16411 |
| Apr. 23, 1981 | [JP] | Japan | 56/62065 |
| Apr. 23, 1981 | [JP] | Japan | 56/62066 |
| Apr. 23, 1981 | [JP] | Japan | 56/62068 |
| Apr. 24, 1981 | [JP] | Japan | 56/62178 |
| Apr. 24, 1981 | [JP] | Japan | 56/62179 |
| Apr. 24, 1981 | [JP] | Japan | 56/62180 |

[51] Int. Cl.[3] ..... G03G 5/082

[52] U.S. Cl. ..... 430/65; 430/67; 430/69; 430/84; 430/95

[58] Field of Search ..... 430/60, 65, 66, 67, 430/84, 95; 427/74, 39; 252/501.1

[56] References Cited

U.S. PATENT DOCUMENTS

| | | | |
|---|---|---|---|
| 3,210,184 | 10/1965 | Uhlig | 430/65 |
| 4,217,374 | 8/1980 | Ovshinsky et al. | 430/84 X |
| 4,226,898 | 10/1980 | Ovshinsky et al. | 430/84 X |
| 4,251,289 | 2/1981 | Moustakas et al. | 204/192 P X |
| 4,253,882 | 3/1981 | Dalal | 427/74 X |
| 4,265,991 | 5/1981 | Hirai et al. | 430/65 X |
| 4,289,822 | 9/1981 | Shimada et al. | 427/74 X |

*Primary Examiner*—John E. Kittle
*Assistant Examiner*—John L. Goodrow
*Attorney, Agent, or Firm*—Fitzpatrick, Cella, Harper & Scinto

[57] ABSTRACT

An electrophotographic image-forming member comprises a substrate for electrophotography and an amorphous layer which is laid on said substrate and constituted of silicon atoms as matrix containing at least one of hydrogen atom and halogen atom and exhibits photoconductivity, said substrate being constituted of aluminum oxide containing chemi-structurally water at least on the surface thereof, and said amorphous layer having a layer region containing at least one member selected from the group consisting of oxygen atom, nitrogen atom and carbon atom in at least a part thereof, the content of said member in said layer region being distributed unevenly in the direction of the thickness of said layer.

167 Claims, 14 Drawing Figures

ELECTROPHOTOGRAPHIC IMAGE-FORMING MEMBER HAVING ALUMINUM OXIDE LAYER ON A SUBSTRATE

BACKGROUND OF THE INVENTION

1. Field of the Invention

The present invention relates to an electrophotographic image-forming member used in the field of image formation, which has a sensitivity to electromagnetic waves such as light (herein used in a broad sense, including ultraviolet rays, visible light, infrared rays, X-rays, gamma-rays, and the like).

2. Description of the Prior Art

Se, Se-Te, CdS, ZnO, and organic photoconductive materials such as PVCz, TNF, and the like are well known as a photoconductive material constituting a photoconductive layer in an electrophotographic image-forming member. As disclosed, for example, German Laid-open Patent Application Nos. 2746967 and 2855718, amorphous silicon (hereinafter referred to as a-Si) has recently attracted attention as a possible photoconductive material in view of advantages that a-Si has comparable characteristics to other photoconductive materials in photosensitivity, spectral wave region, response to light, dark resistance, and the like. In addition, it as no harm to human bodies during usage and is easily capable of controlling p-n in spite of amorphism.

As mentioned above, a-Si has various superior charcteristics to other photoconductive materials, the practical application of which as an electrophotographic image-forming member is under rapid development, although there still remain some points to be solved.

For example, in some cases, when applied in an image-forming member for electrophotography, residual potential is observed to remain during use thereof. Therefore, when such image-forming member is repeatedly used for a long time, there is caused an accumulation of electrical or photoconductive fatigue which causes the so-called ghost phenomenon. In other words, there occur problems such as whitening in transferred images and the like.

Further, when preparing a photoconductive layer having a thickness of ten and several microns or more, after taking out the photoconductive member having such thick photoconductive layer from a vacuum-deposition chamber, the photoconductive layer tends to separate from or peel off the surface of the substrate, on which the photoconductive layer is laid, or to crack with the passage of time. These phenomena are problems to be solved in view toward storage stability, since these phenomena frequently occur in the case of a cylindrical substrate used generally in the field of electrophotography, or the like.

Further, according to the experience of the present inventors from a number of experiments, a-Si material constituting the photoconductive layer of an image-forming member for electrophotography, while it has a number of advantages, as compared with Se, CdS, ZnO or organic photoconductive materials such as PVCz or TNF of prior art, is also found to have several problems to be solved. Namely, when charging treatment is applied for formation of electrostatic images on the photoconductive layer of an image-forming member for electrophotography having a photoconductive member constituted of a mono-layer of a-Si which has been endowed with characteristics for use in a solar battery of the prior art, dark decay is markedly rapid, so that it is difficult to use conventional photographic methods. This tendency is further pronounced under a humid atmosphere to such an extent in some cases that no charge is retained at all before development.

Thus, it is required in designing of a photoconductive material to make efforts to obtain desirable electrical, optical, and photoconductive characteristics along with the improvement of a-Si materials per se and to obtain stable image quality with high sensitivity.

In view of the above-mentioned points, the present invention has succeeded in establishing, as a result of extensive and difficult studies, a relationship between a photoconductive layer and a substrate on which the photoconductive layer is laid from the standpoints of mechanical, electrical, photoconductive, and durable charcteristics of the photoconductive layer itself. This was established where the photoconductive layer is prepared with an amorphous material [hereinafter referred to as a-Si(H, X)] which contains at least one of hydrogen atom (H) and halogen atom (X) in a matrix of silicon atom.

In other words, the present inventors observed that a large strain is generated in the layer of a-Si(H, X) upon formation, and that the strain causes separation from, or peeling from a surface of a substrate, on which the layer is laid, or cracking. On account of this, they have found it necessary to eliminate the above-mentioned disadvantages such that the strain in the formed layer is removed or relaxed to the extent that it has no effect on the layer by any means, that mechanical and electrical contact between the substrate and the layer of a-Si is optimized, that closeness between them is improved, and that the optimum conditions satisfying concurrently the above-mentioned requires are provided for obtaining an electrophotographic image-forming member having excellent durability. Establishment of such optimum conditions has been accomplished as a result of extensive and strenuous studies.

SUMMARY OF THE INVENTION

It is the primary object of the present invention to provide an electrophotographic image-forming member having excellent aging stability of electrophotographic charcteristics even in repeated usage over a long time.

It is another object of the present invention to provide an electrophotographic image-forming member being substantially free from electric and photoconductive fatigue even in continuous usage over a long time.

It is a further object of the present invention to provide an electrophotographic image-forming member excellent in mechanical durability, closeness, and electrical and photoconductive characteristics between a substrate and a photoconductive layer thereon.

Still another object of the present invention is to provide an electrophotographic image-forming member having uniformly stable electrical, optical and photoconductive characteristics, having unlimited use in its environments, being especailly excellent in light-resistant fatigue without deterioration after repeated uses and free entirely or substantially from residual potentials.

Further, still another object of the present invention is to provide an electrophotographic image-forming member, having a high photosensitivity with a spectral sensitive region covering substantially all over the region of visible light, and having also a rapid response to light.

Further, still another object of the present invention is to provide an electrophotographic image-forming member, which is sufficiently capable of bearing charges at the time of charging treatment for formation of electrostatic charges to the extent such that a conventional electrophotographic method can be applied when it is provided for use as an image-forming member for electrophotography, and which has excellent electrophotographic characteristics, such that substantially no deterioration is observed even under a highly humid atmosphere.

Further, still another object of the present invention is to provide an electrophotographic image-forming member for electrophotography capable of providing easily a high quality image which is high in density, clear in halftone and high in definition.

According to the present invention, there is provided an electrophotographic image-forming member comprising a substrate for electrophotography, the surface of said substrate being constituted of aluminum oxide containing chemistructurally water, and an amorphous layer [a-Si (H, X)] which is constituted of silicon atoms as matrix containing at least one of hydrogen atom (H) and halogen atom (X) and exhibits photoconductivity, said amorphous layer having a layer region containing at least one member selected from the group consisting of oxgen atoms, nitrogen atoms and carbon atoms in at least a part thereof, the content of said member in said layer region being distributed unevenly in the direction of the thickness of said layer.

DESCRIPTION OF THE PREFERRED EMBODIMENTS

Figure 1:
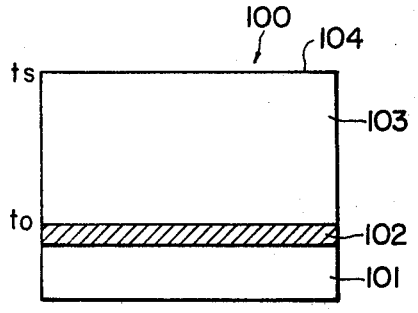
FIG. 1 shows a schematic sectional view of a preferred embodiment of the electrophotographic image-forming member according to the present invention.

Referring now to the drawing, the electrophotographic image-forming members according to the present invention are to be described in detail below.

FIG. 1 shows a schematic sectional view for illustration of a typical exemplary construction of the electrophotographic image-forming member of this invention.

The electrophotographic image-forming member 100 as shown in FIG. 1 comprises a substrate 101 for electrophotographic image-forming having a surface of aluminum oxide containing chemistructually water. Layer 102, which may optionally be provided on said substrate is a barrier layer as an intermediate layer. An amorphous layer 103 exhibiting photoconductivity, said amorphous layer having a layer region containing at least one member selected from the group consisting of oxygen atoms, nitrogen atoms and carbon atoms in at least a part thereof, the content of said member in said layer region being distributed unevenly in the direction of thickness of the layer is on said barrier layer.

The photoconductive member designed to have the layer structure as described above has overcome all of the problems as mentioned above and exhibits excellent electrical, optical and photoconductive characteristics as well as good adaptability for environments during usage.

In particular, when it is applied as an image-forming member for electrophotography, it has good charge bearing capacity during charging treatment without influence of residual potential on the image formation, and its electrical properties are stable even in a high humid atmosphere. Moreover, it is highly sensitive and has a high SN ratio as well as good performance after repeated uses, thus being capable of giving constantly visible images of high quality with high density, clear halftone and high resolution.

The substrate 101 comprises a coating of aluminum oxide containing chemi-structurally water at least on the surface thereof. Such coating can be obtained as composition of $Al_2O_3.H_2O$ or $Al_2O_3.3H_2O$ by the following process. Anodic oxidation treatment is applied onto a surface of a substrate of pure aluminum or aluminum alloy which is suitably pre-treated after processing and forming for electrophotography. After a suitable pre-treatment is, if necessary, carried out, the resulting substrate is treated with boiling water or steam to obtain a surface of $Al_2O_3.H_2O$ or $Al_2O_3.3H_2O$.

For the anodic oxidation treatment is employed a process capable of forming a coating having excellent dielectric strength. Typical processes are the oxalic acid process, the sulphuric acid process, and chromic acid process, and the like.

For example, in the oxalic acid process, the following electrolytic solutions can be used.

(1) Solution of 1–3 percent by weight of oxalic acid or oxalates.

(2) Solution of 1–3 percent by weight of malonic acid or malonates.

(3) Aqueous solution of 35 g of oxalic acid and 1 g of $KMnO_4$ is one liter water.

In these cases, current density and voltage are suitably determined depending upon an electrolytic solution to be used, a material to be treated, and the like. The current density is preferably 3–20 Amp/dm$^2$, the voltage is preferably about 40–120 Volt.

The temperature of the solution during anodic oxidation is preferably about 10°–30° C.

In the sulfuric acid process, a coating having special characteristics can be formed under the conditions that a concentration of the electrolytic solution is preferably 10–70 percent, the voltage preferably 10–15 Volt, and then treating time preferably 10–15 minutes.

In this case, a working power is preferably 0.5–2 KWh/m$^2$ and the treating temperature preferably about 15°–30° C.

For example, for forming a strong and hard coating, a solution of 5% by volume of sulfuric acid and 5% by volume of glycerol is used, a voltage of 12–15 Volt is applied, and the treatment may be carried out for 20–40 minutes. On the contrary, for forming a flexible coating, a solution of 25% by volume of sulfuric acid and 20% by volume of glycerol is used and the treatment may be carried out at 12°–30° C., voltage of 15 volt is supplied for 30–60 minutes. Alternatively, using an electrolytic solution of 5–10% by volume of sulfuric acid and some of $Al_2(SO_4)_3$, the treatment can be carried out at a bath-temperature of about 15°-20° C. A working power is about 2 KWh/m$^2$ for obtaining a hard coating, and a working power about 0.5-1 KWh/m$^2$ for obtaining a soft coating.

For maximizing dielectric strength of such a formed coating, a treatment may be carried out under such conditions that the concentration of $H_2SO_4$ is 60-77 percent, glycerol is added to the solution in the ratio of 1 part per 15 parts of the solution by volume, the bath-temperature is 20°-30° C., the applied voltage about 12 Volt, and the current density 0.1-1.0 Amp/dm$^2$.

A substrate treated by the above-mentioned anodic oxidation process, after optionally carrying out a suitable pre-treatment such as washing and the like, is treated with boiling water or steam to form a coating in its final state.

The treatment with boiling water may be carried out in such a way that a substrate treated with the above-mentioned anodic oxidation processes is dipped into the deionized water of about 80°-100° C. of which pH is controlled 5-9.

The treatment with steam may be carried out in such a way that a substrate treated with the above-mentioned processes previously is fully washed with boiling water and treated with a reductive aqueous solution containing $TiCl_3$, $SnCl_2$, $FeSO_4$, etc. to remove completely components of an electrolytic solution which are associated with the coating, followed by exposure to superheated steam of about 4-5.6 Kg/cm$^2$ for a suitable period of time.

In the present invention, as an aluminum alloy on which a coating having the desired characteristics the capability of matching with a photocondutive layer formed thereon can be formed, there is included the Al-Mg-Si series, Al-Mg series, Al-Mg-Mn series, Al-Mn series, Al-Cu-Mg series, Al-Cu-Ni series, Al-Cu series, Al-Si series, Al-Cu-Zn series, Al-Cu-Si series, and the like. Particular alloys include those which are commercially available under names as: A51S, 61S, 63S, Aludur, Legal, Anticorodal, Pantal, Silal V, RS, 52S, 56S, Hydronalium, BS-Seewasser, 4S, KS-Seewasser, 3S, 14S, 17S, 24S, Y-alloy, NS, RS, Silumin, American alloy, German alloy, Kupfer-Silumin, Silumin-Gamma, and the like.

The thickness of the coating containing chemistructurally water and constituting the surface of the substrate according to the present invention is depends upon the relative relationship among characteristics, constituting materials, thickness, and the like of a photoconductive layer formed on the coating. The thickness of the coating is generally 0.05-10$\mu$, preferably 0.1-5$\mu$, most preferably 0.2-2$\mu$.

The barrier layer 102 has the function of barring effectively penetration of free carriers into the side of the amorphous layer 103 from the side of the substrate 101 and permitting the photocarriers generated by irradiation of electromagnetic waves in the amorphous layer 103 and migrating toward the substrate 101 to easily pass therethrough from the side of the amorphous layer 103 to the side of the substrate 101.

While the barrier layer 102 can be provided to give the function as described above, it is not absolutely required in the present invention to provide such a barrier layer 102. If a function similar to that of the barrier layer 102 can be sufficiently exhibited at the interface between the substrate 101 and the amorphous layer 103 when the amorphous layer 103 is provided directly on the substrate 101, barrier layer 102 is not required.

The barrier layer 102, which is formed so as to have the function as described above exhibited to its full extent, may also desirably be formed so as to provide mechanical and electrical contact and adhesion between the substrate 101 and the amorphous layer 103. As the material constituting the barrier layer 102, most materials can be adopted so long as they can give the various characteristics as mentioned above as desired.

Among such materials, those specifically mentioned as effective materials for the present invention may include amorphous materials containing at least one kind of atom selected from the group consisting of carbon(C), nitrogen(N) and oxygen(O), optionally together with at least one of hydrogen atom and halogen atom, in a matrix of silicon atoms [these are referred to comprehensively as a—$[Si_x(C,N)_{1-x}]_y(H,X)_{1-y}$(where $0<x<1$, $0<y<1$)]; electrically insulating metal oxides, electrically insulating organic compounds; or the like.

In the present invention, in case of the materials containing halogen atoms(X) among those constituting the above-mentioned barrier layer 102, the halogen atom may preferably be F, Cl, Br or I, especially F or Cl.

Typical examples of the amorphous materials as mentioned above effectively used for constituting the barrier layer 102 may include, for example, carbon type amorphous materials such as a—$Si_aC_{1-a}$, a—$(Si_bC_{1-b})_cH_{1-c}$, a—$(Si_dC_{1-d})_eX_{1-e}$, a—$(Si_fC_{1-f})_g(H+X)_{1-g}$; nitrogen type amorphous materials such as a—$Si_hN_{1-h}$, a—$(Si_iN_{1-i})_jH_{1-j}$, a—$(Si_kN_{1-k})_lX_{1-l}$, a—$(Si_mN_{1-m})_n(H+X)_{1-n}$; oxygen type amorphous materials such as a—$Si_oO_{1-o}$, a—$(Si_pO_{1-p})_qH_{1-q}$, a—$(Si_rO_{1-r})_sX_{1-s}$, a—$(Si_tO_{1-t})_u(H+X)_{1-u}$; etc. Further, there may also be mentioned amorphous materials containing at least two or more kinds of atoms of C, N and O as constituent atoms in the amorphous materials as set forth above (where $o<a, b, c, d, e, f, g, h, i, j, k, l, m, n, o, p, q, r, s, t, u<1$).

These amorphous materials may suitably be selected depending on the properties required for the barrier 102 by optimum design of the layer structure and easiness in consecutive fabrication of the amorphous layer 103 to be superposed on said barrier layer 102. In particular, from standpoint of properties, nitrogen type and oxygen type amorphous materials, especially oxygen type amorphous materials may preferably be selected.

The barrier layer 102 constituted of amorphous materials as mentioned above may be formed by the glow discharge method, the sputtering method, the ion implantation method, the ion plating method, the electron-beam method or the like.

When the barrier layer 102 is formed according to the glow discharge method, the starting gases for formation of the aforesaid amorphous material, which may be admixed, if necessary, with a diluting gas at a desired mixing ratio, are introduced into the chamber for vacuum deposition, and the gas introduced is converted to a gas plasma by excitation of glow discharge in said gas thereby to deposit the substance for forming the aforesaid amorphous material on the substrate 101.

In the present invention, the substances effectively used as the starting materials for formation of the barrier layer 102 constituted of carbon type amorphous materials may include silicon hydride gases constituted of Si and H atoms such as silanes, as exemplified by $SiH_4$, $Si_2H_6$, $Si_3H_8$, $Si_4H_{10}$, etc., hydrocarbons constituted of C and H atoms such as saturated hydrocarbons having 1 to 5 carbon atoms, ethylenic hydrocarbons having 2 to 5 carbon atoms or acetylenic hydrocarbons having 2 to 4 carbon atoms. More specifically, typical examples are saturated hydrocarbons such as methane($CH_4$), ethan($C_2H_6$), propane($C_3H_8$), n-butane(n-$C_4H_{10}$), pentane($C_5H_{12}$), and the like; ethylenic hydrocarbons such as ethylene($C_2H_4$), propylene($C_3H_6$), butene-1($C_4H_8$), butene-2($C_4H_8$), isobutylene($C_4H_8$), petene($C_5H_{10}$), and the like; and acetylenic hydrocarbons such as acetylene($C_2H_2$), methylacetylene($C_3H_4$), butyne($C_4H_6$), and the like.

Typical examples of the starting gas constituted of Si, C and H are alkyl silanes such as $Si(CH_3)_4$, $Si(C_2H_5)_4$ and the like. In addition to these starting gases, $H_2$ can of course be effectively used as the starting gas for introduction of hydrogen atoms(H).

Among the starting gas for formation of the barrier layer 102 constituted of carbon type amorphous materials containing halogen atoms, the starting materials for supplying halogen atoms may include single substances of halogen, hydrogen halides, interhalogen compounds, silicon halides, halogen-substituted silicon hydrides, etc. More specifically, there may be included single substances of halogen such as halogenic gases of fluorine, chlorine, bromine and iodine; hydrogen halides such as HF, HI, HCl, HBr, etc.; interhalogen compounds such as BrF, ClF, $ClF_3$, $ClF_5$, $BrF_5$, $IF_7$, $IF_5$, ICl, IBr, etc.; silicon halides such as $SiF_4$, $Si_2F_6$, $SiCl_4$, $SiCl_3Br$, $SiCl_2Br_2$, $SiClBr_3$, $SiCl_3I$, $SiBr_4$, etc.; halogen-substituted silicon hydrides such as $SiH_2F_2$, $SiH_2Cl_2$, $SiHCl_3$, $SiH_3Cl$, $SiH_3Br$, $SiH_2Br_2$, $SiHBr_3$.

In addition to those mentioned above, there are halogen-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$, etc.; fluorinated sulfur compounds such as $SF_4$, $SF_6$, etc.; alkyl silanes such as $Si(CH_3)_4$, $Si(C_2H_5)_4$, etc.; and halogen-containing alkyl silanes such as $SiCl(CH_3)_3$, $SiCl_2(CH_3)_2$, $SiCl_3CH_3$, etc.

These substances for forming barrier layer may be selected and used as desired in formation of the barrier layer so that silicon atoms, carbon atoms and, if necessary, halogen atoms and hydrogen atoms may be incorporated at a desirable composition ratio in the barrier layer formed.

For example, it is possible to form a barrier layer constituted of a—$(Si_fC_{1-f})_g(H+X)_{1-g}$ by introducing $Si(CH_3)_4$, which can incorporate silicon atoms, carbon atoms and hydrogen atoms easily and can form a barrier layer of desired properties, together with a compound for incorporation of halogen atoms such as $SiHCl_3$, $SiCl_4$, $SiH_2Cl_2$, $SiH_3Cl$, or the like at a suitable mixing ratio in a gaseous state into a device for formation of the barrier layer, followed by excitation of glow discharge therein.

When the glow discharge method is adopted for constitution of the barrier layer 102 with a nitrogen type amorphous material, a desired material may be selected from those mentioned above for formation of the barrier layer and the starting material for supplying nitrogen atoms may be used in addition thereto. Namely, as the starting materials which can effectively be used as starting gases for supplying nitrogen atoms in forming the barrier layer 102, there may be mentioned compounds constituted of N or N and H including gaseous or gasifiable nitrogen, nitrides and azides, as exemplified by nitrogen($N_2$), ammonia($NH_3$), hydrazine($H_2NNH_2$), hydrogen azide($HN_3$), ammonium azide($NH_4N_3$), and so on. In addition, it is also possible to use a nitrogen halide compound which can incorporate both nitrogen atoms and halogen atoms, such as nitrogen trifluoride($F_3N$), nitrogen tetrafluoride($F_4N_2$), and the like.

When the glow discharge method is adopted for constituting the barrier layer 102 with an oxygen type amorphous material, a desirable substance is selected from those for formation of the barrier layer as mentioned above and a starting material which can be a starting gas for supplying oxygen atoms may be used in combination. That is, as the starting materials which can be effectively used as starting gases for supplying oxygen atoms in formation of the barrier layer 102, there may be mentioned oxygen($O_2$), ozone($O_3$), disiloxane($H_3SiOSiH_3$), trisiloxane($H_3SiOSiH_2OSiH_3$), etc.

Other than these starting materials for formation of the barrier layer, there may also be mentioned, for example, carbon monoxide(CO), carbon dioxide($CO_2$), dinitrogen oxide($N_2O$), nitrogen monoxide(NO), dinitrogen trioxide($N_2O_3$), nitrogen dioxide($NO_2$), dinitrogen tetraoxide($N_2O_4$), dinitrogen pentoxide($N_2O_5$), nitrogen trioxide($NO_3$), and the like.

As described above, when forming a barrier layer 102 according to the glow discharge method, the starting materials for formation of the barrier layer are suitably selected from those mentioned above so that the barrier layer having the desired characteristics, which is constituted of desired materials, can be formed. For example, when using the glow discharge method, there may be employed a single gas such as $Si(CH_3)_4$, $SiCl_2(CH_3)_2$ and the like, or a gas mixture such as $SiH_4$—$N_2O$ system, $SiH_4$—$O_2$(—Ar) system, $SiH_4$—$NO_2$ system, $SiH_4$—$O_2$—$N_2$ system, $SiCl_4$—$NH_3$—NO system, $SiCl_4$—NO—$H_2$ system, $SiH_4$—$NH_3$ system, $SiCl_4$—$NH_3$ system, $SiH_4$—$N_2$ system, $Si(CH_3)_4$—$SiH_4$ system, $SiCl_2(CH_3)_2$—$SiH_4$ system, etc. as the starting material for formation of the barrier layer 102.

Alternatively, the barrier layer 102 can be formed according to the sputtering method by using a single crystalline or polycrystalline Si wafer, C wafer, or a wafer containing Si and C mixed therein as target, and effecting sputtering of these in various atmospheres. For example, when Si wafer is used as a target, the starting gas for introduction of carbon atoms(C) and hydrogen atoms(H) or halogen atoms(X) which may optionally be diluted with a diluting gas, if desired, are introduced into the deposition chamber to form a gas plasma of these gases and effect sputtering of the aforesaid Si wafer. As other methods, by use of separate targets of Si and C, or one sheet of a mixture of Si and C, sputtering can be effected in a gas atmosphere containing at least hydrogen atoms(H) or halogen atoms(X).

As the starting gases for incorporation of carbon atoms, hydrogen atoms or halogen atoms in the barrier layer formed, the aforesaid starting gases as shown in the glow discharge method may also be useful in the sputtering method.

For formation of a barrier layer 102 constituted of a nitrogen type amorphous material according to the sputtering method, a single crystalline or polycrystalline Si wafer or $Si_3N_4$ wafer or a wafer containing Si and $Si_3N_4$ mixed therein may be used as a target and sputtering may be effected in various gas atmospheres.

For example, when Si wafer is used as a target, a starting gas for introduction of nitrogen atoms optionally together with a starting gas for incorporation of hydrogen atoms and/or halogen atoms, for example $H_2$ and $N_2$ or $NH_3$, which may be diluted with a diluting gas if desired, is introduced into a deposition chamber. A gas plasma of these gases is formed and the aforesaid Si wafer is subjected to sputtering.

Alternatively, with the use of Si and $Si_3N_4$ as separate targets or with the use of a target of one sheet of a mixture of Si and $Si_3N_4$, sputtering may be effected in a diluted gas atmosphere or in a gas atmosphere containing at least one of H atoms and X atoms.

As the starting gas for introduction of nitrogen atoms(N) in the sputtering process, there may be employed those recited for introduction of nitrogen atoms(N) among the starting materials, as shown in the examples for forming the barrier layer by the glow discharge method.

For formation of a barrier layer 102 constituted of an oxygen type amorphous material according to the sputtering method, a single crystalline or polycrystalline Si wafer or $SiO_2$ wafer or a wafer containing Si and $SiO_2$ mixed therein may be used as a target and sputtering may be effected in various gas atmospheres.

For example, when Si wafer is used as a target, a starting gas for introduction of oxygen atoms optionally together with a starting gas for incorporation of hydrogen atoms and/or halogen atoms, for example, $SiH_4$ and $O_2$, or $O_2$, which may be diluted with a diluting gas if desired, is introduced into a deposition chamber, a gas plasma of these gases is formed and the aforesaid Si wafer is subjected to sputtering.

Alternatively, with the use of Si and $SiO_2$ as separate targets or with the use of a target of one sheet of a mixture of Si and $SiO_2$, sputtering may be effected in a diluted gas atmosphere or in a gas atmosphere containing at least one of H atoms and X atoms.

As the starting gas for introducing oxygen atoms(O), in the sputtering process there may be employed those recited for introduction of oxygen atoms(O) among the starting materials, as shown in the examples for forming the barrier layer by the glow discharge method.

As the diluting gas to be employed in forming the barrier layer 102 according to the glow discharge method or the sputtering method, there may included so called rare gases such as He, Ne, Ar, and the like as suitable ones.

When the barrier layer 102 is constituted of the amorphous material as described above, it is formed carefully so that the characteristics required may be given exactly as described.

That is, a substance constituted of Si and at least one of C, N and O, and optionally H or/and X can take various forms from crystalline to amorphous and electrical properties from conductive through semi-conductive to insulating and from photoconductive to non-photoconductive depending on the preparation conditions. In the present invention, the preparation conditions are severely selected so that there may be formed non-photoconductive amorphous materials at least with respect to the light in the so called visible region.

Since the function of the amorphous barrier layer 102 is to bar penetration of free carriers from the side of the substrate 101 into the amorphous layer 103, while permitting easily the photocarriers generated in the amorphous layer 103 to migrate and pass through to the side of the substrate 101, it is desirable that the above-mentioned amorphous materials are formed to exhibit electrically insulating behaviour at least in the visible light region.

The barrier layer 102 is formed also to have a mobility value with repect to passing carriers to the extent that photocarriers generated in the amorphous layer 103 can pass easily through the barrier layer 102.

As another critical element in the conditions for preparation of the barrier layer 102 from the amorphous material having the characteristics as described above, there is the temperature of the substrate during preparation thereof.

In other words, in forming a barrier layer 102 constituted of the aforesaid amorphous material on the surface of the substrate 101, the substrate temperature during the layer formation is an important factor affecting the structure and characteristics of the layer formed. In the present invention, the substrate temperature during the layer formation is severely controlled so that the aforesaid amorphous material having the intended characteristics may be prepared exactly as desired.

The substrate temperature during formation of the barrier layer 102 is selected conveniently within an optimum range depending on the method employed for formation of the barrier layer 102, and is generally from 20° to 300° C., preferably 50° to 250° C. For formation of the barrier layer 102, it is advantageous to adopt the glow discharge method or the sputtering method. These methods can afford severe control of the atomic ratios constituting each layer or layer thickness with relative ease as compared with other methods, when forming consecutively the amorphous layer 103 on the barrier layer 102 in the same system, and further a third layer formed on the amorphous layer 103, if desired. When forming the barrier layer 102 according to these layer forming methods, the discharging power and the gas pressure during layer formation may also be mentioned in addition to the substrate temperature as described above, as important factors influencing the characteristics of the barrier layer to be prepared.

The discharging power conditions, for preparing the barrier layer 102 having the characteristics to achieve the intended purpose effectively with good productibity, is generally 1 to 300 W, preferably 2 to 150 W. The gas pressure in the deposition chamber is generally $3\times10^{-3}$ to 5 Torr, preferably $8\times10^{-3}$ to 0.5 Torr.

The content of carbon atoms, nitrogen atoms, oxygen atoms, hydrogen atoms and halogen atoms in the barrier layer 102 is an important factor similar to the conditions for preparing the barrier layer 102, for providing the barrier layer with desired characteristics.

In forming the barrier 102 constituted of a—$Si_aC_{1-a}$, the content of carbon atoms may generally be from 60 to 90 atomic %, preferably 65 to 80 atomic %, most preferably 70 to 75 atomic %, and in terms of index a, 0.1 to 0.4, preferably 0.2 to 0.35, most preferably 0.25 to 0.3. In case of the constitution of a—$(Si_bC_{1-b})_cH_{1-c}$, the content of carbon atoms is generally 30 90 atomic %, preferably 40 to 90 atomic %, most preferably 50 to 80 atomic %, and the content of hydrogen atoms generally 1 to 40 atomic %, preferably 2 to 35 atomic %, most preferably 5 to 30 atomic %, in terms of indexes b and c, b being generally 0.1 to 0.5, preferably 0.1 to 0.35, most preferably 0.15 to 0.3, and c being generally 0.60 to 0.99, preferably 0.65 to 0.98, most preferably 0.7 to 0.95. In case of the constitution of a—$(Si_dC_{1-d})_eX_{1-e}$ or a—$(Si_fC_{1-f})_g(H+X)_{1-g}$, the content of carbon atoms is generally 40 to 90 atomic %, preferably 50 to 90 atomic %, most preferably 60 to 80 atomic %, the content of halogen atoms or the sum of the contents of halogen atoms is and hydrogen atoms generally 1 to 20 atomic %, preferably 1 to 18 atomic %, most preferably 2 to 15 atomic %, and the content of hydrogen atoms, when both halogen atoms and hydrogen atoms are contained, is generally 19 atomic % or less, preferably 13 atomic % or less, in terms of d, e, f and g, d and f are generally 0.1 to 0.47, preferably 0.1 to 0.35, most preferably 0.15 to 0.3, e and g 0.8 to 0.99, preferably 0.85 to 0.99, most preferably 0.85 to 0.98.

When the barrier layer 102 is constituted of a nitrogen type amorphous material, the content of nitrogen atoms in case of a—$Si_hN_{1-h}$ is generally 43 to 60 atomic %, preferably 43 to 50 atomic %, namely in terms of representation by h, generally 0.43 to 0.60, preferably 0.43 to 0.50.

In case of the constitution of a—$(Si_iN_{1-i})_jH_{1-j}$, the content of nitrogen atoms is generally 25 to 55 atomic %, preferably 35 to 55 atomic %, and the content of hydrogen atoms generally 2 to 35 atomic %, preferably 5 to 30 atomic %, namely in terms of representation by i and j, i being generally 0.43 to 0.6, preferably 0.43 to 0.5 and j generally 0.65 to 0.98, preferably 0.7 to 0.95. In case of the constitution of a—$(Si_kN_{1-k})_lX_{1-l}$ or a—$(Si_mN_{1-m})_n(H+X)_{1-n}$, the content of nitrogen atoms is generally 30 to 60 atomic %, preferably 40 to 60 atomic %, the content of halogen atoms or the sum of contents of halogen atoms and hydrogen atoms generally 1 to 20 atomic %, preferably 2 to 15 atomic %, and the content of hydrogen atoms, when both halogen atoms and hydrogen atoms are contained, generally 19 atomic % or less, preferably 13 atomic % or less, namely in terms of representation by k, l, m and n, k and m being generally 0.43 to 0.60, preferably 0.43 to 0.49, and l and n generally 0.8 to 0.99, preferably 0.85 to 0.98.

When the barrier layer 102 is constituted of an oxygen type amorphous material, the content of oxygen atoms in the barrier layer 102 constituted of a—$Si_oO_{1-o}$ is generally 60 to 67 atomic %, preferably 63 to 67 atomic %, in terms of o generally 0.33 to 0.40, preferably 0.33 to 0.37. In case of the constitution of a—$(Si_pO_{1-p})_qH_{1-q}$, the content of oxygen atoms in the barrier layer 102 is generally 39 to 66 atomic %, preferably 42 to 64 atomic %, and the content of hydrogen atoms generally 2 to 35 atomic %, preferably 5 to 30 atomic %, in terms of p and q, p being generally 0.33 to 0.40, preferably 0.33 to 0.37 and q generally 0.65 to 0.98, preferably 0.70 to 0.95. When the barrier layer 102 is constituted of a—$(Si_rO_{1-r})_sX_{1-s}$ or a—$(Si_tO_{1-t})_u(H+X)_{1-u}$, the content of oxygen atoms in the barrier layer 102 is generally 48 to 66 atomic %, preferably 51 to 66 atomic %, the content of halogen atoms or the sum of contents of halogen atoms and hydrogen atoms, when hydrogen atoms further are contained, generally 1 to 20 atomic %, preferably 2 to 15 atomic %, with the content of hydrogen atoms, when both halogen atoms and hydrogen atoms are contained, being 19 atomic % or less, preferably 13 atomic % or less. As represented in terms of r, s, t and u, r or t is generally 0.33 to 0.40, preferably 0.33 to 0.37, and s or u generally 0.80 to 0.99, preferably 0.85 to 0.98.

As the electrically insulating metal oxides for constituting the barrier layer 102, there is preferably $Al_2O_3$, BeO, CaO, $Cr_2O_3$, $P_2O_5$, $ZrO_2$, $HfO_2$, $GeO_2$, $Y_2O_3$, $TiO_2$, $Ce_2O_3$, MgO, $MgO.Al_2O_3$, $SiO_2.MgO$, etc. A mixture of two or more kinds of these compounds may also be used to form the barrier layer 102.

The barrier layer 102 constituted of an electrically insulating metal oxide may be formed by the vacuum deposition method, the CVD (chemical vapor deposition) method, the glow discharge decomposition method, the sputtering method, the ion implanation method, the ion plating method, the electron-beam method or the like.

For formation of the barrier layer 102 by the sputtering method, for example, a wafer for formation of a barrier layer may be used as target and subjected to sputtering in an atmosphere of various gases such as He, Ne, Ar and the like.

When the electron-beam method is used, there is placed a starting material for formation of the barrier layer in a boat for deposition, which material may in turn be irradiated by an electron beam to effect vapor deposition of said material.

The barrier layer 102 is formed to exhibit electric insulating bahavior, since the barrier layer 102 has the function of barring effectively penetration of carriers into the amorphous layer 103 from the side of the substrate 101 and permitting the photocarriers generated in the amorphous layer 103 and migrating toward the substrate 101 to easily pass therethrough from the side of the amorphous layer 103 to the side of the substrate 101.

The numerical range of the layer thickness of the barrier layer is an important factor to achieve effectively the above-mentioned purpose. In other words, if the layer is too thin, the function of barring penetration of free carriers from the side of the substrate 101 into the amorphous layer 103 cannot be fulfilled sufficiently. On the other hand, if the layer is too thick, the probability of the photo-carriers generated in the amorphous layer 103 being passed to the side of the substrate 101 is very small. Thus, in none of the cases, can the objects of this invention be achieved.

In view of the above points, the thickness of the barrier layer 102 is generally in the range of from 30 to 1000 Å, preferably from 50 to 600 Å for achieving the objects of the present invention.

In the present invention, in order to achieve its objects effectively, the amorphous layer 103 provided on the substrate 101 is constituted of a—Si(H, X) having the semiconductor characteristics as shown below layer 103 is further subjected to doping with at least one member selected from the group consisting of oxygen atoms, nitrogen atoms and carbon atoms distributed in the direction of the layer thickness in a fashion as hereinafter described:

(1) p-type a—Si(H, X)—containing only acceptor; or containing both donor and acceptor with relatively higher concentration of acceptor(Na);

(2) $p^-$-type a—Si(H, X)—in the type of (1) that containing acceptor with lower acceptor concentration (Na) than (1), when containing only acceptor, or containing acceptor with relatively lower concentration as compared with (1), when containing both acceptor and donor;

(3) n-type a—Si(H, X)—containing only donor; or containing both donor and acceptor with relatively higher concentration of donor (Nd);

(4) $n^-$-type a—Si(H, X)—in the type of (3), that containing donor at lower donor concentration (Nd) than (3), when containing only donor, or containing donor with relatively lower concentration as compared with (3), when containing both acceptor and donor;

(5) i-type a—Si(H, X)—$Na \simeq Nd \simeq O$ or $Na \simeq Nd$.

In the present invention, typical examples of halogen atoms (X) contained in the amorphous layer 103 are fluorine, chlorine, bromine and iodine, and fluorine and chlorine are particularly preferred.

In the amorphous layer in the electrophotographic image-forming member according to the present invention, there is provided a layer region containing at least one member selected from the group consisting of oxygen atoms, nitrogen atoms and carbon atoms which are distributed evenly within a plane substantially parallel to the surface of the substrate but unevenly in the direction of layer thickness. According to a preferred embodiment, in addition to this specific feature, oxygen atoms, nitrogen atoms or carbon atoms are more enriched on the side of the surface opposite to the substrate (i.e. the side of the free surface 104 in FIG. 1), so that the maximum value $C_{max}$ of its distribution content may be located at the aforesaid surface or in the vicinity thereof.

In FIGS. 2 through 5, there are shown typical examples of distributions of oxygen atoms, nitrogen or carbon atoms in the layer thickness direction of amorphous layer contained in the amorphous layer of a electrophotographic image-forming member having such content distribution of oxygen atom, nitrogen atom or carbon atom. In FIGS. 2 through 5, the axis of ordinate shows the layer thickness t of the amorphous layer 103, $t_0$ indicating the positions of the interface (lower source) between the amorphous layer 103 and other material such as the substrate 101, the barrier layer 102, and the like, and $t_s$ the position of the interface (upper surface) (the same position as the free surface 104 in FIG. 1) of the amorphous layer 103 in the side of the free surface 104, wherein the layer thickness t increases from $t_0$ toward $t_s$. The axis of abscissa shows the distribution content of oxygen atoms, nitrogen atoms or carbon atoms, C, at any position in the layer thickness direction in the amorphous layer 103, wherein the increase of distribution content is indicated in the direction of the arrowhead and $C_{max}$ indicates the maximum distribution content of oxygen atoms nitrogen atoms or carbon atoms at a certain position in the direction of the thickness layer of the amorphous layer 103.

Figure 2:
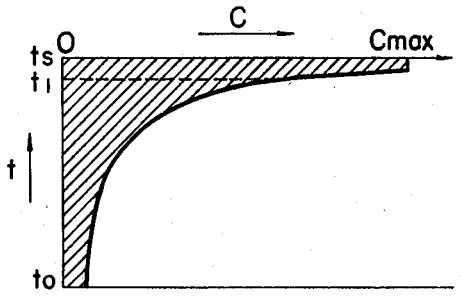
FIGS. 2 through 12 indicate schematically distribution profiles of oxygen atoms, nitrogen atoms or carbon atoms in the amorphous layers of preferred embodiments of the electrophotographic image-forming members according to the present invention, respectively.

In the embodiment as shown in FIG. 2, the content of oxygen atoms, nitrogen atoms or carbon atoms, contained in the amorphous layer 103 is distributed in said layer 103, in such a way that the content of oxygen atoms, nitrogen atoms or carbon atoms, is monotonically continuously increased from the lower surface position $t_0$ toward the upper surface position $t_s$ until reaching the maximum distribution amount $C_{max}$ at the position $t_1$, and thereafter, in the interval to the surface position $t_s$, the value $C_{max}$ is maintained without change in the distribution content, C.

When the electrophotographic image-forming member 100 prepared has an amorphous layer 103 having a free surface 104 as shown in FIG. 1, it is possible to increase the content of oxygen atoms, nitrogen atoms or carbon atoms in the vicinity of the upper surface position $t_s$ by far greater than in other regions thereby to impart improved charge bearing capacity to the free surface 104. In this case, such a layer region functions as a kind of so called barrier layer.

Thus, an upper barrier layer can be formed in the amorphous layer 103 by enriching extremely the content of oxygen atoms, nitrogen atoms or carbon atoms, in the vicinity of the free surface 104 of the amorphous layer 103 as compared with other layer regions. Alternatively, it is also possible to form an upper layer on the surface of the amorphous layer 103 by use of materials having the same characteristics as those of materials constituting the barrier layer 102. The upper layer in this case may suitably be 30 Å to 5μ, preferably 50 Å to 2μ.

Figure 3:
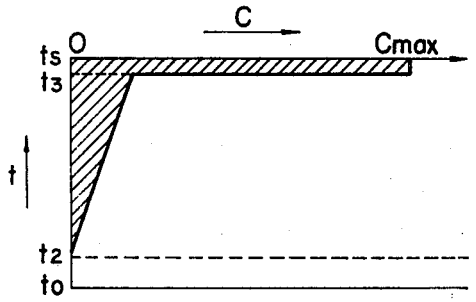

In the embodiment as shown in FIG. 3, in the layer region at the lower part between $t_0$ and $t_2$, there is contained no or less than detectable limit of oxygen atom, nitrogen atom or carbon atom. From the position $t_2$ to $t_3$, the distribution content of oxygen atoms is increased monotonically as the first-order function or approximately the first-order function, until it reaches the maximum distribution amount $C_{max}$ at the position $t_3$. In the layer region between $t_3$ and $t_s$, oxygen atoms, nitrogen atoms or carbon atoms are contained uniformly in the maximum distribution content of $C_{max}$.

Thus, in FIG. 3 the drawing is depicted as if no oxygen, no nitrogen or no carbon were contained at all in the interval between $t_0$ and $t_2$. This is because an amount of oxygen atoms, nitrogen atoms or carbon atoms, if any, less than the detectable limit is dealt with similarly as if no oxygen, no nitrogen or no carbon were present.

Accordingly, in the present invention, for example, the layer region indicated as oxygen content of 0 (for example, the layer region between $t_0$ and $t_2$ in FIG. 3) contains no oxygen atom at all or contains oxygen atoms only in an amount of less than the detectable limit. The detectable limit of oxygen atoms at our present level of technology is 200 atomic ppm based on silicon atoms, the detectable limit of nitrogen atoms is 50 atomic ppm and the detectable limit of carbon atoms is 10 atomic ppm.

Figure 4:
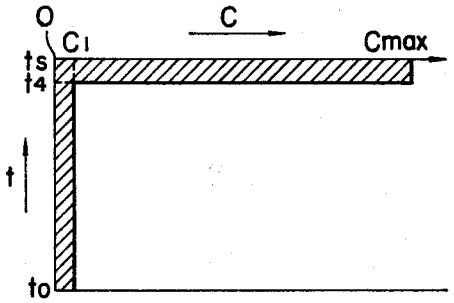

In the embodiment as shown in FIG. 4, at the lower layer region (between $t_0$ and $t_4$) in the amorphous layer 103, oxygen atoms, nitrogen atoms, or carbon atoms, are contained uniformly and evenly, with its distribution content C being constantly $C_1$. In the upper layer region (between $t_4$ and $t_s$), oxygen atoms, nitrogen atoms, or carbon atoms, are distributed uniformly and evenly at the maximum distribution content $C_{max}$, thus providing discontinuously different distribution contents C in the lower and upper layer regions, respectively.

Figure 5:
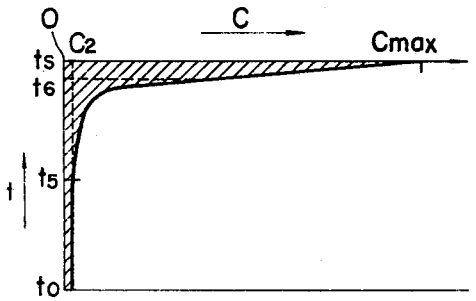

In the embodiment as shown in FIG. 5, oxygen atoms, nitrogen atoms or carbon atoms are contained at a constant distribution content $C_2$ from the lower surface position $t_0$ to the position $t_5$ in the amorphous layer 103, and the distribution content of oxygen, nitrogen or carbon atoms is gradually increased from the position $t_5$ to the position $t_6$. From $t_6$ the distribution content of oxygen nitrogen or carbon atoms is abruptly increased to the upper surface position $t_s$, at which point it reaches the maximum distribution content $C_{max}$.

As described above, as a preferred embodiment of the electrophotographic image-forming member according to the present invention, it is desirable that oxygen, nitrogen or carbon atoms are contained in the amorphous layer 103 so that the oxygen, nitrogen or carbon atoms may be distributed with distribution increasing nearer to the upper surface position $t_s$, in order to obtain a high photosensitization and stable image characteristics.

In case of such distributions as shown in the embodiments in FIGS. 2 through 5, wherein the oxygen atoms contained in the amorphous layer 103 are distributed in the layer thickness direction with more enrichment on the side opposite to the substrate 101, the total content of oxygen atoms $C_t$ contained in the whole layer region is generally 0.05 to 30 atomic % based on silicon atoms, and the maximum distribution content $C_{max}$ at the surface or in the vicinity of said surface opposite to the substrate 101 in said layer region is generally 0.3 to 67 atomic %, preferably 0.5 to 67 atomic %, most preferably 1.0 to 67 atomic %.

In the preferred embodiments of the electrophotographic image-forming members of this invention as shown in FIGS. 2 through 5, the intended object of the present invention can be effectively accomplished by adding oxygen atoms into the amorphous layer 103 according to a desired distribution function so that the oxygen atoms contained in the amorphous layer 103 may be distributed unevenly in the layer thickness direction of the amorphous layer 103. The oxygen atoms have a maximum distribution content $C_{max}$ at the upper surface position $t_s$ or in the vicinity of $t_s$, the distribution content being decreased from the upper surface position $t_s$ toward the lower surface position $t_0$. Further, the total content of oxygen atoms in the whole amorphous layer is also important to accomplish the objects of the present invention.

The total amount of oxygen atoms contained in the amorphous layer is generally 0.05 to 30 atomic % relative to silicon atoms, preferably 0.05 to 20 atomic %, most preferably 0.05 to 10 atomic %.

In case of such distributions as shown in the embodiments in FIGS. 2 through 5, wherein the nitrogen atoms contained in the amorphous layer 103 are distributed in the layer thickness direction with more enrichment on the side opposite to the substrate 101, the total content of nitrogen atoms $C_t$ contained in the whole layer region is generally 0.02 to 30 atomic % based on silicon atoms. The maximum distribution content $C_{max}$ of nitrogen at the surface or in the vicinity of said surface opposite to the substrate 101 in said layer region is generally 0.1 to 60 atomic %, preferably 0.2 to 60 atomic %, most preferably 0.5 to 60 atomic %.

In the preferred embodiments of the electrophotographic image-forming members of this invention as shown in FIGS. 2 through 5, the intended object of the present invention can be effectively accomplished by adding nitrogen atoms into the amorphous layer 103 according to a desired distribution function so that the nitrogen atoms contained in the amorphous layer 103 may be distributed unevenly in the layer thickness direction of the amorphous layer 103. The nitrogen has the maximum distribution content $C_{max}$ at the upper surface position $t_s$ or in the vicinity of $t_s$, the distribution content being decreased from the upper surface position $t_s$ toward the lower surface position $t_0$. Further, the total content of nitrogen atoms in the whole amorphous layer is also important to accomplish the objects of the present invention.

The total amount of nitrogen atoms contained in the amorphous layer is generally within the range as specified above, but it is preferably 0.02 to 20 atomic % relative to silicon atoms, most preferably 0.02 to 10 atomic %.

In case of such distributions as shown in the embodiments in FIGS. 2 through 5, wherein the carbon atoms contained in the amorphous layer 103 are distributed in the layer thickness direction with more enrichment on the side opposite to the substrate 101, the total content of carbon atoms $C_t$ contained in the whole layer region is generally 0.005 to 30 atomic % based on silicon atoms. The maximum distribution content $C_{max}$ of oxygen at the surface or in the vicinity of said surface opposite to the substrate 101 in said layer region is generally 0.03 to 90 atomic %, preferably 0.05 to 90 atomic %, most preferably 0.1 to 90 atomic %.

In the preferred embodiments of the electrophotographic image-forming members of this invention as shown in FIGS. 2 through 5, the intended object of the present invention can be effectively accomplished by adding carbon atoms into the amorphous layer 103 according to a desired distribution function so that the carbon atoms contained in the amorphous layer 103 may be distributed unevenly in the layer thickness direction of the amorphous layer 103. The maximum distribution content $C_{max}$ of carbon at the upper surface position $t_s$ or in the vicinity of $t_s$, wherein the distribution content is decreased from the upper surface position $t_s$ toward the lower surface position $t_0$. Further, the total content of carbon atoms in the whole amorphous layer is also important to accomplish the objects of the present invention.

The total amount of carbon atoms contained in the amorphous layer is generally within the range as specified above, but it is preferably 0.005 to 20 atomic % relative to silicon atoms, most preferably 0.005 to 10 atomic %.

In FIGS. 6 through 12, there is shown another preferred embodiment of the electrophotographic image-forming member of this invention, having at least a layer region, in which oxygen, nitrogen or carbon atoms contained in the amorphous layer 103 are substantially uniformly distributed in planes approximately parallel to the surface of the substrate 101 but distributed unevenly in the thickness direction of the layer, wherein the oxygen, nitrogen or carbon atoms are enriched on the side of the surface at which the substrate 101 is provided than in the central portion of said layer region.

In the embodiment as shown in FIGS. 6 through 12, as distinguished from the embodiment as shown in FIGS. 2 through 5, the amorphous layer 103 has at least a layer region, having the peak of distribution of oxygen, nitrogen or carbon atoms at the surface on the side at which the substrate 101 is provided or in the vicinity of said surface.

The meanings of the ordinate and abscissa axes in FIGS. 6 through 12 are the same as in FIGS. 2 through 5, and the oxygen, nitrogen or carbon content indicated as 0 means respectively that the content of oxygen, nitrogen or carbon atoms is substantially 0, as described previously with respect to FIGS. 2 through 5. Since the content of oxygen, nitrogen or carbon atoms is substantially 0, then the amount of oxygen, nitrogen or carbon atoms in the portion of the layer region is less than the detectable limit as described above, thus including the case wherein oxygen, nitrogen or carbon atoms are less than the detectable limit.

Figure 6:
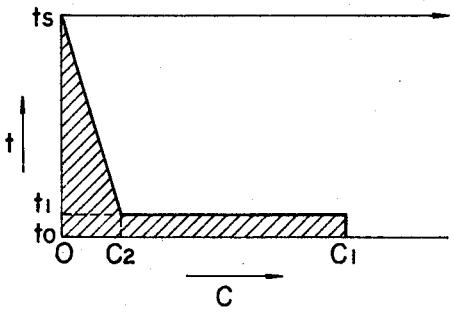

In the embodiment as shown in FIG. 6, the content of oxygen, nitrogen or carbon atoms in the amorphous layer 103 is distributed through said layer 103 such that the distribution content from the lower surface position $t_0$ to the position $t_1$ is constantly $C_1$. The distribution content is decreased as a first-order function from the distribution content $C_2$ from the position $t_1$ to the upper surface position $t_s$, until the content of oxygen, nitrogen or carbon atoms become substantially 0 on reaching the upper surface position $t_s$.

In the embodiment of FIG. 6, by increasing greatly the distribution content C between the layer thickness positions $t_0$ and $t_1$, the amorphous layer 103 can be sufficiently endowed with the function of a barrier layer at its lower surface layer region.

Figure 7:
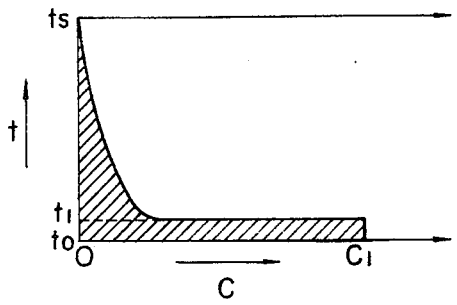

In the embodiment as shown in FIG. 7, the distribution of oxygen, nitrogen or carbon atoms contained in the amorphous layer 103 is such that the distribution content $C_1$ is constant from the lower surface position $t_0$ to the position $t_1$, and the distribution content is gradually decreased with a gentle curve from the position $t_1$ toward the upper surface position $t_s$.

Figure 8:
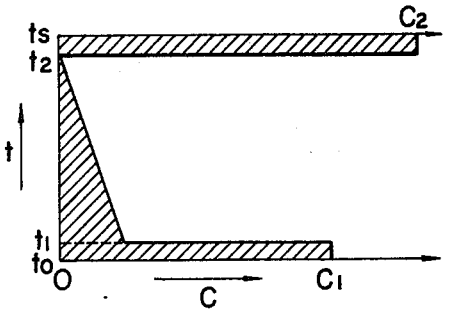

In the embodiment as shown in FIG. 8, the distribution content is constantly $C_1$ from $t_0$ to $t_1$, decreased as a first-order function from $t_1$ to $t_2$ and again becomes constant at $C_2$ from $t_2$ to $t_s$. In this embodiment, the upper surface layer region of the amorphous layer 103 can have sufficient function of a barrier layer by incorporating oxygen, nitrogen or carbon atoms in an amount enough to give a distribution content $C_2$ in the upper surface layer region (the portion between $t_2$ and $t_s$ in FIG. 8) which can exhibit a barrier layer function.

Alternatively, it is also possible in case of the embodiment as shown in FIG. 8 to increase the distribution contents C of oxygen, nitrogen or carbon atoms at both surface sides of the amorphous layer 103 by far greater than that in the internal portion, thereby permitting the both surface layer regions to fulfill the functions of barrier layers.

Figure 9:
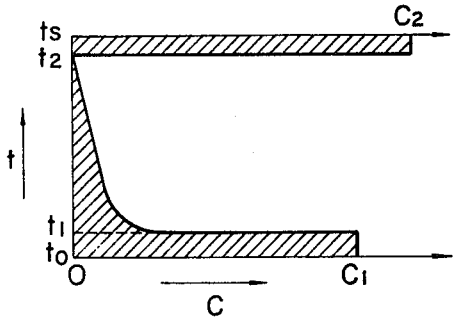

In the embodiment as shown in FIG. 9, the distribution profile of oxygen, nitrogen or carbon atoms between $t_0$ and $t_2$ is similar to that as shown in FIG. 7, but the distribution content is abruptly increased discontinuously between $t_2$ and $t_s$ to have a value of $C_2$, thus giving a different distribution profile as a whole.

Figure 10:
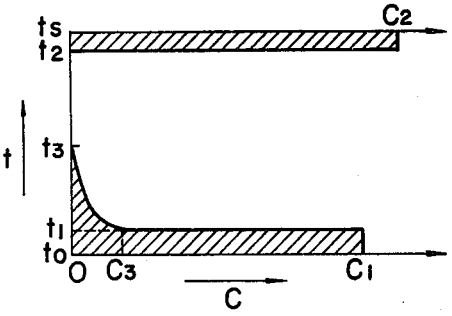

In the embodiment as shown in FIG. 10, the distribution profile is similar to that as shown in FIG. 7 between $t_0$ and $t_3$, but there is formed a layer region with oxygen, nitrogen or carbon content of substantially zero between $t_3$ and $t_2$, while a large amount of oxygen, nitrogen or carbon atoms are contained between $t_2$ and $t_s$ to provide a distribution content of $C_2$.

Figure 11:
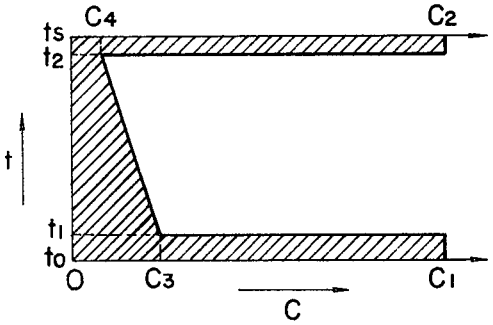

In the embodiment as shown in FIG. 11, the distribution content is constantly $C_1$ between $t_0$ and $t_1$, decreased from the distribution content $C_3$ to $C_4$ as a first-order function between $t_1$ and $t_2$ from the side of $t_1$, and again increased between $t_2$ and $t_s$ up to a constant value $C_2$.

Figure 12:
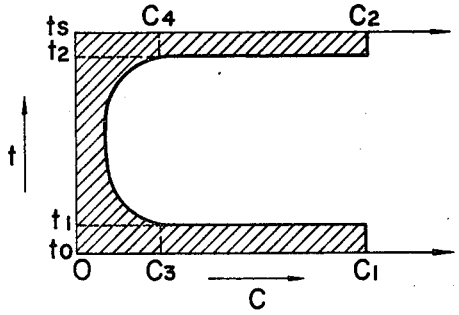

In the embodiment as shown in FIG. 12, the distribution content is constantly $C_1$ between $t_0$ and $t_1$, and also there is formed a distribution profile with a constant distribution content of $C_2$ between $t_2$ and $t_s$, while the distribution content gradually decreasing between $t_2$ and $t_1$ from the $t_1$ side toward the central portion of the layer and again gradually increasing from said central portion to $t_2$, at which the distribution content reaches the value of $C_4$.

As described above, in the embodiment as shown in FIGS. 6 through 12, there is provided a layer region having a peak of distribution content on the surface of the amorphous layer 103 on the side of the substrate 101 or in the vicinity of said surface, where oxygen, nitrogen or carbon atoms are more enriched than in the central portion of said amorphous layer 103. Moreover, if necessary, it is also possible to provide a layer region having more content of oxygen, nitrogen or carbon atoms than that in the central portion of the amorphous layer 103 also in the surface region of the amorphous layer 103 being the opposite side to the substrate. Further, there may also be formed a layer region extremely enriched in content of oxygen, nitrogen or carbon atoms at the lower surface or in the vicinity of said surface so that the function of a barrier layer may sufficiently be exhibited.

In the embodiments as shown in FIGS. 6 through 12, the peak value $C_{max}$ of the distribution content of oxygen atoms contained in the amorphous layer 103 in the layer thickness may generally range from 0.3 to 67 atomic % to achieve effectively the objects of this invention, preferably from 0.5 to 67 atomic %, most preferably 1.0 to 67 atomic %.

In the electrophotographic image-forming member according to the present invention, in case of the embodiments as shown in FIGS. 6 through 12, the oxygen atoms are contained in the amrophous layer 103 with an uneven distribution of its content in the layer thickness direction of said amorphous layer 103, assuming a distribution profile such that its distribution content is decreased from the vicinity of the lower surface layer region toward the central portion of said amorphous layer 103. However, the total content of oxygen atoms contained in the amorphous layer 103 is also another critical factor to achieve the objects of the present invention.

In the present invention, the total content of oxygen atoms in the amorphous layer 103 is generally 0.05 to 30 atomic % based on silicon atoms, preferably 0.05 to 20 atomic %, most preferably 0.05 to 10 atomic %.

In the embodiments as shown in FIGS. 6 through 12, the peak value $C_{max}$ of the distribution content of nitrogen atoms contained in the amorphous layer 103 in the layer thickness may generally range from 0.1 to 60 atomic % to achieve effectively the objects of this invention, preferably from 0.2 to 60 atomic %, most preferably 0.4 to 60 atomic %.

In the electrophotographic image-forming member according to the present invention, in case of the embodiments as shown in FIGS. 6 through 12, the nitrogen atoms are contained in the amorphous layer 103 with an uneven distribution of its content in the layer thickness direction of said amorphous layer 103, assuming a distribution profile such that its distribution content is decreased from the vicinity of the lower surface layer region toward the central portion of said amorphous layer 103. However, the total content of nitrogen atoms contained in the amrophous layer 103 is also another critical factor to achieve the objects of the present invention.

In the present invention, the total content of nitrogen atoms in the amorphous layer 103 is generally 0.02 to 30 atomic % based on silicon atoms, preferably 0.02 to 20 atomic %, most preferably 0.02 to 10 atomic %.

In the embodiments as shown in FIGS. 6 through 12, the peak value $C_{max}$ of the distribution content of carbon atoms contained in the amorphous layer 103 in the layer thickness may generally range from 0.03 to 90 atomic % to achieve effectively the objects of this invention, preferably from 0.05 to 90 atomic %, most preferably 0.1 to 90 atomic %.

In the electrophotographic image-forming member according to the present invention, in case of the embodiments as shown in FIGS. 6 through 12, the carbon atoms are contained in the amorphous layer 103 with an uneven distribution of its content in the layer thickness direction of said amorphous layer 103, assuming a distribution profile such that its distribution content is decreased from the vicinity of the lower surface layer region toward the central portion of said amorphous layer 103. However, the total content of carbon atoms contained in the amorphous layer 103 is also another critical factor to achieve the objects of the present invention.

In the present invention, the total content of carbon atoms in the amorphous layer 103 is generally 0.005 to 30 atomic % based on silicon atoms, preferably 0.005 to 20 atomic %, most preferably 0.005 to 10 atomic %.

Figure 13:
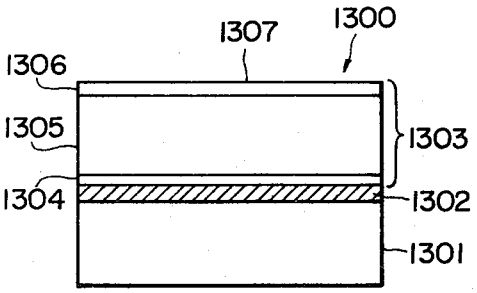
FIG. 13 a schematic sectional view of the layer structure of another preferred embodiment of the electrophotographic image-forming member according to the present invention.

FIG. 13 shows a schematic sectional view of still another preferred embodiment of the electrophotographic image-forming member according to the present invention.

The electrophotographic image-forming member 1300 as shown in FIG. 13, similarly to that described with reference to FIG. 1, comprises a substrate 1301 for the electrophotographic image-forming member, a barrier layer 1302 optionally provided on said 1301, and an amorphous layer 1303, said amprphous layer 1303 containing oxygen, nitrogen or carbon atoms which are distributed substantially equally within planes substantially parallel to the surface of said substrate 1301 but unevenly in the thickness direction of said layer, with different distributions in respective portions of the layer regions 1304, 1305 and 1306. That is, the amorphous layer 1303 is constituted of a lower layer region 1304 in which oxygen, nitrogen or carbon atoms are distributed in the layer direction substantially uniformly with a distribution content of $C_1$, an upper layer 1306 in which oxygen, nitrogen or carbon atoms are distributed in the layer thickness direction substantially uniformly with a distribution content of $C_2$, and an intermediate layer region 1305, sandwiched between both of these layer regions, in which oxygen, nitrogen or carbon atoms are distributed in the layer thickness direction substantially uniformly with a distribution content of $C_3$.

In the embodiment as shown in FIG. 13, the values of distribution content $C_1$, $C_2$ and $C_3$ of oxygen atoms in respective layers can be variable as desired within the relationship $C_3<C_1$, $C_2$. But in order to achieve the objects of the present invention more effectively, the upper limit of the distribution content $C_1$ or $C_2$ is generally 66 atomic % or lower, preferably, 64 atomic % or lower, most preferably 51 atomic % or lower, its lower limit being generally 11 atomic % or higher, preferably 15 atomic % or higher, most preferably 20 atomic % or higher. As for the value of the distribution amount $C_3$, its upper limit may generally 10 atomic % or lower, preferably 5 atomic %, most preferably 2 atomic %, while the lower limit generally 0.01 atomic % or higher, preferably 0.02 atomic % or higher, most preferably 0.03 atomic % or higher.

The total content of oxygen atoms in the amorphous layer 1303 may be generally in the range from 0.05 to 30 atomic % based on silicon atoms, preferably from 0.05 to 20 atomic %, most preferably from 0.05 to 10 atomic %.

In the embodiment as shown in FIG. 13, the values of distribution content $C_1$, $C_2$ and $C_3$ of nitrogen atoms in respective layer can be variable as desired within the relationship $C_3<C_1$, $C_2$. But in order to achieve the objects of the present invention more effectively, the upper limit of the distribution content $C_1$ or $C_2$ is generally 60 atomic % or lower, preferably, 57 atomic % or lower, most preferably 50 atomic % or lower, its lower limit being generally 11 atomic % or higher, preferably 15 atomic % or higher, most preferably 20 atomic or higher. As for the value of the distribution amount $C_3$, its upper limit may generally 10 atomic % or lower, preferably 5 atomic %, most preferably 2 atomic %, while the lower limit generally 0.01 atomic % or higher, preferably 0.02 atomic % or higher, most preferably 0.03 atomic % or higher.

The total content of nitrogen atoms in the amorphous layer 1303 may be generally in the range from 0.02 to 30 atomic % based on silicon atoms, preferably from 0.02 to 20 atomic %, most preferably from 0.02 to 10 atomic %.

In the embodiment as shown in FIG. 13, the values of distribution content $C_1$, $C_2$ and $C_3$ of carbon atoms in respective layer can be variable as desired within the relationship $C_3<C_1$, $C_2$. But in order to achieve the objects of the present invention more effectively, the upper limit of the distribution content $C_1$ or $C_2$ is generally 90 atomic % or lower, preferably, 80 atomic % or lower, most preferably 78 atomic % or lower, and its lower limit being generally 11 atomic % or higher, preferably 15 atomic % or higher, most preferably 20 atomic % or higher. As for the value of the distribution amount $C_3$, its upper limit may generally 10 atomic % or lower, preferably 5 atomic %, most preferably 2 atomic %, while the lower limit generally 0.001 atomic % or higher, preferably 0.002 atomic % or higher, most preferably 0.003 atomic % or higher.

The total content of carbon atoms in the amorphous layer 1303 may be generally in the range from 0.005 to 30 atomic % based on silicon atoms, preferably from 0.005 to 20 atomic %, based preferably from 0.005 to 10 atomic %.

The barrier layer 1302 is not necessarily required to be provided in the present invention, as described above with reference to FIG. 1, if the same function as the barrier layer 1302 as described above can be exhibited sufficiently at the interface formed between the substrate 1301 and the amorphous layer 1303, when said amorphous layer is provided directly on said substrate 1301.

Further, by incorporating a sufficient quantity of oxygen atoms as desired in the surface layer region in the amorphous layer 1303 on the side of the substrate 1301, a part of the layer region of the amorphous layer 1303 can be endowed with the same function as the barrier layer 1302, whereby the barrier layer 1302 can also be dispensed with. When a part of layer region of the amorphous layer 1303 is loaded with the function of a barrier layer, the content of oxygen atoms necessary for the layer region exhibiting such a function is generally 39 to 69 atomic % based on silicon atoms, preferably 42 to 66 atomic %, most preferably 48 to 66 atomic %, and the content of nitrogen atoms is generally 25 to 60 atomic %, preferably 30 to 55 atomic %, most preferably 35 to 50 atomic %, and the content of carbon atoms is generally 30 to 90 atomic %, preferably 40 to 90 atomic %, most preferably 50 to 90 atomic %.

In the present invention, formation an amorphous layer constituted essentially of a—Si (H, X) may be conducted according to the vacuum deposition method utilizing discharging phenomenon, such as the glow discharge method, sputtering method or ion-plating method. For example, for formation of the amorphous layer according to the glow discharge method, a starting gas for incorporation of hydrogen atoms and/or halogen atoms is introduced together with a starting gas capable of supplying silicon atoms (Si), into the deposition chamber. Glow discharge is then generated to form a layer constituted of a—Si (H, X) on the surface of the given substrate placed previously at the predetermined position. For incorporation of one member selected from the group consisting of oxygen atoms (O), nitogen atoms (N) and carbon atoms (C) into the amorphous layer to be formed, a starting gas for incorporation of said member may be introduced into said deposition chamber at the time of forming said amorphous layer.

When the amorphous layer is to be formed according to the sputtering method, a starting gas for incorporation of hydrogen atoms and/or halogen atoms may be introduced into the chamber for sputtering. Sputtering is conducted upon a target formed of Si in an atmosphere of an inert gas such as Ar, He or a gas mixture based on these gases.

As the method for incorporating one member selected from group consisting of oxygen atoms, nitrogen atoms and carbon atoms, into the amorphous layer, a starting gas for incorporating said member may be introduced into said deposition chamber at the time the layer is growing or alternatively at the time of layer formation the target, for incorporation of said gas previously provided in the deposition chamber, may be subjected to sputtering.

The starting gas for supplying Si to be used in forming the amorphous layer according to the present invention may include gaseous or gasifiable silicon hydrides (silanes) such as $SiH_4$, $Si_2H_6$, $Si_3H_8$, $Si_4H_{10}$, and the like as effective materials. In particular, $SiH_4$ and $Si_2H_6$ are preferred with respect to easy handling during layer formation and for efficiently supplying Si.

As the effective starting gas for incorporation of halogen atoms to be used in forming the amorphous layer according to the present invention, there may be mentioned a number of halogen compounds such as halogen gases, halides, interhalogen compounds and silane derivatives substituted with halogens which are gaseous or gasfiable.

Alternatively, it is also effective in the present invention to use gaseous or gasifiable silicon compounds containing halogen atoms, which are constituted of both silicon atoms (Si) and halogen atoms (X).

Typical examples of halogen compounds preferably used in the present invention may include halogen gases such as of fluorine, chlorine, bromine or iodine and interhalogen compounds such as BrF, ClF, $ClF_3$, $BrF_5$, $BrF_3$, $IF_7$, $IF_5$, ICl, IBr, etc.

As the silicon compound containing halogen atoms, silicon halides such as $SiF_4$, $Si_2F_6$, $SiCl_4$, $SiBr_4$, or the like are preferred.

When the specific photoconductive member of this invention is formed according to the glow discharge method by use of a silicon compound containing halogen atoms, it is possible to form an amorphous layer of a—Si containing halogen atoms on the substrate without use of a silicon hydride gas as the starting gas capable of supplying Si.

The basic procedure for forming the amorphous layer containing halogen atoms according to the glow discharge method comprises introducing a starting gas for supplying Si, namely a silicon halide gas and a gas such as Ar, $H_2$, He, etc. at a predetermined ratio in a suitable gas flow quantity into the deposition chamber for formation of the amorphous layer, followed by excitation of glow discharge to form a plasma atmosphere of theses gases, thereby forming an amorphous layer on a predetermined support. For the purpose of incorporating hydrogen atoms, it is also possible to form an amorphous layer by mixing a gas of a silicon compound containing hydrogen atoms at a suitable ratio with these gases.

Each of the gases for introduction of respective atoms may be either a single species or a mixture of plural species at a predetermined ratio. For formation of an amorphous layer of a—Si (H,X) by the reaction sputtering method or the ion-plating method, a target of Si is used and sputtering is effected thereon in a suitable gas plasma atmosphere in case of the sputtering method. Alternatively, in case of ion-plating method, a polycrystalline or single crystalline silicon is placed as a vaporization source in a vapor deposition boat. The silicon vaporization source is vaporized by heating according to a resistance heating method or an electron beam method (EB method) thereby to permit vaporized ions to pass through a suitable gas plasma atmosphere.

During this procedure, for either the sputtering method or the ion-plating method, for incorporation of halogen atoms into the layer formed, a gas of a halogen compound as mentioned above or a silicon compound containing halogen at mentioned above may be introduced into the deposition chamber to form a plasma atmosphere of said gas therein.

When incorporating hydrogen atoms, a starting gas for incorporation of hydrogen atoms such as $H_2$ or silanes as mentioned above may be introduced into a deposition chamber for sputtering, wherein a plasma atmosphere of said gas may be formed.

The oxygen atoms contained in the amorphous layer formed with a desired distribution profile in the direction of the layer thickness may be introduced in the amorphous layer by introducing a starting gas for introducing oxygen atoms at the time of layer formation to coincide with growth of the layer according to the predetermined flow amount into the deposition chamber for formation of said layer. The amorphous layer is formed according to the glow discharge method, ion-plating method or reaction sputtering method.

For formation of the amorphous layer according to the sputtering method, a target for introduction of oxygen atoms may be provided in the aforesaid deposition chamber, and sputtering may be effected on said target, to coincide with the growth of the layer.

In the present invention, as the starting gases for introduction of oxygen atoms effectively used, there may be mentioned oxygen ($O_2$), ozone ($O_3$) and lower siloxanes constituted of Si, O and H such as disiloxane $H_3SiOSiH_3$, trisiloxane $H_3SiOSiH_2OSiH_3$ or the like. As the material for formation of a target for introduction of oxygen atoms, $SiO_2$ and SiO can be effectively used in the present invention.

In the present invention, the substances effectively used as the starting materials for supply of the carbon atoms to used for incorporating carbon atoms in the amorphous layer may include a large number of carbon compounds which are gaseous or easily gasifiable. Examples of such starting materials are hydrocarbons constituted of carbon atoms (C) and hydrogen atoms (H) such as saturated hydrocarbons having 1 to 5 carbon atoms, ethylenic hydrocarbons having 2 to 5 carbon atoms and acetylenic hydrocarbons having 2 to 4 carbon atoms.

More specifically, typical examples are saturated hydrocarbons such as methane ($CH_4$), ethane ($C_2H_6$), propane ($C_3H_8$), n-butane (n-$C_4H_{10}$), pentane ($C_5H_{12}$) and the like; ethylenic hydrocarbons such as ethylene ($C_2H_4$), propylene ($C_3H_6$), butene-1 ($C_4H_8$), butene-2($C_4H_8$), isobutylene ($C_4H_8$), pentene ($C_5H_{10}$) and the like; and acetylenic hydrocarbons such as acetylene ($C_2H_2$), methylacetylene ($C_3H_4$), butyne ($C_4H_6$) and the like.

As starting materials for incorporation of carbon atoms constituted of Si, C and H atoms, there may also effectively employed alkyl silanes such as $Si(CH_3)_4$, $Si(C_2H_5)_4$ and the like, halogen-containing alkyl silanes such as $SiCl(CH_3)_3$, $SiCl_2(CH_3)_2$, $SiCl_3CH_3$ and the like, halogen-substituted paraffinic hydrocarbons such as $CCl_4$, $CHF_3$, $CH_2F_2$, $CH_3Cl$, $CH_3Br$, $CH_3I$, $C_2H_5Cl$ and the like.

For formation of the amorphous layer having incorporated carbon atoms by the sputtering method, a single crystalline or polycrystalline Si wafer is subjected to sputtering in an atmosphere of a starting gas for incorporation of carbon atoms at the time of formation of the amorphous layer or alternatively a single crystalline or polycrystalline Si wafer or C wafer or a wafer containing Si and C mixed therein is used as target and subjected to sputtering.

For example, when Si wafer is sued as a target, a starting gas for incorporation of carbon atoms and hydrogen atoms(H) or halogen atoms(X), which may be diluted with a diluting gas, if desired, is introduced into a deposition chamber to form a gas plasma of these gases therein and effect sputtering of said Si wafer.

Alternatively, Si and C as separate targets or one sheet target of a mixture of Si and C can be used and sputtering is effected in a gas atmosphere containing at least hydrogen atoms(H) or halogen atoms(X).

In the present invention, as the starting materials which can be starting gases for supply of nitrogen atoms to be used for incorporation of nitrogen atoms into the amorphous layer, there may be mentioned a number of nitrogen compound which are gaseous or readily gasifiable.

As such starting methods, there may be included, for example, nitrogen compounds constituted of nitrogen atoms(N) or nitrogen atoms(N) and hydrogen atoms(H) such as gaseous or gasifiable nitrogen, nitrides and azides, including for example, nitrogen($N_2$), ammonia ($NH_3$), hydrazine($H_2NNH_2$), hydrogen azide($HN_3$), ammonium($NH_4N_3$), and so on. In addition, it is also possible to use a nitrogen halide compound which can incorporate nitrogen atoms and halogen atoms, such as nitrogen trifluoride ($F_3N$), nitrogen tetrafluoride ($F_4N_2$).

For formation of the amorphous layer having nitrogen atoms incorporated therein according to the sputtering method, a single crystalline or polycrystalline Si wafer or $Si_3N_4$ wafer or a wafer containing Si and $Si_3N_4$ mixed therein is used as target and subjected to sputtering in an atmosphere of various gases, or alternatively a single crystalline or polycrystalline Si wafer may be subjected to sputtering in an atmosphere of a starting gas for incorporation of nitrogen atoms.

For example, when Si wafer is used as target, a starting gas for incorporation of nitrogen atoms and, if necessary, hydrogen atoms and/or halogen atoms, such as $H_2$ and $N_2$ or $NH_3$, which may be diluted with a diluting gas, if desired, is introduced into a deposition chamber to form a gas plasma therein and effect sputtering of said Si wafer.

Alternatively, Si and $Si_3N_4$ as separate targets or one sheet target of a mixture of Si and $Si_3N_4$ can be used and sputtering is effected in a diluted gas atmosphere as a gas for sputter.

In the present invention, oxygen atoms, nitrogen atoms or carbon atoms may be incorporated in the amorphous layer singly or as a combination of two or more species.

As the starting gases for formation of Si to be used in formation of the amorphous layer in the present invention, there may be included gaseous or gasifiable hydrogenated silicon(silanes) such as $SiH_4$, $Si_2H_6$, $Si_3H_8$, $Si_4H_{10}$, etc. as effective ones. In particular, in the view of easy handling in layer-forming operation and for good efficiency of Si formation, $SiH_4$ and $Si_2H_6$ are preferred.

In the present invention as a starting gas for incorporation of halogen atoms to be used in forming the amorphous layer, there may effectively be used halogen compounds or halogen-containing silicon compounds as mentioned above. In addition to these, it is also possible to use a gaseous or gasifiable halide containing hydrogen atoms as one of the constituents, including hydrogen halides such as HF, HCl, HBr, HI, etc., halogen-substituted silicon hydrides such as $SiH_2F_2$, $SiH_2Cl_2$, $SiHCl_3$, $SiH_2Br_2I$, $SiHBr_3$, etc. as effective starting material for formation of the amorphous layer.

These halides containing hydrogen atoms may preferably be sued as starting materials for incorporation of halogen atoms, since hydrogen atoms, which are very effective for controlling electrical or photoelectric properties, can be introduced simultaneously with introduction of halogen atoms.

Other than the method as described above, hydrogen atoms may also be introduced structurally into the amorphous layer by exciting discharging in the deposition chamber in the co-presence of $H_2$ or silanes gas such as $SiH_4$, $Si_2H_6$, $Si_3H_3$, $Si_4H_{10}$, and the like with silicon compounds as a source for supplying Si.

For example, in case of the reaction sputtering method, using Si target, a gas for incorporation of halogen atoms and $H_2$ gas, optionally together with an inert gas such as He, Ar, and the like are introduced into the deposition chamber to form a plasma atmosphere therein. Thereafter the Si target, is sputtered to obtain an amorphous layer essentially constituted of a—Si (H, X) having desired characteristics.

Furthermore, a gas such as $B_2H_6$, $PH_3$, $PF_3$, and the like can be also introduced with the gases as mentioned above to thereby effect also doping of impurities.

The amount of hydrogen atoms(H) or halogen atoms(X) contained in the amorphous layer of the amorphous layer of the photoconductive member according to the present invention, or total amount of both of these atoms, may generally be 1 to 40 atomic %, preferably 5 to 30 atomic %.

The content of H and/or X incorporated in the amorphous layer can be controlled by controlling, for example, the temperature of the deposition support and/or the amounts of the starting materials used for incorporation of H or X introduced into the deposition chamber, discharging power, etc.

In order to make the amorphous layer n-type, p-type or i-type, either or both of n-type and p-type impurities which control the electric conduction type can be added into the layer in a controlled amount during formation of the layer by the glow discharge method or the reaction sputtering method.

As the impurity to be added into the amorphous layer to make it inclined for i-type or p-type, there may be mentioned preferably an element in the group III A of the periodic table, for example, B, Al, Ga, In, Tl, etc.

On the other hand, for making the layer n-type, there may preferably be used an element in the group V A of the periodic table, such as N, P, As, Sb, Bi, etc.

The amount of the impurity to be added into the amorphous layer in the present invention, in order to have a desired conduction type, may be in the range of $3\times10^{-2}$ atomic % or less in case of an impurity in the group III A of the periodic table, and $5\times10^{-3}$ atomic % or less in case of an impurity in the group V A of the periodic table.

The layer thickness of the amorphous layer, which may suitably be determined as desired so that the photocarriers generated in the amorphous layer may be transported with good efficiency, is generally 3 to 100μ, preferably 5 to 50μ.

Example 1

Figure 14:
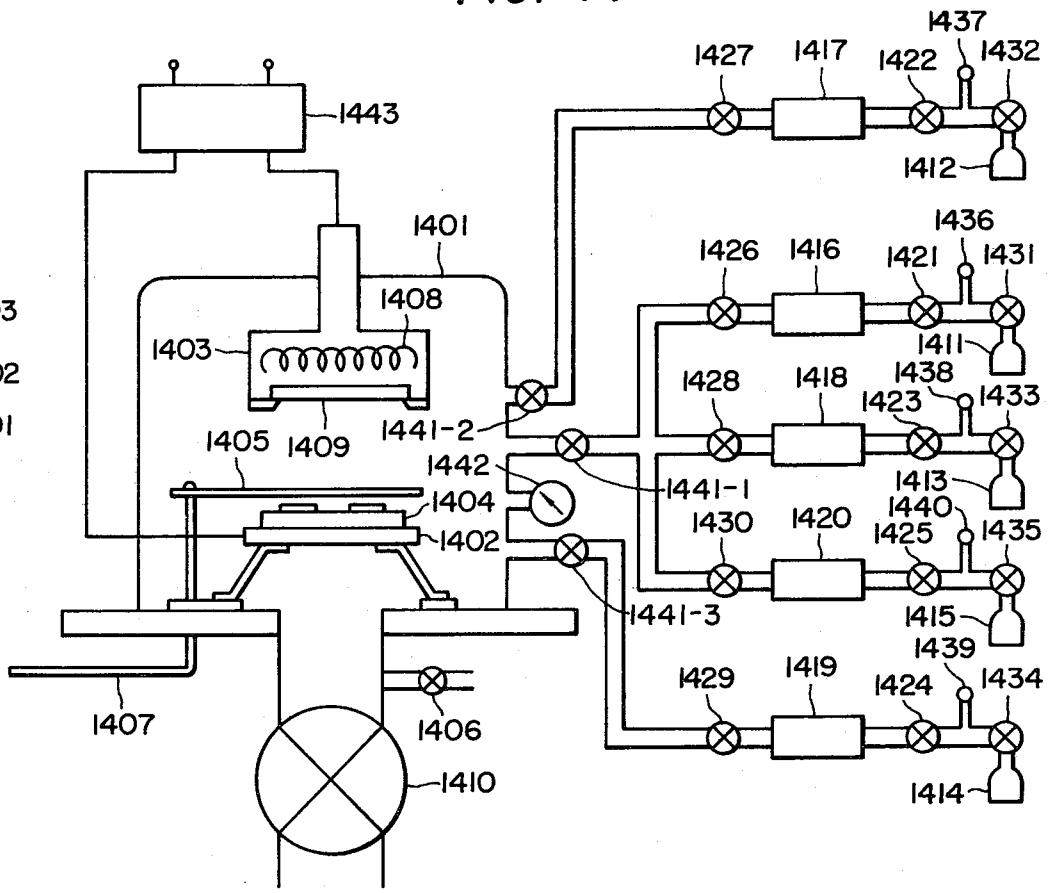
FIG. 14 a schematic flow chart illustrating one example of device for preparation of the electrophotographic image-forming member according to the present invention.

Using a device as shown in FIG. 14 placed in a clean room which had been previously shielded, an image forming member for electrophotography was prepared according to the following procedures.

A substrate of aluminum alloy 52S (containing Si, Mg and Cr) of 1 mm in thickness and 10 cm×10 cm in size having a surface subjected to the mirror grinding, was washed with alkali, acid, and pure water. The washed substrate was subjected to anodic oxidation in 7% sulfuric acid solution containing 5 g/l of aluminum sulfate at 18° C. After effecting anodic oxidation for about 5 min., the substrate was taken up from the sulfuric acid solution and dipped in a boiling pure water bath. After about 10 min., the substrate was taken out from the pure water bath. The substrate thus treated had a coating of about 0.8μ in thickness on the aluminum alloy substrate.

Said substrate 1409 was fixed firmly on a fixing member 1403 disposed at a predetermined position in a glow discharge deposition chamber 1401. The substrate 1409 was heated by a heater 1408 within the fixing chamber 1403 with a precision of ±0.5° C. The temperature was measured directly at the backside of the substrate by an alumel-chromel thermocouple. Then, after confirming that all the valves in the system were closed, the main valve 1401 was fully opened, and evacuation of the chamber 1401 was effected to about $5\times10^{-6}$ Torr. Thereafter, the input voltage for the heater 1408 was elevated by varying the input voltage while detecting the substrate temperature until the temperature was stabilized constantly at 250° C.

Then, the auxiliary valves 1441-1, 1441-2, 1441-3 subsequently the outflow valves 1426, 1427, 1429 and the inflow valves 1421, 1422, 1424 were opened fully to effect degassing sufficiently in the mass flow controllers 1416, 1417, 1419 to vacuo. After closing the auxiliary valves 1441-1, 1441-2, 1441-3 and the valves 1426, 1427, 1429, 1421, 1422, 1424, the valve 1431 of the bomb 1411 containing $SiH_4$ gas (purity: 99.999%) diluted with $H_2$ to 10 vol. % [hereinafter referred to as $SiH_4$ (10)/$H_2$] and the valve 1432 of the bomb 1412 containing $O_2$ gas (purity: 99.999%) diluted with He to 0.1 vol. % [hereinafter referred to as $O_2$ (0.1)/He] were respectively opened to adjust the pressures at the outlet pressure gages 1436 and 1437, respectively, at 1 kg/cm$^2$, whereupon the inflow valves 1421 and 1422 were gradually opened to introduce $SiH_4$ (10)/$H_2$ gas and $O_2$(0.1)/He gas into the mass flow controllers 1416 and 1417, respectively. Subsequently, the outflow valves 1426 and 1427 were gradually opened, followed by opening of the auxiliary valves 1441-1, 1441-2. The mass flow controllers 1416 and 1417 were adjusted thereby so that the gas flow amount ratio of $SiH_4$ (10)/$H_2$ gas to $O_2$ (0.1)/He gas could become 10:0.3. Then, while carefully reading the pirani gauge 1442, the opening of the auxiliary valves 1441-1 and 1441-2 were adjusted and they were opened to the extent that the inner pressure in the chamber 1401 became $1\times10^{-2}$ Torr. After the inner pressure in the chamber 1401 was stabilized, the main valve 1410 was gradually closed to narrow its opening until the indication on the pirani gage 1442 became 0.1 Torr.

After confirming that the gas inflow and the inner pressure were stable, followed by turning on of the switch of the high frequency power source 1443 and closing of the shutter 1405 (which was also the electrode), a high frequency power of 13.56 MHz was applied between the electrode 1403 and the shutter 1405 to generate glow discharging in the chamber 1401 to provide an input power of 10 W. The above conditions were maintained for 3 hours to form a lower portion layer constituting a portion of an amorphous layer constituted of an amorphous material containing oxygen atoms. Thereafter, with the high frequency power source 1443 turned off for interrupting the glow discharge, the outflow valve 1427 was closed, and then under the pressure of 1 kg/cm$^2$ (reading on the outlet pressure gage 1439) of $O_2$ gas (purity: 99.999%) from the bomb 1414 through the valve 1434, the inflow valve 1424 and the outflow valve 1429 were gradually opened to introduce $O_2$ gas into the mass flow controller 1419, and the amount of $O_2$ gas was stabilized by adjustment of the mass flow controller 1419 to 1/10 of the flow amount of $SiH_4$ (10)/$H_2$ gas.

Subsequently, the high frequency power source 1443 was turned on again to renew glow discharge. The input power was 3 W. After glow discharge was continued for additional 10 minutes to form an upper portion layer to a thickness of 600 Å, the heater 1408 was turned off, with the high frequency power source 1443 being also turned off, the substrate was left to cool at 100° C., whereupon the outflow valves 1426, 1429 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 9μ. The thus prepared image-forming member was placed in an experimental device for charging and light exposure, and corona charging was effected at (−) 5.5 KV for 0.2 sec., followed immediately by irradiation of a light image. The light image was irradiated through a transmission type test chart using a tungsen lamp as light source at a dosage of 1.0 lux. sec.

Immediately thereafter, positive (+) charged developers (containing toner and carrier) were cascaded on the surface of the image-forming member to obtain a good toner image on the image-forming member. When the toner image on the image-forming member was copied on a copying paper by corona charging at (−) 5.0 KV, there was obtained a clear image of high density which was excellent in resolution as well as gradation reproducibility.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus providing that the image-forming member for electrophotography was excellent in corona ion resistance, abrasion resistance and cleaning characteristic and also markedly high in durability. As the cleaning method, there was adopted the blade cleaning in which a blade made of a molded product of urethane rubber was employed.

During the repeated image formation, it was observed that the surface potential of the aforesaid image-forming member for electrophotography was constantly about 240 V at the dark portion, while it was about 50 V at the bright portion, being completely free from decrease of potential at the dark portion or the increase of residual potential.

Example 2

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 1, and fully dried. Thereafter the resulting substrate was allowed to stand in a superheated steam bath of 3 atmospheres for 20 minutes. Using the substrate thus treated, an image-forming member was prepared in the same manner as described in Example 1 to test its image-quality and durability. As a result, the image-forming member shows excellent image-characteristics and durability.

Example 3

Amorphous layers were formed in the same manner as described in Example 1, except that the thickness of the coating on the substrate was changed by change of the anodic oxidation time as shown in Table 1. And results shown in Table 1 were obtained by evaluation of image-quality and repeatability. In these cases, development was carried out by using the magnetic brush method and applying the development bias value capable of producing the best image.

TABLE 1

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○(Fog occurs in the negligible extend) | ○ |
| 0.5 | ○(high density) | ○(Fog occurs in the negligible extend) | ⊙ |
| 2 | ○(high density) | ○(Fog occurs in the negligible extend) | ⊙ |
| 5 | ○(high density) | Δ (Fog gradually occurs) | ○ |
| 20 | ○(high density) | X (Fog soon occurs) | X |

*⊙Excellent; ○Good; X Poor

Example 4

A substrate treated in the same manners described in Example 1 was prepared similarly to that in Example 1, followed by evacuation of the glow discharge deposition chamber 1401 to $5\times10^{-6}$ Torr according to the same procedures as in Example 1. After the substrate temperature was maintained at 250° C., according to the same procedures as in Example 1, the auxiliary valves 1441-1, 1441-2, 1441-3, subsequently the outflow valves 1426, 1472, 1429 and inflow valves 1421, 1422, 1424 were fully opened thereby to effect sufficiently degassing of the mass flow controllers 1416, 1417, 1419 to vacuo. After closing of the auxiliary valves 1441-1, 1441-2, 1441-3 and the valves 1426, 1427, 1429, 1421, 1422, 1424, the valve 1431 of the gas bomb 1411 containing $SiH_4$ (10)/$H_2$ gas (purity: 99.999%) and the valve 1432 of the gas bomb 1412 containing $O_2$ (0.1)/He were opened to adjust the pressures at the outlet pressure gages 1436, 1437, respectively, to 1 kg/cm$^2$, followed by gradual opening of the inflow valves 1421, 1422 to introduce the $SiH_4$ (10)/$H_2$ gas and $O_2$ (0.1)/He gas into the mass flow controllers 1416 and 1417, respectively. Subsequently, the outflow valves 1426 and 1427 were gradually opened, followed by gradual opening of the auxiliary valves 1441-1 and 1441-2. The mass flow controllers 1416 and 1417 were adjusted thereby so that the flow amount ratio of $SiH_4$ (10)/$H_2$ gas to $O_2$ (0.1)/He gas could become 10:0.3. Then, while carefully reading the pirani gauge 1442, the openings of the auxiliary valves 1441-1, 1441-2 were adjusted and they were opened to the extent until the inner pressure in the chamber 1401 became $1\times10^{-2}$ Torr. After the inner pressure in the chamber 1401 was stabilized, the main valve 1410 was gradually closed to narrow its opening until the indication on the pirani gauge 1441 became 0.1 Torr. After confirming that the gas inflow and the inner pressure were stable, followed by turning on of the switch of the high frequency power source 1443 and closing of the shutter 1405 (which was also the electrode), a high frequency power of 13.56 MHz was applied between the electrodes 1403 and 1405 to generate glow discharging in the chamber 1401 to provide an input power of 10 W. Simultaneously with commencement of formation of the photoconductive layer on the substrate under the above initial layer forming conditions, the setting value of flow amount at the mass flow controller 1417 was continuously increased and formation of a lower portion layer constituting a portion of an amorphous layer was conducted by controlling the gas flow amount ratio of $SiH_4$ (10)/$H_2$ to $O_2$ (0.1)/He 5 hours after commencement of layer formation to 1:1.

After completion of formation of the lower portion layer, with the high frequency power source 1443 turned off for interrupting the glow discharge, the outflow value 1427 was closed, and then under the pressure of 1 kg/cm$^2$ (reading on the outlet pressure gage 1439) of $O_2$ gas from the bomb 1414 through the valve 1434, the inflow valve 1424 and the outflow valve 1429 were gradually opened to introduce $O_2$ gas into the mass flow controller 1419, followed by gradual opening of the auxiliary valve 1441-3 simultaneously with adjustment of the mass flow controller 1419 to stabilize the flow amount of $O_2$ gas to 1/10 of the flow amount of $SiH_4$ (10)/$H_2$ gas.

Subsequently, the high frequency power source 1443 was turned on again to renew glow discharge. The input power was 3 W. After glow discharge was continued for additional 15 minutes to form an upper portion layer constituting a portion of the amorphous layer, the heater 1408 was turned off, with the high frequency power source 1443 being also turned off, the substrate was left to cool to 100° C., whereupon the outflow valves 1426, 1429 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 15μ. Using this image-forming member, image was formed on a copying paper under the same conditions and according to the same procedures as in Example 1, whereby there was obtained a very clear image-quality.

Example 5

A substrate treated in the same manner as described in Example 1 was set similarly to in Example 1, followed by evacuation of the glow discharge deposition chamber 1401 to $5\times10^{-6}$ Torr according to the same procedures as in Example 1. After the substrate temperature was maintained at 250° C., according to the same procedures as in Example 1, the auxiliary valves 1441-1, 1441-2, 1441-3, subsequently the outflow valves 1426, 1427, 1429 and inflow valves 1421, 1422, 1424 were fully opened thereby to effect sufficiently degassing of the mass flow controllers 1416, 1417, 1419 to vacuo. After closing of the auxiliary valves 1441-1, 1441-2, 1441-3 and the valves 1426, 1427, 1429, 1421, 1422, 1424, the valve 1431 of the bomb 1411 containing $SiH_4$ (10)/$H_2$ gas (purity: 99.999%) and the valve 1432 of the bomb 1412 containing $O_2$ (0.1)/He gas were opened to adjust the pressures at the outlet pressure gauges 1436, 1437, respectively, to 1 kg/cm$^2$, followed by gradual opening of the inflow valves 1421, 1422 to introduce the $SiH_4$ (10)/$H_2$ gas and $O_2$ (0.1)/He gas into the mass flow controllers 1416 and 1417, respectively. Subsequently, the outflow valves 1426 and 1427 were gradually opened, followed by gradual opening of the auxiliary valves 1441-1 and 1441-2. The inflow valves 1421 and 1422 were adjusted thereby so that the gas flow amount ratio of $SiH_4$ (10)/$H_2$ to $O_2$ (0.1)/He was 10:0.3.

Then, while carefully reading the pirani gauge 1442, the openings of the auxiliary valves 1441-1, 1441-2 were adjusted until they were opened to the extent until the inner pressure in the chamber 1401 became $1\times10^{-2}$ Torr. After the inner pressure in the chamber 1401 was stabilized, the main valve 1410 was gradually closed to narrow its opening until the indication on the pirani gauge 1441 became 0.1 Torr. After confirming that the gas inflow and the inner pressure were stable, followed by turning on of the switch of the high frequency power source 1443 and closing of the shutter 1405 (which was also the electrode), a high frequency power of 13.56 MHz was applied between the electrodes 1403 and 1405 to generate glow discharging in the chamber 1401 to provide an input power of 10 W. Simultaneously with commencement of formation of the amorphous layer on the substrate under the above initial layer forming conditions, the setting value of flow amount at the mass flow controller 1417 was continuously increased and formation of the amorphous layer was conducted by controlling the flow amount ratio of $SiH_4$ (10)/$H_2$ gas to $O_2$ (0.1)/He gas 5 hours after commencement of layer formation to 1:10.

After formation of the amorphous layer, the heater 1408 was turned off, with the high frequency power source 1443 being also turned off, the substrate was left to cool to 100° C., whereupon the outflow valves 1426, 1429 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed the amorphous layer was taken out. In this case, the thickness of the layer formed was about 15μ. Using this image-forming member, images were formed on a copying paper under the same conditions and according to the same procedures as in Example 1, whereby there was obtained a very clear image-quality.

Example 6

An amorphous layer was formed on an aluminum alloy substrate under the same operational conditions as described in Example 5 except for the following conditions. Namely, the bomb 1411 containing $SiH_4$ (10)/$H_2$ gas was replaced with the bomb containing $SiF_4$ gas (purity: 99.999%), and the bomb 1412 containing $O_2$ (0.1)/He gas with the bomb of argon gas (purity: 99.999%) containing 0.2 vol. % of oxygen [hereinafter abridged as $O_2$ (0.2)/Ar]. The flow amount ratio of $SiF_4$ gas to $O_2$ (0.2)/Ar at the initial state of deposition of the amorphous layer was set at 1:0.6, and said flow amount ratio was continuously increased after commencement of the layer formation until it was 1:18 at the completion of deposition of the amorphous layer. Further, the input power for glow discharging was changed to 100 W. The layer thickness formed in this case was about 18μ. The thus prepared image-forming member was tested for image formation on a copying paper according to the same procedures as in Example 5, whereby very clear images were obtained.

Example 7

A substrate treated in the same manner as described in Example 1 was set similarly to in Example 1, followed by evacuation of the glow discharge deposition chamber 1401 to $5\times10^{-6}$ Torr according to the same procedures as in Example 1. After the substrate temperature was maintained at 250° C., according to the same procedures as in Example 1, the auxiliary valves 1441-1, 1441-2, 1441-3, subsequently the outflow valves 1426, 1427, 1428, 1429 and inflow valves 1421, 1422, 1423, 1424 were fully opened thereby to effect sufficiently degassing of the mass flow controllers 1416, 1417, 1418, 1419 to vacuo.

After closing of the auxiliary valves 1441-1, 1441-2, 1441-3 and the valves 1426, 1427, 1428, 1429, 1421, 1422, 1423, 1424, the valve 1431 of the bomb 1411 containing $SiH_4$ (10)/$H_2$ gas (purity: 99.999%), the valve 1432 of the bomb 1412 containing $O_2$ (0.1)/He gas, and the valve 1433 of the bomb 1413 containing $B_2H_6$ gas (purity: 99.999%) diluted to 50 vol. ppm with $H_2$ [hereinafter abridged as $B_2H_6$ (50)/$H_2$] were opened to adjust the pressures at the outlet pressure gages 1436, 1437, 1438, respectively, to 1 kg/cm$^2$, followed by gradual opening of the inflow valves 1421, 1422, 1423 to introduce the $SiH_4$ (10)/$H_2$ gas, $O_2$ (0.1)/He gas, and $B_2H_6$ (50)/$H_2$ gas into the mass flow controllers 1416, 1417 and 1418 respectively. Subsequently, the outflow valves 1426, 1427 and 1428 were gradually opened, followed by gradual opening of the auxiliary valves 1441-1, 1441-2 and 1441-3. The mass flow controllers 1416, 1417 and 1418 were adjusted thereby so that the flow amount ratio of $SiH_4$ (10)/$H_2$ to $O_2$ (0.1)/He was 10:0.3, and the feed ratio of $SiH_4$ (10)/$H_2$ to $B_2H_6$ (50)/$H_2$ was 50:1. Then, while carefully reading the pirani gauge 1442, the opening of the auxiliary valves 1441-1 and 1441-2 were adjusted and they were opened to the extent until the inner pressure in the chamber 1401 became $1\times10^{-2}$ Torr. After the inner pressure in the chamber 1401 was stabilized, the main valve 1410 was gradually closed to narrow its opening until the indication on the pirani gauge 1442 became 0.1 Torr. After confirming that the gas inflow and the inner pressure were stable, followed by turning on of the switch of the high frequency power source 1443 and closing of the shutter 1405 (which was also the electrode), a high frequency power of 13.56 MHz was applied between the electrode 1403 and the shutter 1405 to generate glow discharging in the chamber 1401 to provide an input power of 10 W. The above conditions were maintained for 3 hours to form a lower portion layer constituting a portion on amorphous layer. Thereafter, with the high frequency power source 1443 turned off for interrupting the glow discharge, the outflow valves 1427 and 1428 were closed, and then under the pressure of 1 kg/cm$^2$ (reading on the outlet pressure gage 1439) of $O_2$ gas (purity: 99.999%) from the bomb 1414 through the valve 1434, the inflow valve 1424 and the outflow valve 1429 were gradually opened to introduce $O_2$ gas into the mass flow controller 1419, and then simultaneously with gradual opening of the auxiliary valve 1441-3 the amount of $O_2$ gas was stabilized by adjustment of the mass flow controller 1419 to 1/10 of the flow amount of $SiH_4$ (10)/$H_2$ gas.

Subsebquently, the high frequency power source 1443 was turned on again to recommence glow discharge. The input power was 3 W. After glow discharge was continued for additional 10 minutes to form an upper portion layer to a thickness of 600 Å, the heater 1408 was turned off, with the high frequency power source 1443 being also turned off, the substrate was left to cool to 100° C., whereupon the outflow valves 1426, 1429 and the inflow valves 1421, 1422, 1423, and 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers was about 9$\mu$. The thus prepared image-forming member was placed in an experimental device for charging and light-exposure, and corona charging was effected at −5.5 KV for 0.2 sec., followed immediately by irradiation of a light image. The light image was irradiated through a transmission type test chart using a tungsten lamp as light source at a dosage of 1.0 lux. sec.

Immediately thereafter, positively (+) charged developers (containing toner and carrier) were cascaded on the surface of the image-forming member to obtain a good toner image on the image-forming member. When the toner image on the image-forming member was copied on a copying paper by corona charging at −5.0 KV, there was obtained a clear image of high density which was excellent in resolution as well as gradation reproducibility.

Next, the above image-forming member was subjected to corona charging by means of a charging light-exposure experimental device at +6.0 KV for 0.2 sec., followed immediately by image exposure to light at a dosage of 0.8 lux. sec., and thereafter immediately (−) charged developer was cascaded on the surface of the member. Then, by copying on a copying paper and fixing, there was obtained a very clear image.

As apparently seen from the above result, in combination with the previous result, the image-forming member for electrophotography obtained in this Example has the characteristics of a both-polarity image-forming member having no dependency on the charged polarity.

Example 8

Using a device as shown in FIG. 14, an image-forming member for electrophotography was prepared according to the following procedures.

A molybdenum plate (substrate) 1409 of 10 cm square having a thickness of 0.5 mm, which had been treated in the same manner as described in Example 1, was fixed firmly on a fixing member 1403 disposed at a predetermined position in a deposition chamber 1401. The target 1404 was formed by mounting a high purity graphite (99.999%) on a high purity polycrystalline silicon (99.999%) (the area ratio of the silicon to the graphine on the target was 1:9). The substrate 1409 was heated by a heater 1408 within the fixing member 1403 with a precision of ±0.5° C. The temperature was measured directly at the backside of the substrate by an alumel-chromel thermocouple. Then, after confirming that all the valves in the system were closed, the main valve 1410 was opened, and evacuation of the chamber 1401 was effected to about $5\times10^{6}$ Torr (all the valves except for the main valve were closed after this operation).

Then, the auxiliary valves 1441-1, 1441-2, 1441-3, subsequently the outflow valves 1426, 1427, 1429, 1430 were opened to effect degassing sufficiently in the mass flow controllers 1416, 1417, 1419, 1420 to vacuo. Thereafter, the outflow valves 1426, 1427, 1429, 1430 and the auxiliary valves 1441-1, 1441-2 and 1441-3 were closed. The valve 1435 of the bomb 1415 containing argon gas (purity: 99.999%) was opened to adjust the pressure at the outlet pressure gage 1440 at 1 kg/cm$^2$, whereupon the inflow valve 1425 was opened, followed by gradual opening of the outflow valve 1430 to introduce argon gas into the chamber 1401. Subsequently, the outflow valve 1430 was gradually open until the indication on the pirani gauge 1442 became $5\times10^{-4}$ Torr. After the flow amount was stabilized under this state, the main valve 1410 was gradually closed to narrow its opening until the inner pressure in the chamber 1401 became $1\times10^{-2}$ Torr. After confirming that the mass flow controller 1420 was stabilized, with the shutter being closed, the high frequency power source 1443 was turned on to input an alternate current of 13.56 MHz, 100 W between the target 1404 and the fixing member 1403. A layer was formed, while taking matching so as to continue discharging stably under the above conditions. Thus, discharging was continued for one minute to form as intermediate layer with a thickness of 100 Å. Thereafter, with the high frequency power source 1443 turned off for intermission of the glow discharge, the outflow valve 1430 was closed, with full opening of the main valve 1410 to draw out the gas in the chamber 1401 to vacuum of $5\times10^{-6}$ Torr. Then, the input voltage at the heater 1408 was elevated and the input voltage was changed while detecting the temperature of the substrate, until it was stabilized constantly at 200° C. Following afterwards the procedures similar to Example 1 under the same conditions, an amorphous layer was formed. The thus prepared image-forming member was tested for image formation on a copying paper similarly to described in Example 1, whereby there was obtained a very clear and shar image quality.

Example 9

An amorphous layer was formed according to the same procedures and under the same conditions as in Example 6, except that the $O_2$ (0.2)/Ar gas bomb 1412 was replaced with the bomb of He gas containing 0.2 vol. % of $O_2$ gas.

The thickness of the layer formed in this case was about 15μ. Using this image-forming member, an image was formed on a copying paper similarly to described in Example 1 to obtain a very clear image.

Example 10

An image-forming member for electrophotography was prepared according to the same procedure and under the same conditions as in Example 1 except that $C_2H_4$ gas was used in place of $O_2$ gas and $C_2H_4$ gas diluted to 0.1 vol. % with $H_2$ (hereinafter abridged as $C_2H_4$ (0.1)/$H_2$) in place of $O_2$ (0.1)/He.

Using the thus prepared image-forming member for electrophotography, image forming treatment was performed similarly as in Example 1. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly high in durability.

Example 11

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 10, and fully dried. Thereafter the resulting substrate was allowed to stand in a superheated steam bath of 3 atmospheres for 20 minutes. Using the substrate thus treated, an image-forming member was prepared in the same manner as described in Example 10 to test its image-quality and durability. As a result, the image-forming member shows excellent image-characteristics and durability.

Example 12

Amorphous layers were formed in the same manner as described in Example 10, except that the thickness of the coating on the substrate was changed by change of the anodic oxidation time as shown in Table 2. And results shown in Table 2 were obtained by evaluation of image-quality and repeatability. In these cases, development was carried out by using the magnetic brush method and applying the developing bias value capable of producing the best image.

TABLE 2

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○ Good; X Poor

Example 13

An image-forming member for electrophotography was prepared according to the same procedure and under the same conditions as in Example 4 except that $C_2H_4$ gas diluted to 0.1 vol. % with $H_2$ (hereinafter abridged as $C_2H_4$ (0.1)/$H_2$) was used in place of $O_2$ (0.1)/He gas and $C_2H_4$ gas in place of $O_2$ gas.

Using the thus prepared image-forming member for electrophotography, image forming treatment was performed similarly as in Example 10. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 14

An image-forming member for electrophotography was prepared according to the same procedure and under the same conditions as in Example 5 except that $C_2H_4$ (0.1)/$H_2$ gas was used in place of $O_2$ (0.1)/He.

Using the thus prepared image-forming member for electrophotography, image forming treatment was performed similarly as in Example 10. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 15

An image-forming member for electrophotography was prepared according to the same procedure and under the same conditions as in Example 14 except that Ar gas containing 0.2 vol. % of $C_2H_4$ (hereinafter abridged as $C_2H_4$ (0.2)/Ar) was used in place of $C_2H_4$ (0.1)/$H_2$, and that the flow amount ratio of $SiF_4$ to $C_2H_4$ (0.2)/Ar was continuously changed from 1:0.5 to 1:15 from initiation to completion of formation of the amorphous layer.

Using the thus prepared image-forming member for electrophotography, image forming treatment was performed similarly as in Example 14. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper.

Example 16

An image-forming member for electrophotography was prepared according to the same procedure and under the same conditions as in Example 7 except that $C_2H_4$ (0.1)/He gas was used in place of $O_2$ (0.1)/He and $C_2H_4$ gas in place of $O_2$ gas.

Using the thus prepared image-forming member for electrophotography, image forming treatment was performed similarly as in Example 7. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 17

An image-forming member for electrophotography was prepared according to the same procedure and under the same conditions as in Example 8 except that $C_2H_4$ gas was used in place of $O_2$ gas and $C_2H_4$ (0.1)/$H_2$ gas in place of $O_2$ (0.1)/He.

Using the thus prepared image-forming member for electrophotography, image forming treatment was performed similarly as in Example 1. The resulting image on the transfer paper was excellent in resolution, clear with good gradation reproducibility and also high in density.

Example 18

An amorphous layer was formed according to the same procedures and under the same conditions as in Example 15, except that the $C_2H_4$ (0.2)/Ar gas bomb 1412 was replaced with the bomb of $H_2$ gas containing 0.2 vol. % of $C_2H_4$ gas.

The thickness of the layer formed in this case was about 15μ. Using this image-forming member, an image was formed on a copying paper similarly to described in Example 15 to obtain a very clear image.

Example 19

An image-forming member for electrophotography was prepared according to the same procedure and under the same conditions as in Example 1 except that $NH_3$ gas was used in place of $O_2$ gas and $NH_3$ gas diluted to 0.1 vol. % with $H_2$ (hereinafter abridged as $NH_3$ (0.1)/$H_2$) in place of $O_2$ (0.1)/He.

Using the thus prepared image-forming member for electrophotography, image forming treatment was performed similarly as in Example 1. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 20

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 19, and fully dried. Thereafter the resulting substrate was allowed to stand in a superheated steam bath of 3 atmospheres for 20 minutes. Using the substrate thus treated, an image-forming member was prepared in the same manner as described in Example 19 to test its image-quality and durability. As a result, the image-forming member shows excellent image-characteristics and durability.

Example 21

Amorphous layers were formed in the same manner as described in Example 19, except that the thickness of the coating on the substrate was changed by change of the anodic oxidation time as shown in Table 3. And results shown in Table 3 were obtained by evaluation of image-quality and repeatability. In these cases, development was carried out by using the magnetic brush method and applying the developing bias value capable of producing the best image.

TABLE 3

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○(Fog occurs in the negligible extend) | ○ |
| 0.5 | ○ (high density) | ○(Fog occurs in the negligible extend) | ⊙ |
| 2 | ○ (high | ○(Fog occurs | ⊙ |

TABLE 3-continued

| Thickness of surface coating (μ) | Quality of the image obtained in the initial operation | Repeatability | Evaluation* |
|---|---|---|---|
| | density) | in the negligible extend) | |
| 5 | ○(high density) | Δ (Fog gradually occurs) | ○ |
| 20 | ○(high density) | X (Fog soon occurs) | X |

*⊙Excellent; ○Good; X Poor

Example 22

An image-forming member for electrophotography was prepared according to the same procedure and under the same conditions as in Example 4 except that $NH_3$ gas was used in place of $O_2$ gas and $NH_3$ (0.1)/$H_2$ gas in place of $O_2$ (0.1)/He gas.

Using the thus prepared image-forming member for electrophotography, image forming treatment was performed similarly as in Example 19. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 23

An image-forming member for electrophotography was prepared according to the same procedure and under the same conditions as in Example 5 except that $NH_3$ (0.1)/$H_2$ gas was used in place of $O_2$ (0.1)/He.

Using the thus prepared image-forming member for electrophotography, image forming treatment was performed similarly as in Example 19. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 24

An image-forming member for electrophotography was prepared according to the same procedure and under the same conditions as in Example 23 except the Ar gas containing 0.2 vol. % of $NH_3$ [hereinafter abridged as $NH_3$ (0.2)/Ar] and $SiF_4$ in place of Si (10)/$H_2$ was used in place of $NH_3$ (0.1)/$H_2$; and that the flow amount ratio of $SiF_4$ to $NH_3$ (0.2)/Ar was continuously changed from 1:0.6 to 1:18 from initiation to completion of formation of the amorphous layer.

Using the thus prepared image-forming member for electrophotography, image forming treatment was performed similarly as in Example 23. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper.

Example 25

An image-forming member for electrophotography was prepared according to the same procedure and under the same conditions as in Example 7 except that $NH_3$ (0.1)/$H_2$ gas was used in place of $O_2$ (0.1)/He gas and $NH_3$ gas in place of $O_2$ gas.

Using the thus prepared image-forming member for electrophotography, image forming treatment was performed similarly as in Example 7. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abration resistance and cleaning characteristic and also markedly rich in durability.

Example 26

An image-forming member for electrophotography was prepared according to the same procedure and under the same conditions as in Example 8 except that $NH_3$ gas was used in place of $O_2$ gas and $NH_3$ (0.1)/$H_2$ gas in place of $O_2$ (0.1)/He gas.

Using the thus prepared image-forming member for electrophotography, image forming treatment was performed similarly as in Example 19. The resulting image on the transfer paper was excellent in resolution, clear with good gradation reproducibility and also high in density.

Example 27

An amorphous layer was formed according to the same procedures and under the same conditions as in Example 24, except that the $NH_3$ (0.2)/Ar gas bomb 1412 was replaced with the bomb of He gas containing 0.2 vol. % of $NH_3$ gas.

The thickness of the layer formed in this case was about 15μ. Using this image-forming member, an image was formed on a copying paper similarly to described in Example 24 to obtain a very clear image.

Example 28

When Examples 19 to 27 were repeated except that $N_2$, ($NH_3+O_2$), $N_2O$, or ($N_2+O_2$) was used in place of $NH_3$, and corresponding electrophotographic image forming processes were applied to respective photoconductive members prepared, there could be obtained transferred images of very high quality. Further, no lowering in transferred image quality was observed after repeated uses for a long time.

Example 29

Using a device as shown in FIG. 14 placed in a clean room which had been completely shielded, an image-forming member for electrophotography was prepared according to the following procedures.

A substrate of 1409 of 10 cm square having a thickness of 0.5 mm, which had been treated in the same manner discribed in Example 1, was fixed firmly on a fixing member 1403 disposed at a predetermined position in a glow discharge deposition chamber 1401. The substrate 1409 was heated by a heater 1408 within the fixing member 1403 with a precision of ±0.5° C. The temperature was measured directly at the backside of the substrate by an alumel-chromel thermocouple. Then, after confirming that all the valves in the system were closed, the main valve 1410 was fully opened, and evacuation of the chamber 1401 was effected to about $5\times10^{-6}$ Torr. Thereafter, the input voltage for the heater 1408 was elevated by varying the input voltage while detecting the substrate temperature until the temperature was stabilized constantly at 250° C.

Then, the auxiliary valves 1441-1, 1441-2, 1441-3, subsequently the outflow valves 1426, 1427, 1429 and the inflow valves 1421, 1422, 1424 were opened fully to effect degassing sufficiently in the mass flow controllers 1416, 1417, 1419 to vacuo. After closing the auxiliary valves 1441-1, 1441-2, 1441-3 and the valves 1426, 1427, 1429, 1421, 1422, 1424, the valve 1431 of the bomb 1411 containing $SiH_4$ (10)/$H_2$ gas (purity: 99.999%) and the valve 1434 of the bomb 1414 containing $O_2$ gas (purity: 99.999%) were respectively opened to adjust the pressures at the outlet pressure gages 1436 and 1439, respectively, at 1 kg/cm$^2$, whereupon the inflow valves 1421 and 1424 were gradually opened to introduce $SiH_4$ (10)/$H_2$ gas and $O_2$ gas into the mass flow controllers 1416 and 1419, respectively. Subsequently, the outflow valves 1426 and 1429 were gradually opened, followed by opening of the auxiliary valves 1441-1, 1441-3. The mass flow controllers 1416 and 1419 were adjusted thereby so that the gas flow amount ratio of $SiH_4$ (10)/$H_2$ gas to $O_2$ could become 10:1. Then, while carefully reading the pirani gauge 1442, the opening of the auxiliary valves 1441-1 and 1441-3 were adjusted and they were opened to the extent until the inner pressure in the chamber 1401 became $1\times10^{-2}$ Torr.

After the inner pressure in the chamber 1401 was stabilized, the main valve 1410 was gradually closed to narrow its opening until the indication of the pirani gage 1442 became 0.1 Torr. After confirming that the gas inflow and the inner pressure were stable, followed by closing of the shutter 1405 (which was also the electrode), the switch of the high frequence power source 1443 was turned on to input a high frequency power of 13.56 MHz was applied between the electrode 1403 and the shutter 1405 to generate glow discharging in the chamber 1401 to provide an input power of 3 W. The above conditions were maintained for 10 minutes to form a lower barrier layer to a thickness of 600 Å on the substrate 1409. Thereafter, with the high frequency power source 1443 turned off for intermission of the glow discharge, the outflow valve 1429 was closed, and then under the pressure of 1 kg/cm$^2$ (reading on the outlet pressure gauge 1437) of $O_2$ (0.1)/He gas from the bomb 1412 through the valve 1432, the inflow valve 1422 and the outflow valve 1427 were gradually opened to introduce $O_2$ (0.1)/He gas into the mass flow controller 1417, and the amount of $O_2$ (0.1)/He gas was stabilized by adjustment of the mass flow controllers 1416, 1417 so that the ratio of the flow amount of $SiH_4$ (10)/$H_2$ gas to that of the $O_2$ (0.1)/He gas was 1:1.

Subsequently, the high frequency power source 1443 was turned on again to renew glow discharge. The input power was 10 W. Under the above conditions, a photoconductive amorphous layer began to be formed on the lower barrier layer and at the same time the setting value of flow amount at the mass flow controller 1417 was continuously decreased over 3 hours until the flow amount ratio of the $SiH_4$ (10)/$H_2$ gas to $O_2$ (0.1)/He gas after 3 hours became 10:0.3. The layer formation was thus conducted for 3 hours. Then, the heater 1408 was turned off, with the high frequency power source 1443 being also turned off, the substrate was left to cool to 100° C., whereupon the outflow valves 1426, 1427 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers was about 9μ.

The thus prepared image-formed member was placed in an experimental device for charging and light-exposure, and corona charging was effected at −5.5 KV for 0.2 sec., followed immediately by irradiation of a light image. The light image was irradiated through a transmission type test chart using a tungsten lamp as light source at a dosage of 1.0 lux. sec.

Immediately thereafter, positively (+) charged developers (containing toner and carrier) were cascaded on the surface of the image-forming member to obtain a good toner image on the image-forming member. When the toner image on the image-forming member was copied on a copying paper by corona charging at −5.0 KV, there was obtained a clear image of high density which was excellent in resolution as well as gradation reproducibility.

The image forming treatment as described above was applied repeatedly to the above image-forming member for electrophotography for testing of durability. As a result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability. As the cleaning method, there was adopted the blade cleaning in which a blade made of a molded product of urethane rubber was employed.

During the repeated image formation, it was observed that the surface potential of the aforesaid image-forming member for electrophotography was constantly about 240 V at the dark portion, while it was about 50 V at the bright portion, being completely free from decrease of potential at the dark portion or the increase of residual potential.

Example 30

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 29, and fully dried. Thereafter the resulting substrate was allowed to stand in a superheated steam bath of 3 atmosphers for 20 minutes. Using the substrate thus treated, an image-forming member was prepared in the same manner as described in Example 29 to test its image-quality and durability. As a result, the image-forming member shows excellent image-characteristics and durability.

Example 31

Amorphous layers were formed in the same manner as described in Example 29, except that the thickness of the coating on the substrate was changed by change of the anodic oxidation time as shown in Table 4. And results shown in Table 4 were obtained by evaluation of image-quality and repeatability. In these cases, development was carried out by using the magnetic brush method and applying the developing bias value capable of producing the best image.

TABLE 4

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○Good; X Poor

Example 32

A substrate, which had been treated in the same manner described in Example 1, was set similarly to in Example 29, followed by evacuation of the glow discharge deposition chamber 1401 to $5\times10^{-6}$ Torr according to the same procedures as in Example 8. After the substrate temperature was maintained at 250° C., according to the same procedures as in Example 8, the auxiliary valves 1441-1, 1441-2, 1441-3, subsequently the outflow valves 1426, 1427 and inflow valves 1421, 1422 were fully opened thereby to effect sufficiently degassing of the mass flow controllers 1416, 1417 to vacuo. After closing of the auxiliary valves 1441-1, 1441-2, 1441-3 and the valves 1426, 1427, 1421, 1422, the valve 1431 of the gas bomb 1411 containing $SiH_4$ (10)/$H_2$ gas and the valve 1432 of the gas bomb 1412 containing $O_2$ (0.1)/He were opened to adjust the pressures at the outlet pressure gauges 1436, 1437, respectively, to 1 kg/cm$^2$, followed by gradual opening of the inflow valves 1421, 1422 to introduce the $SiH_4$ (10)/$H_2$ gas and $O_2$ (0.1)/He gas into the mass flow controllers 1416 and 1417, respectively. Subsequently, the outflow valves 1426 and 1427 were gradually opened, followed by gradual opening of the auxiliary valves 1441-1 and 1441-2. The mass flow controllers 1416 and 1417 were adjusted thereby so that the gas flow amount ratio of $SiH_4$ (10) /$H_2$ to $O_2$(0.1)/He was 1:10.

Then, which carefully reading the pirani gauge 1442, the openings of the auxiliary valves 1441-1, 1441-2 were adjusted, and they were opened to the extent until the inner pressure in the chamber 1401 became $1\times10^{-2}$ Torr. After the inner pressure in the chamber 1401 was stabilized, the main valve 1410 was gradually closed to narrow its opening until the indication on the pirani gauge 1441 became 0.1 Torr. After confirming that the gas inflow and the inner pressure were stable, followed by closing of the shutter 1405, the switch of the high freqency power source 1443 was turned on to input a high frequency power of 13.56 MHz between the electrode 1403 and the shutter 1405 to generate glow discharging in the chamber 1401 to provide an input power of 10 W. Simultaneously with commencement of formation of the photoconductive layer on the substrate under the above initial layer forming conditions, the setting value of flow amount at the mass flow controller 1417 was continuously decreased and formation of the photoconductive layer was conducted by controlling the gas flow amount ratio of $SiH_4$ (10)/$H_2$ to $O_2$ (0.1)/He 5 hours after commencement of layer formation to 10:0.3.

After completion of formation of the photoconductive amorphous layer, the heater 1408 was turned off, with the high frequency power source 1443 being also turned off, and the substrate was left to cool to 100° C., whereupon the outflow valves 1426, 1427 and the inflow valves 1421, 1422 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 15μ. Using this image-forming member, image was formed on copying paper under the same conditions and according to the same procedures as in Example 29, whereby there was obtained a very clear image.

Example 33

After formation of a lower barrier layer and a photoconductive amorphous layer on a substrate according to the same procedures and under the same conditions as in Example 29, the high frequency power source 1443 was turned off for intermission of glow discharge. Under this state, the outflow valve 1427 was closed and then the outflow valve 1429 was opened again, and the flow amount ratio of $O_2$ gas to $SiH_4$ (10)/$H_2$ was stabilized to 1/10 by adjusting the mass flow controllers 1419 and 1416. Subsequently, the high frequency power source 1443 was turned on to renew glow discharging. The input voltage was thereby adjusted to 3 W, similarly as before.

Under these conditions, glow discharge was further maintained for 15 minutes to form an upper barrier layer to a thickness 900 Å, and thereafter the heater 1408 was turned off, with the high frequency power source 1443 being also turned off, the substrate was left to cool to 100° C., whereupon the outflow valves 1426, 1429 and the inflow valves 1421, 1422 and 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 9μ. Using this image-forming member, image was formed on a copying paper under the same conditions and according to the same procedures as in Example 29, whereby there was obtained a very clear image.

Example 34

After formation of a photoconductive amorphous layer on a substrate according to the same procedures and under the same conditions as in Example 32, the high frequency power source 1443 was turned off for interruption of glow discharge. Under this state, the outflow valve 1427 was closed and then the outflow valve 1429 was opened again, and the flow amount ratio of $O_2$ gas to $SiH_4$ (10)/$H_2$ was stabilized to 1/10 by adjusting the mass flow controllers 1419 and 1416. Subsequently, the high frequency power source was turned on to renew glow discharging. The input voltage was thereby adjusted to 3 W, similarly as before.

Under these conditions, glow discharge was further maintained for 10 minutes to form an upper barrier layer to a thickness of 900 Å, and thereafter the heater 1408 was turned off, with the high frequency power source 1443 being also turned off, the substrate was left to cool to 100° C., whereupon the outflow valves 1426, 1429 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 15μ. Using this image-forming member, image was formed on a copying paper under the same conditions and according to the same procedures as in Example 29, whereby there was obtained a very clear image quality.

Example 35

A substrate, which had been treated in the same manner described in Example 1, was set similarly to in Example 1, followed by evacuation of the glow discharge deposition chamber 1401 to $5\times10^{-6}$ Torr according to the same procedures as in Example 8. After the substrate temperature was maintained at 250° C., according to the same procedures as in Example 8, the auxiliary valves 1441-1, 1441-2, subsequently the outflow valves 1426, 1427, and inflow valves 1421, 1422 were fully opened thereby to effect sufficiently degassing of the mass flow controllers 1416, 1417 to vacuo. After closing of the auxiliary valves 1441-1, 1441-2, and the valves 1426, 1427, 1421, 1422, the valve 1431 of the bomb 1411 containing $SiH_4$ (10)/$H_2$ gas and the valve 1432 of the bomb 1412 containing $O_2$ (0.1)/He were opened to adjust the pressures at the outlet pressure gauges 1436, 1437, respectively, to 1 kg/cm$^2$, followed by gradual opening of the inflow valves 1421, 1422 to introduce the $SiH_4$ (10)/$H_2$ gas and $O_2$ (0.1)/He gas into the mass flow controllers 1416 and 1417, respectively. Subsequently, the outflow valves 1426 and 1427 were gradually opened, followed by gradual opening of the auxiliary valves 1441-1 and 1441-2. The mass flow controllers 1416 and 1417 were adjusted thereby so that the gas flow amount ratio of $SiH_4$ (10)/$H_2$ to $O_2$ (0.1)/He was 1:10.

Then, while carefully reading the pirani gage 1442, the openings of the auxiliary valves 1441-1, 1441-2 were adjusted and they were opened to the extent until the inner pressure in the chamber 1401 became $1\times10^{-2}$ Torr. After the inner pressure in the chamber 1401 was stabilized, the main valve 1410 was gradually closed to narrow its opening until the indication on the pirani gauge 1442 became 0.1 Torr. After confirming that the gas inflow and the inner pressure were stable, followed by closing of the shutter 1405, the switch of the high frequency power source 1443 was turned on to input a high frequency power of 13.56 MHz between the electrode 1403 and the shutter 1405 to generate glow discharging in the chamber 1410 to provide an input power of 10 W. Simultaneously with commencement of formation of the photoconductive layer on the substrate under the above initial layer forming conditions, the setting value of flow amount at the mass flow controller 1417 was continuously decreased and formation of the photoconductive amorphous layer was conducted by controlling the gas flow amount ratio of $SiH_4$ (10)/$H_2$ to $O_2$ (0.1)/He 2.5 hours after commencement of layer formation to 10:0.3. Then, after said ratio had been maintained for 30 minutes, the setting value of flow amount at the mass flow controller 1417 was continuously increased, as contrary to the previous operation, until the gas flow amount ratio of $SiH_4$ (10)/$H_2$ to $O_2$ (0.1)/He was adjusted to 1:10 for 2.5 hours after commencement of increase of the flow amount.

After completion of formation of the photoconductive amorphous layer, the heater 1408 was turned off, with the high frequency power source 1443 being also turned off, and the substrate was left to cool to 100° C., whereupon the outflow valves 1426, 1427 and the inflow valves 1421, 1422 were closed, with the main valve 1410 being fully opened, thereby to make the inner pressure in the chamber 1401 to $10^{-5}$ Torr or less. Then, the main valve 1401 was closed and the inner pressure in the chamber 1401 was made atmospheric through the leak valve 1406, and the substrate having formed layers was taken out. In this case, the entire thickness of the layers formed was about 17μ. Using this image-forming member, image was formed on a copying paper under the same conditions and according to the same procedures as in Example 8, whereby there was obtained a very clear image.

Example 36

After formation of a lower barrier layer on a substrate, which had been treated in the same manner in Example 1, according to the same procedures and under the same conditions as in Example 29, the high frequency power source 1443 was turned off for to interrupt glow discharge. Under this state, the outflow valve 1429 was closed and thereafter the valve 1432 of the bomb 1412 containing $O_2$ (0.1)/He gas and the valve 1433 of the bomb 1413 containing $B_2H_6$ gas (purity: 99.999%) diluted to 50 vol. ppm with $H_2$ [(hereinafter abridged as $B_2H_6$ (50)/$H_2$)] were opened to adjust the pressures at the outlet pressure gauges 1437, 1438, respectively, to 1 kg/cm$^2$, followed by gradual opening of the inflow valves 1422, 1423 to introduce the $O_2$ (0.1)/He gas and $B_2H_6$ (50)/$H_2$ gas into the mass flow controllers, 1417, and 1418 respectively. Subsequently, the outflow valves 1427 and 1428 were gradually opened, and the mass flow controllers 1416, 1417 and 1418 were adjusted thereby so that the gas flow amount ratio of $SiH_4$ (10)/$H_2$ to $O_2$ (0.1)/He was 1:10, and the flow amount ratio of $SiH_4$ (10)/$H_2$ to $B_2H_6$ (50)/$H_2$ was 1:5. Then, while carefully reading the pirani gauge 1442, the opening of the auxiliary valves 1441-1 and 1441-2 were adjusted and they were opened to the extent until the inner pressure in the chamber 1401 became $1\times10^{-2}$ Torr. After the inner pressure in the chamber 1401 was stabilized, the main valve 1410 was gradually closed to narrow its opening until the indication of the pirani gauge 1442 became 0.1 Torr.

After confirming that the gas feeding and the inner pressure were stable, the switch of the high frequency power source 1443 was turned on to input a high frequency power of 13.56 MHz to renew glow discharging in the chamber 1401 to provide an input power of 10 W.

Simultaneously with commencement of formation of the photoconductive amorphous layer on the lower barrier layer under the above conditions, the setting value of flow amount at the mass flow controller 1417 was continuously decreased and formation of the photoconductive amorphous layer was conducted by controlling the gas flow amount ratio of $SiH_4$ (10)/$H_2$ to $O_2$ (0.1)/He 5 hours after commencement of layer formation to 10:0.3. After the photoconductive amorphous layer was thus formed for 5 hours, the heater 1408 was turned off, with the high frequency power source 1443 being also turned off, and the substrate was left to cool to 100° C., whereupon the outflow valves 1426, 1427, 1428 and the inflow valves 1421, 1422, 1423, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 15μ.

The thus prepared image-forming member was placed in an experimental device for charging and light-exposure, and corona charging was effected at −5.5 KV for 0.2 sec., followed immediately by irradiation of a light image. The light image was irradiated through a transmission type test chart using a tungsten lamp as light source at a dosage of 1.0 lux. sec.

Immediately thereafter, positively (+) charged developers (containing toner and carrier) were cascaded on the surface of the image-forming member to obtain a good toner image on the image-forming member. When the toner image on the image-forming member was copied on a copying paper by corona charging at −5.0 KV, there was obtained a clear image of high density which was excellent in resolution as well as gradation reproducibility.

Next, the above image-forming member was subjected to corona charging by means of a charging light-exposure experimental device at +6.0 KV for 0.2 sec., followed immediately by image exposure to light at a dosage of 1.0 lux. sec., and thereafter immediately (−) charged developer was cascaded on the surface of the member. Then, by copying on a copying paper and fixing, there was obtained a very clear image.

As apparently seen from the above result, in combination with the previous result, the image-forming member for electrophotography obtained in this Example has the characteristics of a both-polarity image-forming member having no dependency on the charged polarity.

Example 37

A photoconductive amorphous layer was formed on a substrate under the same operational conditions as described in Example 30 except for the following conditions. Namely, the $SiH_4$ (10)/$H_2$ gas bomb 1411 was replaced with the bomb containing $SiF_4$ gas (purity: 99.999%), and the bomb 1412 containing $O_2$ (0.1)/He gas with the bomb of argon gas (purity: 99.999%) containing 0.2 vol. % for oxygen [(hereinafter abridged as $O_2$ (0.2)/Ar)]. The flow amount ratio of $SiF_4$ gas to $O_2$ (0.2)/Ar at the initial state of deposition of the photoconductive amorphous layer was set at 1:18, and the flow amount of $O_2$ (0.2)/Ar was continuously decreased after commencement of the layer formation so that the flow amount ratio of $SiF_4$ gas to $O_2$ (0.2)/Ar gas could become 1:0.6 at the completion of deposition of the photoconductive layer. Further, the input power for glow discharging was changed to 100 W. The layer thickness formed in this case was about 18μ. The thus prepared image-forming member was tested for image formation on a copying paper according to the same procedures as in Example 29, whereby a very clear image was obtained.

Example 38

Using a device as shown in FIG. 14, an image-forming member for electrophotography was prepared according to the following procedures.

A substrate 1409 of 10 cm square having a thickness of 0.5 mm, which had been treated in the same manner described in Example 29, was fixed firmly on a fixing member 1403 disposed at a predetermined position in a deposition chamber 1401. The target 1404 was formed by mounting a high purity graphite (99.999%) on a high purity polycrystalline silicon (99.999%) (the area ratio of the silicon to the graphite on the target was 1:2). The substrate 1409 was heated by a heater 1408 within the fixing member 1403 with a precision of ±0.5° C. The temperature was measured directly at the backside of the substrate by an alumel-chromel thermocouple. Then, after confirming that all the valves in the system were closed, the main valve 1410 was opened, and evacuation of the chamber 1401 was effected to about $5\times10^{-6}$ Torr (all the valves except for the main valve were closed during this operation).

Then, the auxiliary valves 1441-1, 1441-2, 1441-3, subsequently the outflow valves 1426, 1427, 1429, 1430 were opened to effect degassing sufficiently in the mass flow controllers 1416, 1417, 1419, 1420 to vacuo. Thereafter, the outflow valves 1426, 1427, 1429, 1430 and the auxiliary valves 1441-1, 1441-2 and 1441-3 were closed. The valve 1435 of the bomb 1415 containing argon gas (purity: 99.999%) was opened to adjust the pressure at the outlet pressure gauge 1440 at 1 kg/cm$^2$, whereupon the inflow valve 1425 was opened, followed by gradual opening of the outflow valve 1430 to introduce argon gas into the chamber 1401. Subsequently, the outflow valve 1430 was gradually opened until the indication on the pirani gauge 1411 became $5\times10^{-4}$ Torr. After the flow amount was stabilized under this state, the main valve 1410 was gradually closed to narrow its opening until the inner pressure in the chamber 1401 became $1\times10^{-2}$ Torr. After confirming that the mass flow controller 1420 was stabilized, with the shutter being closed, the high frequency power source 1443 was turned on to input an alternate current of 13.56 MHz, 100 W between the target 1404 and the fixing member 1403. Formation of a layer was started, while taking matching so as to continue discharging stably under the above conditions. Thus, discharging was continued for one minute to form a lower barrier layer with a thickness of 100 Å. Thereafter, with the high frequency power source 1443 turned off for intermission of the glow discharge, the outflow valve 1430 was closed, with full opening of the main valve 1410 to draw out the gas in the chamber 1401 to vacuum of $5\times10^{-6}$ Torr. Then, the input voltage at the heater 1408 was elevated and the input voltage was changed while detecting the temperature of the substrate, until it was stabilized constantly at 200° C.

Following afterwards the procedures similar to Example 30 under the same conditions, a photoconductive amorphous layer was formed. The thus prepared image-forming member was tested for image formation on a copying paper similarly as described in Example 29, whereby there was obtained a very clear and sharp image quality.

Example 39

A photoconductive amorphous layer was formed on a substrate according to the same procedures and under the same conditions as in Example 37, except that the bomb 1412 containing $O_2$ (0.2)/Ar gas was replaced with the bomb of He gas containing 0.2 vol. % of $O_2$ gas.

The thickness of the layer formed in this case was about 15μ. Using this image-forming member, an image was formed on a copying paper similarly to described in Example 8 to obtain a very clear image.

Example 40

An image-forming member for electrophotography was prepared according to the same procedure and under the same conditions as in Example 29 except that $NH_3$ gas was used in place of $O_2$ gas and $NH_3$ (0.1)/$H_2$ gas in place of $O_2$ (0.1)/He, and that the flow amount ratio of $SiH_4$(10)/$H_2$ gas to $NH_3$ gas was changed to 5:1.

Using the thus prepared image-forming member for electrophotography, image forming treatment was performed similarly as in Example 29. The resulting image on the transfer paper was excellent in resolution, clear with good gradation reproducibility and also high in density.

The image forming treatment as described above was applied repeatedly to the above image-forming member for elecrophotography for testing of durability. As the result, the image obtained on the ten thousandth transfer paper was also of extremely good quality without substantial difference from the image on the first transfer paper, thus providing that the image-forming member for electrophotography was excellent in corona ion resistance, abrasion resistance and cleaning characteristic and also markedly rich in durability.

Example 41

A substrate of aluminum alloy 61S (contining Cu, Si and Cr) of 1 mm in thickness and 10 cm×10 cm in size, of which surface had been subjected to the mirror grinding, was subjected to the same anodic oxidation as described in Example 40, and fully dried. Thereafter the resulting substrate was allowed to stand in a superheated steam bath of 3 atmospheres for 20 minutes. Using the substrate thus treated, an image-forming member was prepared in the same manner as described in Example 40 to test its image-quality and durability. As a result, the image-forming member shows excellent image-characteristics and durability.

Example 42

Amorphous layers were formed in the same manner as described in Example 40, except that the thickness of the coating on the substrate was changed by change of the anodic oxidation time as shown in Table 5. And results shown in Table 5 were obtained by evaluation of image-quality and repeatability. In these cases, development was carried out by using the magnetic brush method and applying the developing bias value capable of producing the best image.

TABLE 5

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○Good; X Poor

Example 43

An image-forming member for electrrophotography was prepared according to the same procedure and under the same conditions as in Example 33 except that $NH_3$(0.1)/$H_2$ gas was used in place of $O_2$(0.1)/He gas.

Using the thus prepared image-forming member for electrophotography, image forming treatment was performed similarly as in Example 33. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 44

An image-forming member for electrophotography was prepared according to the same procedure and under the same conditions as in Example 34 except that $C_2H_4$ gas was used in place of $O_2$ gas and $NH_3$(0.1)/$H_2$ gas in place of $O_2$(0.1)/He gas; and that the flow amount ratio of $SiH_4$(10)/$H_2$ to $NH_3$ was changed to 5:1.

Using the thus prepared image-forming member for electrophotography, image forming treatment was performed similarly as in Example 34. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus providing that the image-forming member for electrophotography was excellent in corona ion resistance, abrasion resistance and cleaning characteristic and also markedly rich in durability.

Example 45

An image-forming member for electrophotography was prepared according to the same procedure and under the same conditions as in Example 35 except that $NH_3$ gas was used in place of $O_2$ gas and $NH_3$ gas diluted to 0.1 vol.% with $H_2$ [(hereinafter abridged as $NH_3(0.1)/H_2$)] in place of $O_2(0.1)/He$ gas.

Using the thus prepared image-forming member for electrophotography, image forming treatment was performed similarly as in Example 35. The resulting image on the transfer paper was excellent in resolution, clear with good gradation reproducibility and also high in density.

Example 46

An image-forming member for electrophotography was prepared according to the same procedure and under the same conditions as in Example 35 except that $NH_3(0.1)/H_2$ gas was used in place of $O_2(0.1)/He$ gas.

Using the thus prepared image-forming member for electrophotography, image forming treatment was performed similarly as in Example 35. The resulting image on the transfer paper was excellent in resolution, clear with good gradation reproducibility and also high in density.

Example 47

An image-forming member for electrophotography was prepared according to the same procedure and under the same conditions as in Example 36 except that $NH_3(0.1)/H_2$ gas was used in place of $O_2(0.1)/He$ gas.

Using the thus prepared image-forming member for electrophotography, image forming treatment was performed similarly as in Example 36. The resulting image on the transfer paper was excellent in resolution, clear with good gradation reproducibility and also high in density.

Example 48

An image-forming member for electrophotography was prepared according to the same procedure and under the same conditions as in Example 37 except that $NH_3$ gas diluted to 0.2 vol.% with Ar [(hereinafter abridged as $NH_3(0.2)/Ar$)] was used in place of $O_2(0.2)/Ar$ gas.

Using the thus prepared image-forming member for electrophotography, image forming treatment was performed similarly as in Example 37. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 49

An image-forming member for electrophotography was prepared according to the same procedure and under the same conditions as in Example 38 except that $NH_3$ gas was used in place of $O_2$ gas and $NH_3(0.1)/H_2$ gas in place of $O_2(0.1)/He$ gas.

Using the thus prepared image-forming member for electrophotography, image forming treatment was performed similarly as in Example 38. The resulting image on the transfer paper was excellent in resolution, clear with good gradation reproducibility and also high in density.

Example 50

When Examples 40 to 49 were repeated except that $N_2$, $(NH_3+O_2)$, $N_2O$, or $(N_2+O_2)$ was used in place of $NH_3$, and corresponding electrophotographic image forming processes were applied to respective photoconductive members prepared, there could be obtained transferred images of very high quality. Further, no lowering in transferred image quality was observed after repeated uses for a long time.

Example 51

An image-forming member for electrophotography was prepared according to the same procedure and under the same conditions as in Example 29 except that $C_2H_4$ gas was used in place of $O_2$ gas and $C_2H_4$ gas diluted to 0.1 vol.% with $H_2$ [hereinafter abridged as $C_2H_4(0.1)/H_2$] in place of $O_2(0.1)/He$; and that the flow amount ratio of $SiH_4(10)/H_2$ to $C_2H_4(0.1)/H_2$ was continuously changed from 1:1 to 10:0.3 from initiation to completion of formation of the amorphous layer.

Using the thus prepared image-forming member for electrophotography, image forming treatment was performed similarly as in Example 29. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 52

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 51, and fully dried. Thereafter the resulting substrate was allowed to stand in a superheated steam bath of 3 atmospheres for 20 minutes. Using the substrate thus treated, an image-forming member was prepared in the same manner as described in Example 10 to test its image-quality and durability. As a result, the image-forming member shows excellent image-characteristics and durability.

Example 53

Amourphous layers were formed in the same manner as described in Example 51, except that the thickness of the coating on the substrate was changed by change of the anodic oxidation time as shown in Table 6. And results shown in Table 6 were obtained by evaluation of image-quality and repeatability. In these cases, development was carried out by using the magnetic brush method and applying the developing bias value capable of producing the best image.

TABLE 6

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○Good; X Poor

Example 54

An image-forming member for electrophotography was prepared according to the same procedure and under the same conditions as in Example 32 except that $C_2H_4(0.1)/H_2$ gas was used in place of $O_2(0.1)/He$ gas; and that the flow amount ratio of $SiH_4(10)/H_2$ to $C_2H_4(0.1)/H_2$ was changed from 1:10 to 10:0.1.

Using the thus prepared image-forming member for electrophotography, image forming treatment was performed similarly as in Example 32. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 55

An image-forming member for electrophotography was prepared according to the same procedure and under the same conditions as in Example 33 except that $C_2H_4$ gas was used in place of $O_2$ gas and $C_2H_4(0.1)/H_2$ gas in place of $O_2(0.1)/He$ gas.

Using the thus prepared image-forming member for electrophotography, image forming treatment was performed similarly as in Example 33. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also extremely of good quality without substantial difference from the image on the first transfer paper, thus proving that the image-forming member for electrophotography was excellent in corona ion resistance, abrasion resistance and cleaning characteristic and also markedly rich in durability.

Example 56

An image-forming member for electrophotography was prepared according to the same procedure and under the same conditions as in Example 34 except that $C_2H_4$ gas was used in place of $O_2$ gas and $C_2H_4(0.1)/H_2$ gas in place of $O_2(0.1)/He$ gas.

Using the thus prepared image-forming member for electrophotography, image forming treatment was performed similarly as in Example 34. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paer was also of extremely good quality without substantial difference from the image on the first transfer paper.

Example 57

An image-forming member for electrophotography was prepared according to the same procedure and under the same conditions as in Example 35 except that $C_2H_4(0.1)/He$ gas was used in place of $O_2(0.1)/He$ gas; and the flow amount ratio of $SiH_4(10)/H_2$ to $C_2H_4(0.1)/H_2$ was changed from 10:0.3 to 10:0.1.

Using the thus prepared image-forming member for electrophotography, image forming treatment was performed similarly as in Example 35. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 58

An image-forming member for electrophotography was prepared according to the same procedure and under the same conditions as in Example 36 except that $C_2H_4(0.1)/H_2$ gas was used in place of $O_2(0.1)/He$ gas;

and that the flow amount ratio of $SiH_4(10)/H_2$ to $C_2H_4(0.1)/H_2$ was changed from 10:0.3 to 10:0.1.

Using the thus prepared image-forming member for electrophotography, image forming treatment was performed similarly as in Example 36. The resulting image on the transfer paper was excellent in resolution, clear with good gradation reproducibility and also high in density.

Example 59

An amorphous layer was formed according to the same procedures and under the same conditions as in Example 37, except that the $O_2(0.2)/Ar$ gas bomb 1412 was replaced with the bomb of Ar gas containing 0.2 vol.% of $C_2H_4$ gas; and that the flow amount ratio of $SiF_4$ to $C_2H_4(0.2)/Ar$ was continuously changed from 1:15 to 1:0.5 from initiation to completion of formation of the amorphous layer.

The thickness of the layer formed in this case was about 15μ. Using this image-forming member, an image was formed on a copying paper similarly to described in Example 15 to obtain a very clear image.

Example 60

An image-forming member for electrophotography was prepared according to the same procedure and under the same conditions as in Example 38 except that $C_2H_4$ gas was used in place of $O_2$ gas and $C_2H_4(0.1)/H_2$ gas in place of $O_2(0.1)/He$ gas.

Using the thus prepared image-forming member for electrophotography, image forming treatment was performed similarly as in Example 38. The resulting image on the transfer paper was excellent in resolution, clear with good gradation reproducibility and also high in density.

The image-forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning charaacteristic and also markedly rich in durability.

Example 61

An image-forming member for electrophotography was prepared according to the same procedure and under the same conditions as in Example 59 except that $C_2H_4$ gas diluted to 0.2 vol.% with $H_2$ [(hereinafter abridged as $C_2H_4(0.2)/H_2$)] was used in place of $C_2H_4(0.2)/Ar$ gas.

Using the thus prepared image-forming member for electrophotography, image forming treatment was performed similarly as in Example 59. The resulting image on the transfer paper was excellent in resolution, clear with good gradation reproducibility and also high in density.

Example 62

Using a device as shown in FIG. 14 placed in a clean room which has been completely shielded, an image-forming member for electrophotography was prepared according to the following procedures.

A substrate 1409 of 10 cm square having a thickness of 0.5 mm, which had been treated in the same manner described in Example 1, was fixed firmly on a fixing member 1403 disposed at a predetermined position in a glow discharge deposition chamber 1401. The substrate 1409 was heated by a heater 1408 within the fixing member 1403 with a precision of ±0.5° C. The temperature was measured directly at the backside of the substrate by an alumel-chromel thermocouple. Then, after confirming that all the valves in the system were closed, the main valve 1410 was fully opened, and evacuation of the chamber 1401 was effected to about $5\times10^{-6}$ Torr. Thereafter, the input voltage for the heater 1408 was elevated by varying the input voltage while detecting the substrate temperature until the temperature was stabilized constantly at 250° C.

Then, the auxiliary valves 1441-1, 1441-2, 1441-3, subsequently the outflow valves 1426, 1427, 1429 and the inflow valves 1421, 1422, 1424 were opened fully to effect degassing sufficiently in the mass flow controllers 1416, 1417, 1419 to vacuo. After closing the valves 1426, 1427, 1429, 1421, 1424, the valve 1431 of the bomb 1411 containing $SiH_4(10)/H_2$ gas and the valve 1434 of the bomb 1414 containing $O_2$ gas (purity: 99.999%) were respectively opened to adjust the pressures at the outlet pressure gages 1436 and 1439, respectively, at 1 kg/cm$^2$, whereupon the inflow valves 1421 and 1424 were gradually opened to introduce $SiH_4(10)/H_2$ gas and $O_2$ gas into the mass flow controllers 1416 and 1419, respectively. Subsequently, the outflow valves 1426 and 1429 were gradually opened, followed by opening of the auxiliary valves 1441-1, 1441-3. The mass flow controllers 1416 and 1419 were adjusted thereby so that the gas flow amount ratio of $SiH_4(10)/H_2$ to $O_2$ was 10:1. Then, while carefully reading the pirani gauge 1442, the opening of the auxiliary valves 1441-1 and 1441-3 were adjusted and they were opened to the extent until the inner pressure in the chamber 1401 became $1\times10^{-2}$ Torr.

After the inner pressure in the chamber 1401 was stabilized, the main valve 1410 was gradually closed to narrow its opening until the indication on the pirani gauge 1442 become 0.1 Torr. After confirming that the gas inflow and the inner pressure were stable, followed by closing of the shutter 1405, the switch of the high frequency power source 1443 was turned on to input a high frequency power of 13.56 MHz between the electrode 1403 and the shutter 1405 to generate glow discharging in the chamber 1401 to provide an input power of 3 W. The above conditions were maintained for 10 minutes to form lower layer region which is a part of a photoconductive amorphous layer to a thickness of 600 Å. Thereafter, with the high frequency power source 1443 turned off for interruption of the glow discharge, the outflow valve 1429 was closed, and then under the pressure of 1 kg/cm$^2$ (reading on the outlet pressure gauge 1439) through the valve 1422 of the bomb 1412 containing $O_2(0.1)/He$ gas, the inflow valve 1422, and the outflow valve 1427 were gradually opened to introduce $O_2(0.1)/He$ gas into the mass controller 1417, and the flow amount ratio of $O_2(0.1)/He$ gas to $SiH_4(10)/H_2$ was adjusted by the mass flow controllers 1416 and 1417 so that the gas flow amount ratio of $O_2(0.1)/He$ to $SiH_4(10)/H_2$ was 0.3:10.

Subsequently, the high frequency power source 1443 was turned on again to renew glow discharge. The input power was 10 W.

After an intermediate layer region constituting a part of the photoconductive amorphous layer was formed under the above conditions for 5 hours, the high frequency power source 1443 was turned off for interruption of glow discharge. Under this state, the outflow valve 1427 was closed, followed by reopening of the outflow valve 1429, and the flow amount of the $O_2$ gas was stabilized to 1/10 based on the flow amount of $SiH_4(10)/H_2$ gas by adjustment of the mass flow controllers 1419, 1416. Subsequently, the high frequency power source 1443 was turned on again to renew glow discharge. The input power was 3 W, similarly as before.

After glow discharging was maintained for 15 minutes to form an upper layer region constituting a part of the photoconductive amorphous layer to a thickness of 900 Å, the heater 1408 was turned off, with the high frequency power source 1443 being also turned off, the substrate was left to cool to 100° C., whereupon the outflow valves 1426, 1429 and the inflow valves 1421, 1422, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers was about 15μ.

The thus prepared image-forming member was placed in an experimental device for charging and light-exposure, and corona charging was effected at −5.5 KV for 0.2 sec., followed immediately by irradiation of a light image. The light image was irradiated through a transmission type test chart using a tungsten lamp as light source at a dosage of 1.0 lux. sec.

Immediately thereafter, positively (+) charged developers (containing toner and carrier) were cascaded on the surface of the image-forming member to obtain a good toner image on the image-forming member. When the toner image on the image-forming member was copied on a copying paper by corona charging at −5.0 KV, there was obtained a clear image of high density which was excellent in resolution as well as gradation reproducibility.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability. As the cleaning method, there was adopted the blade cleaning in which a blade made of a molded product of urethane rubber was employed.

During the repeated image formation, it was observed that the surface potential of the aforesaid image-forming member for electrophotography was constantly about 240 V at the dark portion, while it was about 50 V at the bright portion, being completely free from decrease of potential at the dark portion or the increase of residual potential.

Example 63

A substrate of aluminum alloy 61S (containing Cu, Si and Dr) of 1 mm in thickness and 10 cm×10 cm in size, of which surface had been subjected to the mirror grinding, was subjected to the same anodic oxidation as described in Example 62, and fully dried. Thereafter the resulting substrate was allowed to stand in a superheated steam bath of 3 atmospheres for 20 minutes. Using the substrate thus treated, an image-forming member was prepared in the same manner as described in Example 62 to test its image-quality and durability. As a result, the image-forming member shows excellent image-characteristics and durability.

Example 64

Amorphous layers were formed in the same manner as described in Example 62, except that the thickness of the coating on the substrate was changed by change of the anodic oxidation time as shown in Table 7. And results shown in Table 7 were obtained by evaluation of image-quality and repeatability. In these cases, development was carried out by using the magnetic brush method and applying the developing bias value capable of producing the best image.

TABLE 7

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | (Fog occurs in the negligible extend) | ⊙ |
| 5 | ○ (high density) | ○ (Fog gradually occurs) | ○ |
| 20 | ○ (high density) | X (Fog soon occurs) | X |

*⊙Excellent; ○Good; X Poor

Example 65

A substrate, which had been treated in the same manner described in Example 1, was set similarly as in Example 62, followed by evacuation of the glow discharge deposition chamber 1401 to $5\times10^{-5}$ Torr according to the same procedures as in Example 62. According to the same procedures as in Example 17, the auxiliary valves 1441-1, 1441-2, 1441-3, subsequently the outflow valves 1426, 1427, 1429, 1430 and inflow valves 1421, 1422, 1424, 1425 were fully opened thereby to effect sufficiently degassing of the mass flow controllers 1416, 1417, 1419, 1420 to vacuo. After closing of the auxiliary valves 1441-1, 1441-2, 1441-3 and the valves 1426, 1427, 1429, 1430, 1421, 1422, 1424, 1425, the valve 1435 of the bomb 1415 containing the argon gas (purity: 99.999%) was opened to adjust the pressure at the outlet pressure gauge 1440 to 1 kg/cm², followed by opening of the inflow valve 1425 and then gradual opening of the outflow valve 1430 to introduce argon gas into the chamber 1401. The outflow valve 1430 was gradually opened until the indication on the pirani gauge became $5\times10^{-4}$ Torr. After the flow amount was stabilized under this state, the main valve 1410 was gradually closed to narrow its opening until the inner pressure in the chamber became $1\times10^{-2}$ Torr. The shutter 1405 was opened, and confirming that the mass flow controller 1420 was stabilized, the high frequency power source 1443 was turned on to input an alternate current power of 13.56 MHz, 100 W between the target 1404, which had a high purity graphite wafer (purity: 99.999%) mounted on a high purity polycrystalline silicon wafer (purity: 99.999%) (The area ratio of the silicon to the graphite was 1:9) and the fixing member 1403. Under these conditions, a layer was formed while taking matching so as to continue stable discharging. Discharging was thus continued for one minute to form a lower barrier layer with a thickness of 100 Å. The high frequency power source was thereafter turned off for interruption of discharging. Subsequently, the outflow valve 1430, the shutter 1405 were closed, with full opening of the main valve, 1410 to degas the chamber 1401 to $5\times10^{-6}$. Then, the input voltage at the heater 1408 was elevated, while detecting the substrate temperature, until it was stabilized constantly at 200° C. Following afterwards the procedures under the same conditions as in Example 62, a photoconductive amorphous layer was formed. The thus prepared image-forming member was used for image formation on a copying paper according to the same procedures and under the same conditions as in Example 62, whereby there was obtained a very clear and sharp image quality.

EXAMPLE 66

After formation of a lower layer region constituting a part of the photoconductive amorphous layer on a substrate, which had been treated in the same manner described in Example 1, according to the same procedures and under the same conditions as in Example 62, the high frequency power source 1443 was turned off for intermission of glow discharge. Under this state, the outflow valve 1429 was closed and thereafter the valve 1432 of the bomb 1412 containing $O_2(0.1)/He$ gas and the valve 1433 of the bomb 1413 containing $B_2H_6(50)/H_2$ gas were opened to adjust the pressures at the outlet pressure gages 1437, 1438 to 1 kg/cm$^2$, respectively followed by gradual opening of the inflow valves 1422, 1423, to introduce $O_2(0.1)/He$ gas and $B_2H_6(50)/H_2$ gas into the mass flow controllers 1417 and 1418, respectively. Subsequently, outflow valves 1427 and 1428 were gradually opened, and the mass flow controllers 1416, 1417 and 1418 were controlled so that the ratio of the flow amount of $SiH_4(10)/H_2$ to that of $O_2(0.1)/He$ was 10:0.3 and the ratio of the flow amount of $SiH_4(10)/H_2$ to that of $B_2H_6(50)/H_2$ gas was 50:1. Then, while carefully reading the pirani gauge 1442, the opening of the auxiliary valves 1441-1 and 1441-2 were again adjusted and they were opened to the extent until the inner pressure in the chamber 1401 became $1\times10^{-2}$ Torr. After the inner pressure in the chamber 1401 was stabilized, the main valve 1410 was again adjusted to narrow its opening until the indication on the pirani gauge 1442 became 0.1 Torr.

After confirming that the gas inflow and the inner pressure were stabilized, the switch of the high frequency power source 1443 was turned on again to input a high frequency power of 13.56 MHz to renew glow discharging in the chamber 1401 to provide an input power of 10 W. The above conditions were maintained for 5 hours to form an intermediate layer region which was a part of a photoconductive layer. Thereafter, with the high frequency power source 1443 turned off for interruption of the glow discharge, the outflow valves 1427 and 1428 were closed, and then the outflow valve 1429 was opened again and the ratio of the flow amount of $O_2$ gas to $SiH_4(10)/H_2$ gas was stabilized by controlling of the mass flow controllers 1419, 1416 to 1/10.

Subsequently, the high frequency power source 1443 was turned on again to renew glow discharge. The input power was 3 W similarly to in formation of the lower layer region. After glow discharge was continued for additional 15 minutes to form an upper layer region which was a part of a photoconductive amorphous layer to a thickness of 900 Å, the heater 1408 was turned off, with the high frequency power source 1443 being also turned off, the substrate was left to cool to 100° C., whereupon the outflow valves 1426, 1427, 1428 and the inflow valves 1421, 1422, 1423, 1424 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers was about 15$\mu$.

The thus prepared image-forming member was placed in an experimental device for charging and light-exposure, and corona charging was effected at −5.5 KV for 0.2 sec., followed immediately by irradiation of a light image. The light image was irradiated through a transmission type test chart using a tungsten lamp as light source at a dosage of 1.0 lux. sec.

Immediately thereafter, positively (+) charged developers (containing toner and carrier) were cascaded on the surface of the image-forming member to obtain a good toner image on the image-forming member. When the toner image on the image-forming member was copied on a copying paper by corona charging at −5.0 KV, there was obtained a clear image of high density which was excellent in resolution as well as gradation reproducibility.

Next, the above image-forming member was subjected to corona charging by means of a charging light-exposure experimental device at +6.0 KV for 0.2 sec., followed immediately by image exposure to light at a dosage of 1.0 lux. sec., and thereafter immediately (−) charged developer was cascaded on the surface of the member. Then, by copying on a copying paper and fixing, there was obtained a very clear image.

As apparently seen from the above result, in combination with the previous result, the image-forming member for electrophotography obtained in this Example has the characteristics of a both-polarity image-forming member having no dependency on the charged polarity.

Example 67

The bomb 1411 containing $SiH_4(10)/H_2$ gas was previously replaced with the bomb containing $SiF_4$ gas (purity: 99.999%), and a lower barrier layer was formed on a substrate, which had been treated in the same manner described in Example 1, according to the same procedures and under the same conditions as in Example 65. Then, with the high frequency power source 1443 turned off for interruption of glow discharge, the outflow valves 1430 and the shutter 1405 were closed, followed by full opening of the main valve 1410, to degass the chamber 1401 to $5\times10^{-6}$ Torr. The input voltage at the heater 1408 was thereafter elevated, while detecting the substrate temperature, until it was stabilized constantly at 200° C. Then, with the shutter 1405 closed, $SiF_4$ gas and $O_2$ gas were used by setting their flow amount ratio at 10:1 in forming the lower layer region and the upper layer region, while $SiF_4$ gas and $O_2(0.1)/He$ gas werre used by setting their flow amount ratio at 1:1.2 in formation of the intermediate layer region, and the input power for glow discharge was 100 W. Under otherwise the same conditions as in Example 62, a photoconductive amorphous layer was formed.

After formation of the photoconductive amorphous layer, with the heater 1408 turned off, the outflow valves 1426, 1428 were closed and the shutter 1405 was opened again. When the substrate temperature was cooled to 80° C., the upper barrier layer was formed similarly under the same conditions as in formation of the lower barrier layer.

After forming, on the substrate, the lower barrier layer, the photoconductive layer and the upper barrier layer as described, the high frequency power source 1443 was turned off, and the outflow valve 1430 and the inflow valves 1421, 1422, 1425 were closed, with the main valve 1410 being fully opened, thereby to make the inner pressure in the chamber 1401 to $10^{-5}$ Torr or less. Then, the main valve 1410 was closed and the inner pressure in the chamber 1401 was made atmospheric through the leak valve 1406, and the substrate having formed respective layers was taken out. In this case, the entire thickness of the layers formed was about 15μ. Using this image-forming member, image was formed on a copying paper under the same conditions and according to the same procedures as in Example 62, whereby there was obtained a very clear image.

Example 68

An image-forming member for electrophotography was prepared according to the same procedure and under the same conditions as in Example 62 except that $C_2H_4(0.1)/H_2$ gas was used in place of $O_2(0.1)/He$ gas and $C_2H_4$ gas in place of $O_2$ gas; and that the flow amount ratio of $SiH_4(10)/H_2$ to $C_2H_4(0.1)/H_2$ in forming the intermediate region layer was changed to 10:0.5.

Using the thus prepared image-forming member for electrophotography, image forming treatment was performed similarly as in Example 62. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resitance, abrasion resistance and cleaning characteristic and also markedly rich in durability. As the cleaning method, there was adopted the blade cleaning in which a blade made of a molded product of urethane rubber was employed.

During the repeated image formation, it was observed that the surface potential of the aforesaid image-forming member for electrophotography was constantly about 240 V at the dark portion, while it was about 50 V at the bright portion, being completely free from decrease of potential at the dark portion or the increase of residual potential.

Example 69

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 68, and fully dried. Thereafter the resulting substrate was allowed to stand in a superheated steam bath of 3 atmospheres for 20 minutes. Using the substrate thus treated, an image-forming member was prepared in the same manner as described in Example 68 to test its image-quality and durability. As a result, the image-forming member shows excellent image-characteristics and durability.

Example 70

Photoconductive layers were formed in the same manner as described in Example 68, except that the thickness of the coating on the substrate was changed by change of the anodic oxidation time as shown in Table 8. And results shown in Table 8 were obtained by evaluation of image-quality and repeatability. In these cases, development was carried out by using the magnetic brush method and applying the developing bias value capable of producing the best image.

TABLE 8

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○Good; X Poor

Example 71

An image-forming member for electrophotography was prepared according to the same procedure and under the same conditions as in Example 65 except that $C_2H_4(0.1)/H_2$ gas was used in place of $O_2(0.1)/He$ gas and $C_2H_4$ gas in place of $O_2$ gas; and that the flow amount ratio of $SiH_4(10)/H_2$ to $C_2H_4(0.1)/H_2$ in forming the intermediate region layer was changed to 10:0.5.

Using the thus prepared image-forming member for electrophotography, image forming treatment was performed similarly as in Example 65. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten throusandth transfer paper was also of extremely good quality without substantial difference from the image on the first transfer paper, thus proving that the image-forming member for electrophotography was excelelnt in corona ion resistance, abration resistance and cleaning characteristic and also markedly rich in durability.

Example 72

An image-forming member for electrophotography was prepared according to the same procedure and under the same conditions as in Example 66 except that $C_2H_4(0.1)/H_2$ gas was used in place of $O_2(0.1)/He$ gas and $C_2H_4$ gas in place of $O_2$ gas; and that the flow amount ratio of $SiH_4(10)/H_2$ to $C_2H_4(0.1)/H_2$ in forming the intermediate region layer was changed to 10:0.5.

Using the thus prepared image-forming member for electrophotography, image forming treatment was performed similarly as in Example 66. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristics and also markedly rich in durability.

Example 73

An image-forming member for electrophotography was prepared according to the same procedure and under the same conditions as in Example 67 except that $C_2H_4(0.1)/H_2$ gas was used in place of $O_2(0.1)/He$ gas and $C_2H_4$ gas in place of $O_2$ gas; and that the flow amount ratio of $SiF_4$ to $C_2H_4(0.1)/H_2$ in forming the intermediate region layer was changed to 1:1.

Using the thus prepared image-forming member for electrophotography, image forming treatment was performed similarly as in Example 67. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 74

An image-forming member for electrophotography was prepared according to the same procedure and under the same conditions as in Example 62 except that $NH_3(0.1)/H_2$ was used in place of $O_2(0.1)/He$ gas and $NH_3$ gas in place of $O_2$ gas; and that the flow amount ratio of $SiH_4(10)/H_2$ to $NH_3$ was changed to 50:1 and that of $SiH_4(10)/H_2$ to $NH_3(0.1)/H_2$ to 10:1.

Using the thus prepared image-forming member for electrophotography, image forming treatment was performed similarly as in Example 62. The resulting image on the transfer paper was excellent in resolution, clear with good gradation reproducibility and also high in density.

The image forming treatment as described abobe was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability. As the cleaning method, there was adopted the blade cleaning in which a blade made of a molded product of urethane rubber was employed.

During the repeated image formation, it was observed that the surface potential of the aforesaid image-forming member for electrophotography was constantly about 240 V at the dark portion, while it was about 50 V at the bright portion, being completely free from decrease of potential at the dark portion or the increase of residual potential.

Example 75

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 72, and fully dried. Thereafter the resulting substrate was allowed to stand in a superheated steam bath of 3 atmospheres for 20 minutes. Using the substrate thus treated, an image-forming member was prepared in the same manner as described in Example 72 to test its image-quality and durability. As a result, the image-forming member shows excellent image-characteristics and durability.

Example 76

Amorphous layers were formed in the same manner as described in Example 73, except that the thickness of the coating on the substrate was changed by change of the anodic oxidation time as shown in Table 9. And results shown in Table 9 were obtained by evaluation of image-quality and repeatability. In these cases, development was carried out by using the magnetic brush method and applying the developing bias value capable of producing the best image.

TABLE 9

| Thickness of surface coating (μ) | Quality of the image obtained in the initial operation | Repeatability | Evaluation* |
|---|---|---|---|
| 0.03 | X (low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |
| 20 | ○ (high density) | X (Fog soon occurs) | X |

*⊙Excellent; ○Good; X Poor

Example 77

After a lower barrier layer was formed similarly as in Example 65 on a substrate which had been prepared by applying the same treatment as in Example 1, an amorphous layer was formed on said lower barrier layer similarly as in Example 74 to prepare an image-forming member for electrophotography.

Using the thus prepared image-forming member for electrophotography, image forming treatment was performed similarly as in Example 74. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 78

On a substrate prepared by applying the same treatment as in Example 1, an amorphous layer was formed according to the same procedure and under the same conditions as in Example 66, except for the following conditions, to prepare an image-forming member for electrophotography:

| | |
|---|---|
| Upper layer region | $SiH_4(10)/H_2:NH_3 = 5:1$<br>Layer thickness = 900 Å |
| Intermediate layer region | $SiH_4(10)/H_2:NH_3(0.1)/H_2 = 10:0.3$<br>$SiH_4(10)/H_2:B_2H_6(50)/H_2 = 10:0.2$<br>Time for layer formation:<br>4 hrs. and 30 min. |
| Lower layer region | $SiH_4(10)/H_2:NH_3(0.1)/H_2 = 2:1$<br>$SiH_4(10/H_2:B_2H_6(50)/H_2 = 10:0.2$<br>Time for layer formation: 30 min. |

Using the thus prepared image-forming member for electrophotography, image forming treatment was performed similarly as in Example 66. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 79

An image-forming member for electrophotography was prepared in the same manner as in Example 67 except that $SiF_4$ (10)/Ar gas and $NH_3$ (0.1)/$H_2$ gas were used at a flow amount ratio of 1:20 in forming the lower layer region and the upper layer region constituting the amorphous layer, and that $SiF_4$ (10)/Ar gas and $NH_3$ (0.1)/$H_2$ gas were used at a flow amount ratio of 1:1.2 in forming the intermediate layer region.

Using the thus prepared image-forming member for electrophotography, image forming treatment was performed similarly as in Example 67. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thousandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

Example 80

When Examples 74 to 79 were repeated except that $N_2$, $N_2O$, or ($N_2+O_2$) was used in place of $NH_3$, and corresponding electrophotographic image forming processes were applied to respective image-forming members for electrophotography prepared, there could be obtained transferred images of very high quality. Further, no lowering in transferred image quality was observed after repeated used for a long time.

Example 81

An image-forming member for electrophotography was prepared in the same manner as in Example 48 except that $NH_3$ (0.2)/Ar gas was replaced with $NH_3$ (0.1)/$H_2$ gas.

Using the thus prepared image-forming member for electrophotography, image forming treatment was performed similarly as in Example 67. The resulting image on the transfer paper was excellent in resolution, clear with good gradation reproducibility and also high in density.

The image forming treatment as described above was applied repeatedly to the above image-forming member for electrophotography for testing of durability. As the result, the image obtained on the ten thoudandth transfer paper was also of extremely good quality without substantial difference from the image on the first transfer paper, thus proving that the image-forming member for electrophotography was excellent in corona ion resistance, abrasion resistance and cleaning characteristic and also markedly rich in durability.

What we claim is:

1. An electrophotographic image-forming member, comprising a substrate for electrophotography and an amorphous layer which is laid on said substrate and comprising silicon atoms as matrix and at least one of hydrogen atom and halogen atom and exhibits photoconductivity, said substrate comprising aluminum oxide containing chemi-structurally water at least on the surface thereof, and said amorphous layer having a layer region containing at least one atom selected from the group consisting of oxygen atom, nitrogen atom and carbon atom in at least a part thereof, the content of said atom in said layer region being distributed unevenly in the direction of the thickness of said layer.

2. An electrophotographic image-forming member according to claim 1, wherein the layer region has a peak of the content of said atom distributed in the thickness direction of said layer.

3. An electrophotographic image-forming member according to claim 2, wherein said atom is oxygen atom.

4. An electrophotographic image-forming member according to claim 2, wherein said atom is nitrogen atom.

5. An electrophotographic image-forming member according to claim 2, wherein said atom is carbon atom.

6. An electrophotographic image-forming member according to claim 1, wherein said atom is oxygen atom.

7. An electrophotographic image-forming member according to claim 6, wherein the distribution profile of the content of oxygen atom within said layer region in the layer thickness direction has the maximum value of distribution $C_{max}$ on the side of the surface of the amorphous layer opposite to the side of said substrate.

8. An electrophotographic image-forming member according to claim 7, wherein the maximum value of distribution $C_{max}$ is 0.3 to 67 atomic %.

9. An electrophotographic image-forming member according to claim 7, wherein the maximum value of distribution $C_{max}$ is 0.3 to 67 atomic % and the total content of oxygen atom in the layer region is 0.05 to 30 atomic %.

10. An electrophotographic image-forming member according to claim 6, wherein the distribution profile of the content of oxygen atom within the layer region in the layer thickness direction has the maximum value of distribution $C_{max}$ on the side of the support.

11. An electrophotographic image-forming member according to claim 10, wherein the maximum value of distribution $C_{max}$ is 0.3 to 67 atomic %.

12. An electrophotographic image-forming member according to claim 10, wherein the maximum value of distribution $C_{max}$ is 0.3 to 67 atomic % and the total of nitrogen atom in the layer region is 0.05 to 30 atomic %.

13. An electrophotographic image-forming member according to claim 6, wherein the amorphous layer is constituted of a lower layer region in which the content of oxygen atom is distributed substantially uniformly in the layer thickness direction at a distribution content of $C_1$, an upper layer region in which the content of oxygen atom is distributed substantially uniformly in the layer thickness direction at a distribution content of $C_2$ and an intermediate layer region sandwiched between both of said layers, in which the content of oxygen atom is distributed substantially uniformly in the layer thickness direction at a distribution content of $C_3$, the values of $C_1$ and $C_2$ being respectively greater than the value of $C_3$.

14. An electrophotographic image-forming member according to claim 13, wherein values of the distribution contents $C_1$ and $C_2$ range from 11 to 66 atomic %, and a value of the distribution content $C_3$ from 0.01 to 10 atomic %.

15. An electrophotographic image-forming member according to claim 13, wherein the total content of oxygen atom is 0.05 to 30 atomic %, and values of the distribution contents $C_1$ and $C_2$ range from 11 to 66 atomic %, and a value of the distribution content $C_3$ from 0.01 to 10 atomic %.

16. An electrophotographic image-forming member according to claim 1, wherein said atom is nitrogen atom.

17. An electrophotographic image-forming member according to claim 16, wherein the distribution profile of the content of nitrogen atom within said layer region in the layer thickness direction has the maximum value of distribution $C_{max}$ on the side of the surface of the amorphous layer opposite to the side of said substrate.

18. An electrophotographic image-forming member according to claim 17, wherein the maximum value of distribution $C_{max}$ is 0.1 to 60 atomic %.

19. An electrophotographic image-forming member according to claim 17, wherein the maximum value of distribution $C_{max}$ is 0.1 to 60 atomic % and the total content of nitrogen atom in the layer region is 0.02 to 30 atomic %.

20. An electrophotographic image-forming member according to claim 6, wherein the distribution profile of the content of nitrogen atom within the layer region in the layer thickness direction has the maximum value of distribution $C_{max}$ on the side of the substrate.

21. An electrophotographic image-forming member according to claim 20, wherein the maximum value of distribution $C_{max}$ is 0.1 to 60 atomic %.

22. An electrophotographic image-forming member according to claim 20, wherein the maximum value of distribution $C_{max}$ is 0.1 to 60 atomic % and the total content of nitrogen atom in the layer region is 0.02 to 30 atomic %.

23. An electrophotographic image-forming member according to claim 16, wherein the amorphous layer is constituted of a lower layer region in which the content of nitrogen atom is distributed substantially uniformly in the layer thickness direction at a distribution content of $C_1$, an upper layer region in which the content of nitrogen atom is distributed substantially uniformly in the layer thickness direction at a distribution content of $C_2$ and an intermediate layer region sandwiched between both of said layers, in which the content of nitrogen atom is distributed substantially uniformly in the layer thickness direction at a distribution content of $C_3$, the values of $C_1$ and $C_2$ being respectively greater than the value of $C_3$.

24. An electrophotographic image-forming member according to claim 23, wherein values of the distribution contents $C_1$ and $C_2$ range from 11 to 60 atomic %, and a value of the distribution content $C_3$ from 0.005 to 10 atomic %.

25. An electrophotographic image-forming member according to claim 23, wherein the total content of nitrogen atom in the amorphous layer is 0.02 to 30 atomic %, and values of the distribution contents $C_1$ and $C_2$ range from 11 to 60 atomic %, and a value of the distribution content $C_3$ from 0.005 to 10 atomic %.

26. An electrophotographic image-forming member according to claim 1, wherein said atom is carbon atom.

27. An electrophotographic image-forming member according to claim 26, wherein the distribution profile of the content of carbon atom within said layer region in the layer thickness direction has the maximum value of distribution $C_{max}$ on the side of the surface of the amorphous layer opposite to the side of said substrate.

28. An electrophotographic image-forming member according to claim 27, wherein the maximum value of distribution $C_{max}$ is 0.03 to 90 atomic %.

29. An electrophotographic image-forming member according to claim 27, wherein the maximum value of distribution $C_{max}$ is 0.03 to 90 atomic % and the total content of carbon atoms in the layer region is 0.005 to 30 atomic %.

30. An electrophotographic image-forming member according to claim 26, wherein the distribution profile of the content of carbon atom within the layer region in the layer thickness direction has the maximum value of distribution $C_{max}$ on the side of the substrate.

31. An electrophotographic image-forming member according to claim 30, wherein the maximum value of distribution $C_{max}$ is 0.03 to 90 atomic %.

32. An electrophotographic image-forming member according to claim 30, wherein the maximum value of distribution $C_{max}$ is 0.03 to 90 atomic % and the total content of carbon atom in the layer region is 0.005 to 30 atomic %.

33. An electrophotographic image-forming member according to claim 26, wherein the amorphous layer is constituted of a lower layer region in which the content of carbon atom is distributed substantially uniformly in the layer thickness direction at a distribution content of $C_1$, an upper layer region in which the content of carbon atom is distributed substantially uniformly in the layer thickness direction at a distribution content of $C_2$ and an intermediate layer region sandwiched between both of said layers, in which the content of carbon atom is distributed substantially uniformly in the layer thickness direction at a distribution content of $C_3$, the values of $C_1$ and $C_2$ being respectively greater than the value of $C_3$.

34. An electrophotographic image-forming member according to claim 33, wherein values of the distribution content $C_1$ and $C_2$ range from 11 to 90 atomic %, and a value of the distribution content $C_3$ from 0.01 to 10 atomic %.

35. An electrophotographic image-forming member according to claim 33, wherein the total content of carbon atom is 0.005 to 30 atomic %, and values of the distribution contents $C_1$ and $C_2$ range from 11 to 90 atomic %, and a value of the distribution content $C_3$ from 0.001 to 10 atomic %.

36. An electrophotographic image-forming member according to claim 1, wherein the amorphous layer contains an impurity which controls the electric conduction type.

37. An electrophotographic image-forming member according to claim 36, wherein the impurity is a p-type impurity.

38. An electrophotographic image-forming member according to claim 37, wherein the p-type impurity is an element in the group III A of the periodic table.

39. An electrophotographic image-forming member according to claim 38, wherein the element is selected from the group consisting of B, Al, Ga, In and Tl.

40. An electrophotographic image-forming member according to claim 37, wherein the content of the p-type impurity is $3\times10^{-2}$ atomic % or less.

41. An electrophotographic image-forming member according to claim 36, wherein the impurity is a n-type impurity.

42. An electrophotographic image-forming member according to claim 41, wherein the n-type impurity is an element in the group V A of the periodic table.

43. An electrophotographic image-forming member according to claim 42, wherein the element is selected from the group consisting of N, P, As, Sb and Bi.

44. An electrophotographic image-forming member according to claim 1, wherein the amorphous layer has a thickness of 3 to 100μ.

45. An electrophotographic image-forming member according to claim 1, wherein there is further provided an intermediate layer between the support and the amorphous layer.

46. An electrophotographic image-forming member according to claim 45, wherein the intermediate layer is a barrier layer.

47. An electrophotographic image-forming member according to claim 45, wherein the intermediate layer comprises an amorphous material comprising silicon atoms as matrix and at least one atom selected from the group consisting of carbon atom, nitrogen atom and oxygen atom as constituent elements.

48. An electrophotographic image-forming member according to claim 47, wherein the amorphous material further contains at least one of hydrogen atom and halogen atom as constituent elements.

49. An electrophotographic image-forming member according to claim 47, wherein the amorphous material is represented by the formula $Si_aC_{1-a}$ wherein a is 0.1 to 0.4.

50. An electrophotographic image-forming member according to claim 47, wherein the amorphous material is represented by the formula $(Si_bC_{1-b})_cH_{1-c}$ wherein b is 0.1 to 0.5 and c is 0.6 to 0.99.

51. An electrophotographic image-forming member according to claim 47, wherein the amorphous material is represented by the formula $(Si_dC_{1-d})_eX_{1-e}$ wherein X represents a halogen atom, d is 0.1 to 0.47 and e is 0.8 to 0.99.

52. An electrophotographic image-forming member according to claim 47, wherein the amorphous material is represented by the formula $(Si_fC_{1-f})_g(H+X)_{1-g}$ wherein X represents a halogen atom, f is 0.1 to 0.47 and g is 0.8 to 0.99.

53. An electrophotographic image-forming member according to claim 47, wherein the amorphous material is represented by the formula $Si_hN_{1-h}$ wherein h is 0.43 to 0.6.

54. An electrophotographic image-forming member according to claim 47, wherein the amorphous material is represented by the formula $(Si_iN_{1-i})_jH_{1-j}$ wherein i is 0.43 to 0.6 and j is 0.65 to 0.98.

55. An electrophotographic image-forming member according to claim 47, wherein the amorphous material is represented by the formula $(Si_kN_{1-k})_lX_{1-l}$ wherein X represents a halogen atom, k is 0.43 to 0.60 and l is 0.8 to 0.99.

56. An electrophotographic image-forming member according to claim 47, wherein the amorphous material is represented by the formula $(Si_mN_{1-m})_n(H+X)_{1-n}$ wherein X represents a halogen atom, m is 0.43 to 0.60 and n is 0.8 to 0.99.

57. An electrophotographic image-forming member according to claim 47, wherein the amorphous material is represented by the formula $Si_oO_{1-o}$ wherein o is 0.33 to 0.40.

58. An electrophotographic image-forming member according to claim 47, wherein the amorphous material is represented by the formula $(Si_pO_{1-p})_qH_{1-q}$ wherein p is 0.33 to 0.40 and g is 0.65 to 0.98.

59. An electrophotographic image-forming member according to claim 47, wherein the amorphous material is represented by the formula $(Si_rO_{1-r})_sX_{1-s}$ wherein X represents a halogen atom, r is 0.33 to 0.40 and s is 0.80 to 0.89.

60. An electrophotographic image-forming member according to claim 47, wherein the amorphous material is represented by the formula $(Si_tO_{1-t})_u(H+X)_{1-u}$ wherein X represents a halogen atom, t is 0.33 is 0.40 and u is 0.80 to 0.99.

61. An electrophotographic image-forming member according to claim 45, wherein the intermediate layer comprises an electrically insulating metal oxide.

62. An electrophotographic image-forming member according to claim 45, wherein the intermediate layer has a thickness of 30 to 1000 Å.

63. An electrophotographic image-forming member according to claim 1, wherein there is further provided an upper layer on the amorphous layer.

64. An electrophotographic image-forming member according to claim 63, wherein the upper layer is a barrier layer.

65. An electrophotographic image-forming member according to claim 63, wherein the upper layer comprises an amorphous material comprising silicon atoms as matrix and at least one atom selected from the group consisting of carbon atom, nitrogen atom and oxygen atom as constituent elements.

66. An electrophotographic image-forming member according to claim 65, wherein the amorphous material further contains at least one of hydrogen atom and halogen atom as constituent elements.

67. An electrophotographic image-forming member according to claim 65, wherein the amorphous material is represented by the formula $Si_aC_{1-a}$ wherein a is 0.1 to 0.4.

68. An electrophotographic image-forming member according to claim 65, wherein the amorphous material is represented by the formula $(Si_bC_{1-b})_cH_{1-c}$ wherein b is 0.1 to 0.5 and c is 0.6 to 0.99.

69. An electrophotographic image-forming member according to claim 65, wherein the amorphous material is represented by the formula $(Si_dC_{1-d})_eX_{1-e}$ wherein X represents a halogen atom, d is 0.1 to 0.47 and e is 0.8 to 0.99.

70. An electrophotographic image-forming member according to claim 65, wherein the amorphous material is represented by the formula $(Si_fC_{1-f})_g(H+X)_{1-g}$ wherein X represents a halogen atom, f is 0.1 to 0.47 and g is 0.8 to 0.99.

71. An electrophotographic image-forming member according to claim 65, wherein the amorphous material is represented by the formula $Si_hN_{1-h}$ wherein h is 0.43 to 0.6.

72. An electrophotographic image-forming member according to claim 65, wherein the amorphous material is represented by the formula $(Si_iN_{1-i})_jH_{1-j}$ wherein i is 0.43 to 0.6 and j is 0.65 to 0.98.

73. An electrophotographic image-forming member according to claim 65, wherein the amorphous material is represented by the formula $(Si_kN_{1-k})_lX_{1-l}$ wherein X represents a halogen atom, k is 0.43 to 0.60 and l is 0.8 to 0.99.

74. An electrophotographic image-forming member according to claim 65, wherein the amorphous material is represented by the formula $(Si_mN_{1-m})_n(H+X)_{1-n}$ wherein X represents a halogen atom, m is 0.43 to 0.60 and n is 0.8 to 0.99.

75. An electrophotographic image-forming member according to claim 65, wherein the amorphous material is represented by the formula $Si_oO_{1-o}$ wherein o is 0.33 to 0.40.

76. An electrophotographic image-forming member according to claim 65, wherein the amorphous material is represented by the formula $(Si_pO_{1-p})_qH_{1-q}$ wherein p is 0.33 to 0.40 and q is 0.65 to 0.98.

77. An electrophotographic image-forming member according to claim 65, wherein the amorphous material is represented by the formula $(Si_rO_{1-r})_sX_{1-s}$ wherein X represents a halogen atom, r is 0.33 to 0.40 and s is 0.80 to 0.89.

78. An electrophotographic image-forming member according to claim 65, wherein the amorphous material is represented by the formula $(Si_tO_{1-t})_u(H+X)_{1-u}$ wherein X represents a halogen atom, t is 0.33 to 0.40 and u is 0.80 to 0.99.

79. An electrophotographic image-forming member according to 63, wherein the upper layer comprises an electrically insulating metal oxide.

80. An electrophotographic image-forming member according to claim 63, wherein the upper layer has a thickness of 30 Å to 5μ.

81. An electrophotographic image-forming member according to claim 1, wherein the content of hydrogen atom in the amorphous layer is 1 to 40 atomic %.

82. An electrophotographic image-forming member according to claim 1, wherein the content of halogen atom in the amorphous layer is 1 to 40 atomic %.

83. An electrophotographic image-forming member according to claim 1, wherein both hydrogen atom and halogen atom are contained in the amorphous layer.

84. An electrophotographic image-forming member according to claim 83, wherein the sum of contents of hydrogen atom and halogen atom is 1 to 40 atomic %.

85. An electrophotographic image-forming member according to claim 84, wherein the content of hydrogen atoms is 19 atomic % or less.

86. An electrophotographic image-forming member according to claim 6, wherein the content of oxygen atom in the layer region is 0.05 to 30 atomic %.

87. An electrophotographic image-forming member according to claim 16, wherein the content of nitrogen atom in the layer region is 0.02 to 30 atomic %.

88. An electrophotographic image-forming member according to claim 26, wherein the content of carbon atom in the layer region is 0.005 to 30 atomic %.

89. An electrophotographic image-forming member, comprising a substrate for an electrophotographic image-forming member said chemi-structurally water at least on the surface thereof and an amorphous layer which comprises silicon atoms as matrix and exhibits photoconductivity, said amorphous layer containing oxygen atoms and the distribution profile of content of oxygen atoms being uneven in the direction of the layer thickness and having a maximum value $C_{max}$.

90. An electrophotographic image-forming member according to claim 89, wherein the content of oxygen atom in the amorphous layer is 0.05 to 30 atomic %.

91. An electrophotographic image-forming member according to claim 89, wherein the amorphous layer further contains at least one atom selected from the group consisting of hydrogen atom and halogen atom as constituent elements.

92. An electrophotographic image-forming member according to claim 89, wherein the maximum value $C_{max}$ in the content distribution of oxygen atom is 0.3 to 67 atomic %.

93. An electrophotographic image-forming member according to claim 6 or claim 89, wherein there is at least one portion in which the content distribution of oxygen atom is continuously decreased.

94. An electrophotographic image-forming member according to claim 89, wherein the amorphous layer is constituted of a lower layer region in which the content of oxygen atom is distributed substantially uniformly in the layer thickness direction at a distribution content of $C_1$, an upper layer region in which the content of oxygen atom is distributed substantially uniformly in the layer thickness direction at a distribution content of $C_2$ and an intermediate layer region sandwiched between both of said layers, in which the content of oxygen atom is distributed substantially uniformly in the layer thickness direction at a distribution content of $C_3$, the values of $C_1$ and $C_2$ being respectively greater than the value of $C_3$.

95. An electrophotographic image-forming member according to claim 9 or claim 94, wherein $C_1$ and $C_2$ are substantially equal.

96. An electrophotographic image-forming member according to claim 13 or claim 94, wherein $C_1$ and $C_2$ are different.

97. An electrophotographic image-forming member, comprising a support for a photoconductive member, said substrate comprising aluminum oxide containing chemi-structurally water at least on the surface thereof and an amorphous layer which comprises silicon atoms as matrix and exhibits photoconductivity, said amorphous layer containing nitrogen atoms and the distribution profile of the content of nitrogen atom being uneven in the direction of the layer thickness and having a maximum value $C_{max}$.

98. An electrophotographic image-forming member according to claim 97, wherein the content of nitrogen atom in the amorphous layer is 0.02 to 30 atomic %.

99. An electrophotographic image-forming member according to claim 97, wherein the amorphous layer further contains at least one atom selected from the group consisting of hydrogen atom and halogen atom as constituent elements.

100. An electrophotographic image-forming member according to claim 97, wherein the maximum value $C_{max}$ in the content distribution of nitrogen atom is 0.1 to 60 atomic %.

101. An electrophotographic image-forming member according to claim 16 or claim 97, wherein there is at least one portion in which the content distribution of nitrogen atom is continuously decreased.

102. An electrophotographic image-forming member according to claim 97, wherein the amorphous layer is constituted of a lower layer region in which the content of nitrogen atom is distributed substantially uniformly in the layer thickness direction at a distribution content of $C_1$, an upper layer region in which the content of nitrogen atom is distributed substantially uniformly in the layer thickness direction at a distribution content of $C_2$ and an intermediate layer region sandwiched between both of said layers, in which the content of nitrogen atom is distributed substantially uniformly in the layer thickness direction at a distribution content of $C_3$, the values of $C_1$ and $C_2$ being respectively greater than the value of $C_3$.

103. An electrophotographic image-forming member according to claim 23 or claim 97, wherein $C_1$ and $C_2$ are substantially equal.

104. An electrophotographic image-forming member according to claim 23 or claim 97, wherein $C_1$ and $C_2$ are different.

105. An electrophotographic image-forming member, comprising a substrate for a photoconductive member said substrate comprising aluminum oxide containing chemi-structurally water at least on the surface thereof and an amorphous layer which comprises silicon atoms as matrix and exhibits photoconductivity, said amorphous layer containing carbon atoms and the distribution profile of the content of carbon atom being uneven in the direction of the layer thickness and having a maximum value $C_{max}$.

106. An electrophotographic image-forming member according to claim 105, wherein the content of carbon atom in the amorphous layer is 0.005 to 30 atomic %.

107. An electrophotographic image-forming member according to claim 105, wherein the amorphous layer further contains at least one atom selected from the group consisting of hydrogen atom and halogen as constituent elements.

108. An electrophotographic image-forming member according to claim 105, wherein the maximum value $C_{max}$ in the content distribution of carbon atom is 0.03 to 90 atomic %.

109. An electrophotographic image-forming member according to claim 26 or claim 105, wherein there is at least one portion in which the content distribution of carbon atom is continuously decreased.

110. An electrophotographic image-forming member according to claim 105, wherein the amorphous layer is constituted of a lower layer region in which the content of carbon atom is distributed substantially uniformly in the layer thickness direction at a distribution content of $C_1$, an upper layer region in which the content of carbon atom is distributed substantially uniformly in the layer thickness direction at a distribution content of $C_2$ and an intermediate layer region sandwiched between both of said layers, in which the content of carbon atom is distributed substantially uniformly in the layer thickness direction at a distribution content of $C_3$, the values of $C_1$ and $C_2$ being respectively greater than the value of $C_3$.

111. An electrophotographic image-forming member according to claim 33 or claim 110, wherein $C_1$ and $C_2$ are substantially equal.

112. An electrophotographic image-forming member according to claim 33 or claim 110, wherein $C_1$ and $C_2$ are different.

113. An electrophotographic image-forming member according to claim 1, wherein the distribution profile of the content of said atoms within said layer region in the layer thickness direction has a portion in which said content increases toward the side of the support.

114. An electrophotographic image-forming member according to claim 1, wherein the distribution profile of the content of said atoms within said layer region in the layer thickness direction has a portion in which said content increases toward the side opposite to the side of the support.

115. An electrophotographic image-forming member according to claim 1, wherein the distribution profile of the content of said atoms within said layer region in the layer thickness direction has two portions in which said content increases toward each of the both end sides of said layer.

116. An electrophotographic image-forming member according to claim 1, wherein the distribution profile of the content of said atoms within said layer region in the layer thickness direction is concave.

117. An electrophotographic image-forming member according to claim 89, wherein the distribution profile of the content of oxygen within said layer region in the layer thickness direction has a portion in which said content increases toward the side of the support.

118. An electrophotographic image-forming member according to claim 89, wherein the distribution profile of the content of oxygen within said layer region in the layer thickness direction has a portion in which said content increases toward the side opposite to the side of the support.

119. An electrophotographic image-forming member according to claim 89, wherein the distribution profile of the content of oxygen within said layer region in the layer thickness direction has a portion in which said content increases toward each of the both end sides of said layer.

120. An electrophotographic image-forming member according to claim 89, wherein the distribution profile of the content of oxygen within said layer region in the layer thickness direction is concave.

121. An electrophotographic image-forming member according to claim 97, wherein the distribution profile of the content of nitrogen within said layer region in the layer thickness direction has a portion in which said content increases toward the side of the support.

122. An electrophotographic image-forming member according to claim 97, wherein the distribution profile of the content of nitrogen within said layer region in the layer thickness direction has a portion in which said content increases toward the side opposite to the side of the support.

123. An electrophotographic image-forming member according to claim 97, wherein the distribution profile of the content of nitrogen within said layer region in the layer thickness direction has two portions in which said content increases toward each of the both end sides of said layer.

124. An electrophotographic image-forming member according to claim 97, wherein the distribution profile of the content of nitrogen within said layer region in the layer thickness direction is concave.

125. An electrophotographic image-forming member according to claim 1, wherein the distribution profile of the content of carbon within said layer region in the layer thickness direction has a portion in which said content increases toward the side of the support.

126. An electrophotographic image-forming member according to claim 1, wherein the distribution profile of the content of carbon within said layer region in the layer thickness direction has a portion in which said content increases toward the side opposite to the side of the support.

127. An electrophotographic image-forming member according to claim 1, wherein the distribution profile of the content of carbon within said layer region in the layer thickness direction has two portions in which said content increases toward each of the both end sides of said layer.

128. An electrophotographic image-forming member according to claim 1, wherein the distribution profile of the content of nitrogen within said layer region in the layer thickness direction is concave.

129. An electrophotographic image-forming member according to claim 89, wherein the amorphous layer contains an impurity which controls the electric conduction type.

130. An electrophotographic image-forming member according to claim 129, wherein the impurity is a p-type impurity.

131. An electrophotographic image-forming member according to claim 130, wherein the p-type impurity is an element in Group III A of the Periodic Table.

132. An electrophotographic image-forming member according to claim 131, wherein the element is selected from the group consisting of B, Al, Ga, In and Tl.

133. An electrophotographic image-forming member according to claim 130, wherein the content of the p-type impurity is $3\times10^{-2}$ atomic % or less.

134. An electrophotographic image-forming member according to claim 129, wherein the impurity is an n-type impurity.

135. An electrophotographic image-forming member according to claim 134, wherein the n-type impurity is an element in Group V A of the Periodic Table.

136. An electrophotographic image-forming member according to claim 135, wherein the element is selected from the group consisting of N, P, As, Sb and Bi.

137. An electrophotographic image-forming member according to claim 89, wherein the amorphous layer has a thickness of 3 to 100μ.

138. An electrophotographic image-forming member according to claim 89, wherein there is further provided an intermediate layer between the support and the amorphous layer.

139. An electrophotographic image-forming member according to claim 138, wherein the intermediate layer is a barrier layer.

140. An electrophotographic image-forming member according to claim 138, wherein the intermediate layer comprises an amorphous material comprising silicon atoms as matrix and at least one atom selected from the group consisting of carbon atom, nitrogen atom and oxygen atom as constituent elements.

141. An electrophotographic image-forming member according to claim 140, wherein the amorphous material further contains at least one of hydrogen atom and halogen atom as constituent elements.

142. An electrophotographic image-forming member according to claim 97, wherein the amorphous layer contains an impurity which controls the electric conduction type.

143. An electrophotographic image-forming member according to claim 142, wherein the impurity is a p-type impurity.

144. An electrophotographic image-forming member according to claim 143, wherein the p-type impurity is an element in Group III A of the Periodic Table.

145. An electrophotographic image-forming member according to claim 144, wherein the element is selected from the group consisting of B, Al, Ga, In and Tl.

146. An electrophotographic image-forming member according to claim 143, wherein the content of the p-type impurity is $3\times10^{10-2}$ atomic % or less.

147. An electrophotographic image-forming member according to claim 142, wherein the impurity is an n-type impurity.

148. An electrophotographic image-forming member according to claim 147, wherein the n-type impurity is an element in Group V A of the Periodic Table.

149. An electrophotographic image-forming member according to claim 148, wherein the element is selected from the group consisting of N, P, As, Sb and Bi.

150. An electrophotographic image-forming member according to claim 97, wherein the amorphous layer has a thickness of 3 to 100μ.

151. An electrophotographic image-forming member according to claim 97, wherein there is further provided an intermediate layer between the support and the amorphous layer.

152. An electrophotographic image-forming member according to claim 151, wherein the intermediate layer is a barrier layer.

153. An electrophotographic image-forming member according to claim 151, wherein the intermediate layer comprises an amorphous material comprising silicon atoms as matrix and at least one atom selected from the group consisting of carbon atoms, nitrogen atom and oxygen atom as constituent elements.

154. An electrophotographic image-forming member according to claim 153, wherein the amorphous material further contains at least one of hydrogen atom and halogen atom as constituent elements.

155. An electrophotographic image-forming member according to claim 105, wherein the amorphous layer contains an impurity which controls the electric conduction type.

156. An electrophotographic image-forming member according to claim 155, wherein the impurity is a p-type impurity.

157. An electrophotographic image-forming member according to claim 156, wherein the p-type impurity is an element in Group III A of the Periodic Table.

158. An electrophotographic image-forming member according to claim 157, wherein the element is selected from the group consisting of B, Al, Ga, In and Tl.

159. An electrophotographic image-forming member according to claim 156, wherein the content of the p-type impurity is $3\times10^{-2}$ atomic % or less.

160. An electrophotographic image-forming member according to claim 155, wherein the impurity is an n-type impurity.

161. An electrophotographic image-forming member according to claim 160, wherein the n-type impurity is an element in Group V A of the Periodic Table.

162. An electrophotographic image-forming member according to claim 161, wherein the element is selected from the group consisting of N, P, As, Sb and Bi.

163. An electrophotographic image-forming member according to claim 105, wherein the amorphous layer has a thickness of 3 to 100$\mu$.

164. An electrophotographic image-forming member according to claim 105, wherein there is further provided an intermediate layer between the support and the amorphous layer.

165. An electrophotographic image-forming member according to claim 164, wherein the intermediate layer is a barrier layer.

166. An electrophotographic image-forming member according to claim 164, wherein the intermediate layer comprises of an amorphous material comprising silicon atoms as matrix and at least one atom selected from the group consisting of carbon atom, nitrogen atom and oxygen atom as constituent elements.

167. An electrophotographic image-forming member according to claim 166, wherein the amorphous material further contains at least one of hydrogen atom and halogen atom as constituent elements.

* * * * *

UNITED STATES PATENT AND TRADEMARK OFFICE

CERTIFICATE OF CORRECTION

PATENT NO. : 4,464,451

DATED : August 7, 1984

INVENTOR(S) : Shirai et al.

It is certified that error appears in the above-identified patent and that said Letters Patent is hereby corrected as shown below:

Column 1, line 27, change "as" to --causes--.

Column 2, line 36, change "requires" to --requirements--.

Column 3, line 27, change "oxgen" to --oxygen--.

Column 4, line 66, change "supplied" to --applied--.

Column 5, line 33, after "characteristics" insert --and--.

Column 5, line 48, delete "is" before "depends".

Column 7, line 27, after "$BrF_5$" insert --$BrF_3$--.

Column 10, lines 40-41, change "productibity" to --productivity--.

Column 10, line 55, after "30" insert --to--.

line 68, after "atoms" delete --is--. (1st occurrence).

line 68, after "atoms" insert --is-- (2nd occurrence).

UNITED STATES PATENT AND TRADEMARK OFFICE

CERTIFICATE OF CORRECTION

PATENT NO. : 4,464,451

DATED : August 7, 1984

INVENTOR(S) : Shirai et al.

It is certified that error appears in the above-identified patent and that said Letters Patent is hereby corrected as shown below:

Column 14, line 7, delete "or".

Column 18, line 14, change "amrophous" to --amorphous--.

line 45, change "amrophous" to --amorphous--.

Column 20, line 28, change "based" to --most--.

Column 22, line 19, change "at" to --as--.

Column 23, line 20, change "sued" to --used--.

Column 24, line 21, change "$SiH_2Br_{21}$, $SiHBr_3$" to --$SiH_2Br_2$, $SiHBr_3$--.

Column 24, line 23, change "sued" to --used--.

line 33, change "$Si_3H_3$" to --$Si_3H_8$--.

Column 26, line 39, change "at" to --to--.

Column 27, Table 1, In "Repeatability" column, change all occurrences of "extend" to --extent--.

Column 28, line 5, change "1472" to --1427--.

Column 29, line 17, change "to" to --as--.

Column 30, line 39, change "to" to --as--.

Column 32, line 20, change "graphine" to --graphite--.

UNITED STATES PATENT AND TRADEMARK OFFICE

CERTIFICATE OF CORRECTION

PATENT NO. : 4,464,451

DATED : August 7, 1984

INVENTOR(S) : Shirai et al.

It is certified that error appears in the above-identified patent and that said Letters Patent is hereby corrected as shown below:

Column 33, line 1, change "to" to --as--.

line 2, change "shar" to --sharp--.

Column 34, Table 2, under the "Repeatability" column, change all occurrences of "extend" to --extent--.

Column 34, line 46, change "rich" to --high--.

line 68, change "rich" to --high--.

Column 36, line 3, change "to" to --as--.

Column 36, line 28, change "rich" to --high--.

Table 3, under "Repeatability" column, change all occurrences of "extend" to --extent--.

Column 37, Table 3, under "Repeatability" column, change "extend" to --extent--.

Column 37, line 37, change "rich" to --high--.

line 59, change "rich" to --high--.

Column 38, line 38, change "rich" to --high--.

line 61, change "to" to --as--.

Column 39, line 13, change "discribed" to --described--.

UNITED STATES PATENT AND TRADEMARK OFFICE

CERTIFICATE OF CORRECTION

PATENT NO. : 4,464,451

DATED : August 7, 1984

INVENTOR(S) : Shirai et al.

It is certified that error appears in the above-identified patent and that said Letters Patent is hereby corrected as shown below:

line 57, change "frequence" to --frequency--.

line 63, change "600$\sqrt[3]{\ }$" to --600Å--.

Column 40, line 31, change "image-formed" to --image-forming--.

line 57, change "rich to --high--.

Column 41, line 9, change "atmosphers" to --atmospheres--.

Column 41, Table 4, under the "Repeatability" column, change all occurrences of "extend" to --extent--.

Column 41, line 50, change "to" to --as--.

Column 42, line 7, change "which" to --after--.

Column 47, line 51, change "elecrophotography" to --electrophotography--.

Column 48, Table 5, under "Repeatability" column, change all instances of "extend" to --extent--.

Column 51, Table 6, under "Repeatability" column, change all instances of "extend" to --extent--.

UNITED STATES PATENT AND TRADEMARK OFFICE

CERTIFICATE OF CORRECTION

PATENT NO. : 4,464,451

DATED : August 7, 1984

INVENTOR(S) : Shirai et al.

It is certified that error appears in the above-identified patent and that said Letters Patent is hereby corrected as shown below:

Column 52, line 36, change "paer" to --paper--.

Column 56 Table 7, under "Repeatability" column, change all instances of "extend" to --extent-- and also insert "O" before ("Fog occurs in the third instance").

Column 60 Table 8, under "Repeatability" column, change all instances of "extend" to --extent--.

Column 60, line 62, change "throusandth" to --thousandth--.

Column 60, line 66, change "excelelnt" to --excellent--.

Column 61, line 66, change "abobe" to --above--.

Column 62, Table 9, under "Repeatability" column, change all instances of "extend" to --extent--.

Column 64, line 22, change "used" to --use--.

IN THE CLAIMS:

Claim 60, change "is" (2d occurrence) to --to--.

UNITED STATES PATENT AND TRADEMARK OFFICE

CERTIFICATE OF CORRECTION

PATENT NO. : 4,464,451

DATED : August 7, 1984

INVENTOR(S) : Shirai, et al.

It is certified that error appears in the above-identified patent and that said Letters Patent is hereby corrected as shown below:

Claim 89, line 3, after "said" insert --substrate comprising aluminum oxide containing--.

Claim 97, line 3, change "substrate" to --support--.

Claim 146, change "3 x $10^{10-2}$" to --3 x $10^{-2}$--.

Signed and Sealed this

*Eleventh* Day of *June 1985*

[SEAL]

*Attest:*

DONALD J. QUIGG

*Attesting Officer* *Acting Commissioner of Patents and Trademarks*